US011407538B2

(12) United States Patent
Lancaster, III et al.

(10) Patent No.: US 11,407,538 B2
(45) Date of Patent: Aug. 9, 2022

(54) PACKAGING MATERIAL PROFILING FOR CONTAINMENT FORCE-BASED WRAPPING

(71) Applicant: Lantech.com, LLC, Louisville, KY (US)

(72) Inventors: Patrick R. Lancaster, III, Louisville, KY (US); Michael P. Mitchell, Louisville, KY (US)

(73) Assignee: LANTECH.COM, LLC, Louisville, KY (US)

( * ) Notice: Subject to any disclaimer, the term of this patent is extended or adjusted under 35 U.S.C. 154(b) by 600 days.

(21) Appl. No.: 16/299,800

(22) Filed: Mar. 12, 2019

(65) Prior Publication Data

US 2019/0202584 A1 Jul. 4, 2019

Related U.S. Application Data

(62) Division of application No. 14/179,843, filed on Feb. 13, 2014, now Pat. No. 10,239,645.
(Continued)

(51) Int. Cl.
*B65B 11/58* (2006.01)
*B65B 11/02* (2006.01)
(Continued)

(52) U.S. Cl.
CPC ..... *B65B 11/58* (2013.01); *B65B 11/00* (2013.01); *B65B 11/008* (2013.01);
(Continued)

(58) Field of Classification Search
CPC ..... B65B 11/58; B65B 11/00; B65B 11/045; B65B 11/025; B65B 11/008; B65B 57/04;
(Continued)

(56) References Cited

U.S. PATENT DOCUMENTS 2,076,617 A 4/1937 Cleaves
2,227,398 A 12/1940 Mohl
(Continued)

FOREIGN PATENT DOCUMENTS

CA 2277316 A1 1/2001
DE 3140972 A1 6/1982
(Continued)

OTHER PUBLICATIONS

European Patent Office; Office Action in European Patent Application No. 14708716.7 dated Oct. 4, 2016 3 pages.
(Continued)

*Primary Examiner* — Gloria R Weeks
*Assistant Examiner* — Mobeen Ahmed
(74) *Attorney, Agent, or Firm* — Middleton Reutlinger

(57) ABSTRACT

Packaging material may be profiled to generate an incremental containment force per revolution (ICF) attribute that is represented by a function that is variable as a function of wrap force. Moreover, the performance of different packaging materials, e.g., in terms of speed or cost, may be compared for a particular load through simulation of wrap operations based upon dimensions of the load and a desired load containment force requirement for the load.

31 Claims, 24 Drawing Sheets

Related U.S. Application Data

(60) Provisional application No. 61/764,107, filed on Feb. 13, 2013.

(51) Int. Cl.

| | |
|---|---|
| ***B65B 11/04*** | (2006.01) |
| ***B65B 11/00*** | (2006.01) |
| ***B65B 57/04*** | (2006.01) |
| *B65B 59/00* | (2006.01) |
| *B65B 59/02* | (2006.01) |

(52) U.S. Cl.
CPC ..... *B65B 11/025* (2013.01); *B65B 11/045* (2013.01); *B65B 57/04* (2013.01); *B65B 59/003* (2019.05); *B65B 59/02* (2013.01); *B65B 2210/04* (2013.01); *B65B 2210/14* (2013.01); *B65B 2220/14* (2013.01)

(58) Field of Classification Search
CPC ... B65B 2210/04; B65B 57/00; B65B 59/003; B65B 59/02; B65B 2210/14; B65B 2220/14
See application file for complete search history.

(56) References Cited

U.S. PATENT DOCUMENTS 2,904,196 A 9/1959 Teixeira
3,029,571 A 4/1962 Douthit
3,707,658 A 12/1972 Hilsenbeck
3,776,081 A * 12/1973 Becker ..... B65B 41/16 83/272
3,815,313 A 6/1974 Heisler
3,867,806 A 2/1975 Lancaster, III
3,910,005 A 10/1975 Thimon et al.
4,077,179 A 3/1978 Lancaster et al.
4,079,566 A 3/1978 Stoecklin
4,152,879 A 5/1979 Shulman
4,216,640 A 8/1980 Kaufman
4,235,062 A 11/1980 Lancaster, III et al.
4,271,657 A 6/1981 Lancaster, III et al.
4,300,326 A 11/1981 Stackhouse
4,344,269 A 8/1982 Dieterlen et al.
4,387,548 A 6/1983 Lancaster et al.
4,395,255 A 7/1983 Branecky et al.
4,418,510 A 12/1983 Lancaster, III et al.
4,429,514 A 2/1984 Lancaster et al.
4,432,185 A 2/1984 Geisinger
4,458,467 A 7/1984 Shulman et al.
4,497,159 A 2/1985 Lancaster, III
4,501,105 A 2/1985 Rogers et al.
4,503,658 A 3/1985 Mouser et al.
4,505,092 A 3/1985 Bowers et al.
4,514,955 A 5/1985 Mouser et al.
4,524,568 A 6/1985 Lancaster et al.
4,545,182 A 10/1985 McDowell, Jr.
4,590,746 A 5/1986 Humphrey
4,628,667 A 12/1986 Humphrey et al.
4,631,898 A 12/1986 Brambilla
4,676,048 A 6/1987 Lancaster et al.
4,693,049 A 9/1987 Humphrey
4,712,354 A 12/1987 Lancaster et al.
4,716,709 A 1/1988 Lamb et al.
4,736,567 A 4/1988 Pienta
4,754,594 A 7/1988 Lancaster
4,761,934 A 8/1988 Lancaster
4,807,427 A 2/1989 Casteel et al.
4,840,006 A 6/1989 Humphrey
4,845,920 A 7/1989 Lancaster
4,852,330 A 8/1989 Carangelo
4,855,924 A 8/1989 Strosser
4,862,678 A 9/1989 Humphrey
4,866,909 A 9/1989 Lancaster, III et al.
4,905,451 A 3/1990 Jaconelli et al.
4,938,008 A 7/1990 Salzsauer
4,953,336 A 9/1990 Lancaster, III et al.
4,955,176 A 9/1990 Seko et al.
4,991,381 A 2/1991 Simons
5,027,579 A 7/1991 Keip
5,040,356 A 8/1991 Thimon
5,040,359 A 8/1991 Thimon
5,054,263 A 10/1991 Maki-Rahkola et al.
5,054,987 A 10/1991 Thornton
5,077,956 A 1/1992 Thimon
5,081,824 A 1/1992 Thimon et al.
5,107,657 A 4/1992 Diehl et al.
5,123,230 A 6/1992 Upmann
5,138,817 A 8/1992 Mowry et al.
5,163,264 A 11/1992 Hannen
5,186,981 A 2/1993 Shellhamer et al.
5,195,296 A 3/1993 Matsumoto
5,195,297 A 3/1993 Lancaster et al.
5,195,301 A 3/1993 Martin-Cocher et al.
5,203,136 A 4/1993 Thimon et al.
5,203,139 A 4/1993 Salsburg et al.
5,203,671 A 4/1993 Cawley et al.
5,216,871 A 6/1993 Hannen
5,240,198 A 8/1993 Dorfel
5,301,493 A 4/1994 Chen
5,311,725 A 5/1994 Martin et al.
5,315,809 A 5/1994 Gordon et al.
5,351,461 A 10/1994 Fandard et al.
5,369,416 A 11/1994 Haverty et al.
5,414,979 A 5/1995 Moore et al.
5,447,008 A 9/1995 Martin-Cocher
5,450,711 A 9/1995 Martin-Cocher
5,463,842 A 11/1995 Lancaster
5,524,413 A 6/1996 Fukuda
5,546,730 A 8/1996 Newell et al.
5,572,855 A 11/1996 Reigrut et al.
5,581,979 A 12/1996 Scherer
5,595,042 A 1/1997 Cappi et al.
5,634,321 A 6/1997 Martin-Cocher et al.
5,653,093 A 8/1997 Delledonne
5,671,593 A 9/1997 Ginestra et al.
5,765,344 A 6/1998 Mandeville et al.
5,768,862 A 6/1998 Mauro et al.
5,797,246 A 8/1998 Martin-Cocher
5,799,471 A 9/1998 Chen
5,836,140 A * 11/1998 Lancaster, III ..... B65B 11/045 53/64
5,875,617 A 3/1999 Scherer
5,884,453 A 3/1999 Ramsey et al.
5,893,258 A 4/1999 Lancaster et al.
5,941,049 A 8/1999 Lancaster et al.
5,953,888 A 9/1999 Martin-Cocher et al.
6,082,081 A 7/2000 Mucha
6,170,228 B1 1/2001 Zeman
6,185,900 B1 2/2001 Martin
6,195,968 B1 3/2001 Marois et al.
6,253,532 B1 7/2001 Orpen
6,293,074 B1 9/2001 Lancaster, III et al.
6,314,333 B1 11/2001 Rajala et al.
6,338,480 B1 1/2002 Endo
6,360,512 B1 3/2002 Marois et al.
6,370,839 B1 4/2002 Nakagawa et al.
6,453,643 B1 9/2002 Buscherini et al.
6,516,591 B1 2/2003 Lancaster, III et al.
6,598,379 B2 7/2003 Zitella
6,684,612 B2 2/2004 Trottet
6,698,161 B1 3/2004 Rossi
6,748,718 B2 6/2004 Lancaster, III et al.
6,826,893 B2 12/2004 Cere'
6,848,240 B2 2/2005 Frey
6,851,252 B2 2/2005 Maki-Rahkola et al.
6,918,229 B2 7/2005 Lancaster, III et al.
7,040,071 B2 5/2006 Heikaus
7,114,308 B2 10/2006 Cox
7,137,233 B2 11/2006 Degrasse et al.
7,178,317 B1 2/2007 Koskela
7,386,968 B2 6/2008 Sperry et al.
7,490,823 B2 2/2009 Oishi et al.
7,540,128 B2 6/2009 Lancaster, III et al.
7,568,327 B2 8/2009 Lancaster, III et al.

(56) References Cited

U.S. PATENT DOCUMENTS 7,707,801 B2 5/2010 Lancaster, III
7,707,901 B2 5/2010 Lancaster, III et al.
7,779,607 B2 8/2010 Lancaster, III et al.
8,001,745 B2 8/2011 Carter et al.
8,037,660 B2 10/2011 Lancaster, III et al.
8,074,431 B1 12/2011 Pierson
8,276,346 B2 10/2012 Lancaster, III et al.
8,276,354 B2 10/2012 Lancaster, III et al.
8,296,101 B1 * 10/2012 Barlow ..... G06Q 50/28 702/182
8,424,271 B2 4/2013 Murarotto
8,539,739 B2 9/2013 Pierson et al.
8,549,819 B1 10/2013 Bison
8,707,644 B2 4/2014 Degen et al.
8,739,502 B2 6/2014 Lancaster, III
8,772,651 B2 7/2014 Martin et al.
8,915,460 B2 12/2014 Busch et al.
9,073,210 B2 7/2015 Nakajima et al.
9,488,557 B2 11/2016 Lancaster et al.
9,493,262 B2 11/2016 Lancaster et al.
9,776,748 B2 10/2017 Lancaster et al.
9,896,229 B1 2/2018 Pierson et al.
10,676,292 B2 6/2020 Saylor
2001/0015057 A1 8/2001 Suolahti
2001/0017023 A1 * 8/2001 Armington ..... B65B 61/22 53/472
2002/0029540 A1 3/2002 Lancaster et al.
2003/0089081 A1 5/2003 Platon
2003/0093973 A1 5/2003 Mir
2003/0110737 A1 6/2003 Lancaster et al.
2003/0145563 A1 8/2003 Cere'
2003/0158684 A1 8/2003 Livingston
2003/0200731 A1 10/2003 Maki-Rahkola et al.
2003/0200732 A1 10/2003 Maki-Rahkola et al.
2004/0031238 A1 2/2004 Cox
2004/0040477 A1 3/2004 Neumann
2004/0060264 A1 * 4/2004 Miller ..... B65B 67/08 53/461
2004/0129150 A1 7/2004 Lancaster et al.
2004/0177592 A1 9/2004 Lancaster et al.
2004/0243277 A1 * 12/2004 Bonnain ..... B65B 59/001 700/213
2005/0044812 A1 3/2005 Lancaster et al.
2005/0115202 A1 6/2005 Mertz et al.
2005/0284783 A1 12/2005 May, Jr.
2006/0028969 A1 2/2006 Kondo et al.
2006/0213155 A1 9/2006 Fomi et al.
2006/0248858 A1 11/2006 Lancaster
2006/0254214 A1 11/2006 Cox et al.
2006/0254225 A1 11/2006 Lancaster et al.
2006/0289691 A1 12/2006 Fomi
2007/0169442 A1 7/2007 Asiold
2007/0204564 A1 * 9/2007 Lancaster, III ..... B65B 57/04 53/399
2007/0204565 A1 9/2007 Lancaster et al.
2007/0209324 A1 9/2007 Lancaster et al.
2008/0066431 A1 3/2008 Cousins
2008/0216449 A1 9/2008 Zimmerli
2008/0229707 A1 9/2008 Zitella et al.
2008/0229714 A1 9/2008 Zitella et al.
2008/0229716 A1 * 9/2008 Zitella ..... B65B 11/025 53/461
2008/0295614 A1 * 12/2008 Lancaster, III ..... B65B 11/025 700/95
2008/0307754 A1 12/2008 Storig et al.
2009/0178374 A1 * 7/2009 Lancaster, III ..... B65B 57/02 700/240
2009/0235617 A1 9/2009 Moore et al.
2009/0277901 A1 11/2009 Port et al.
2009/0293425 A1 12/2009 Carter et al.
2009/0313942 A1 12/2009 Murarotto
2010/0107653 A1 5/2010 Paskevich et al.
2010/0126119 A1 5/2010 Ours
2010/0239403 A1 9/2010 Lancaster, III et al.
2010/0300049 A1 12/2010 Schmidt et al.
2010/0303526 A1 12/2010 Hayase
2010/0313525 A1 12/2010 Martin et al.
2010/0320305 A1 12/2010 Lia
2011/0131927 A1 * 6/2011 Lancaster, III ..... B65B 57/04 53/64
2011/0146203 A1 6/2011 Lancaster, III et al.
2011/0153277 A1 6/2011 Morath
2011/0168751 A1 7/2011 Tsurumi
2011/0179752 A1 7/2011 Lancaster, III et al.
2012/0031053 A1 2/2012 Lancaster, III et al.
2012/0042615 A1 2/2012 Roche
2012/0102886 A1 * 5/2012 Lancaster, III ..... B65B 11/008 53/461
2012/0102887 A1 * 5/2012 Lancaster, III ..... B65B 11/025 73/788
2012/0124944 A1 5/2012 Lancaster, III et al.
2012/0181368 A1 7/2012 Ekola
2013/0000252 A1 * 1/2013 Pettersson ..... B65B 5/024 348/46
2013/0061558 A1 3/2013 Klear et al.
2013/0067865 A1 * 3/2013 Maruo ..... B65B 61/005 53/461
2013/0076753 A1 * 3/2013 Lancaster, III ..... B65B 11/045 345/440
2013/0115971 A1 5/2013 Marti et al.
2013/0199133 A1 8/2013 Kluge et al.
2013/0247519 A1 9/2013 Clark et al.
2013/0326999 A1 12/2013 Lemieux et al.
2014/0013707 A1 1/2014 Murarotto
2014/0053502 A1 2/2014 Pecchenini
2014/0109523 A1 4/2014 Nelson
2014/0116006 A1 5/2014 Lancaster, III et al.
2014/0116007 A1 5/2014 Lancaster, III et al.
2014/0116008 A1 5/2014 Lancaster, III et al.
2014/0123605 A1 5/2014 Cere' et al.
2014/0168422 A1 6/2014 Feng et al.
2014/0208696 A1 7/2014 Phillips et al.
2014/0223863 A1 * 8/2014 Lancaster, III ..... B65B 57/04 53/436
2014/0331609 A1 11/2014 Bison
2015/0096266 A1 4/2015 Divine et al.
2015/0128530 A1 5/2015 Brunson et al.
2015/0197360 A1 7/2015 Lancaster, III
2015/0353220 A1 * 12/2015 Lancaster, III ..... B65B 11/025 53/461
2016/0096645 A1 4/2016 Lancaster et al.
2016/0096646 A1 * 4/2016 Lancaster, III ..... G06F 3/0482 53/461
2016/0098171 A1 4/2016 Lancaster et al.
2017/0052075 A1 2/2017 Cere'
2017/0088301 A1 3/2017 Riemenschneider
2017/0283106 A1 * 10/2017 Lancaster, III ..... B65B 57/00
2018/0162660 A1 6/2018 Saylor
2018/0215485 A1 * 8/2018 Koet ..... B65B 5/12
2018/0273226 A1 8/2018 Lancaster et al.
2018/0249637 A1 9/2018 Kraus et al.
2019/0002138 A1 1/2019 Laghi
2020/0346799 A1 11/2020 Lancaster et al.

FOREIGN PATENT DOCUMENTS

DE 3119038 A1 12/1982
DE 0096635 A1 12/1983
DE 3634924 A1 4/1988
DE 3901704 A1 8/1990
DE 4234604 A1 4/1994
DE 19509649 9/1996
EP 0144266 A2 6/1985
EP 0246659 A1 11/1987
EP 0466980 A1 1/1992
EP 0653352 A1 5/1995
EP 0671324 A1 9/1995
EP 0811554 A1 12/1997
EP 0842850 A2 5/1998
EP 1083126 A1 3/2001
EP 1125841 A1 8/2001
EP 1213223 A1 6/2002

(56) References Cited

FOREIGN PATENT DOCUMENTS

| | | | |
|---|---|---|---|
| EP | 1489004 | A1 | 12/2004 |
| EP | 1650573 | A2 | 4/2006 |
| EP | 1705119 | A1 | 9/2006 |
| EP | 1717149 | A1 | 11/2006 |
| EP | 1736426 | A2 | 12/2006 |
| EP | 1807308 | A1 | 7/2007 |
| EP | 1736426 | A3 | 10/2007 |
| EP | 3521183 | A2 | 8/2019 |
| EP | 3656685 | | 5/2020 |
| EP | 3733533 | | 11/2020 |
| GB | 1 546 523 | A | 5/1979 |
| GB | 2059906 | A | 4/1981 |
| GB | 2107668 | A | 5/1983 |
| GB | 2437359 | A | 10/2007 |
| JP | 57166252 | | 10/1982 |
| JP | 63191707 | | 8/1988 |
| JP | 0385209 | | 4/1991 |
| JP | 06239311 | | 8/1994 |
| JP | 085448 | | 1/1996 |
| JP | 09254913 | A | 9/1997 |
| JP | 11165705 | A | 6/1999 |
| JP | 2001048111 | | 2/2001 |
| JP | 2001072012 | A | 3/2001 |
| JP | 2002211503 | | 7/2002 |
| JP | 2002362879 | A1 | 12/2002 |
| JP | 2004161344 | A | 6/2004 |
| JP | 3634993 | | 1/2005 |
| JP | 4350940 | | 10/2009 |
| WO | WO 9107341 | A1 | 5/1991 |
| WO | WO 9420367 | A1 | 9/1994 |
| WO | WO 9700202 | A1 | 1/1997 |
| WO | WO 9822346 | A1 | 5/1998 |
| WO | WO 2004069659 | A1 | 8/2004 |
| WO | WO2006032065 | | 3/2006 |
| WO | WO 2006110596 | A1 | 10/2006 |
| WO | WO 2007071593 | A1 | 6/2007 |
| WO | WO 2007100596 | A2 | 9/2007 |
| WO | WO 2007100597 | A2 | 9/2007 |
| WO | WO 2008007189 | A2 | 1/2008 |
| WO | WO200849148 | | 5/2008 |
| WO | WO 2008115868 | A1 | 9/2008 |
| WO | WO 2008129432 | A1 | 10/2008 |
| WO | WO2010130011 | | 11/2010 |
| WO | WO 2011057166 | A2 | 5/2011 |
| WO | WO 2012058549 | A2 | 5/2012 |
| WO | WO 2012058596 | A1 | 5/2012 |
| WO | WO2016057724 | | 4/2016 |
| WO | WO 2017053603 | | 3/2017 |

OTHER PUBLICATIONS

Canadian Patent Office; Office Action in Canadian Patent Application No. 2,901,256, dated Aug. 11, 2016.
European Patent Office; Decision to Grant in Application No. 14708716.7 dated Dec. 21, 2017.
Australian Patent Office, Notice of Acceptance in Application No. 2014216281 dated Sep. 7, 2017.
European Patent Office; Decision to Grant in Application No. 17199698.6 dated Apr. 5, 2019.
U.S. Patent Office; Notice of Allowance in U.S. Appl. No. 14/179,843 dated Nov. 7, 2018.
European Patent Office; Communication for Application No. 18206394.1 dated Apr. 8, 2019.
European Patent Office; Extended European Search Report issued in Application No. 18206394.1 dated Jan. 24, 2019.
Canadian Patent Office; Office Action in Application No. 3,007,829 dated May 31, 2019.
Canadian Patent Office, Notice of Allowance in Application No. 2,983,858 dated Jul. 3, 2019.
IP Australia, Notice of Grant for Patent for Application No. 2017251774 dated Sep. 19, 2019.
U.S. Patent and Trademark Office, Office Action for U.S. Appl. No. 15/722,920 dated Sep. 19, 2019.
European Patent Office; Intention to Grant in Application No. 18 206 394.1 dated Nov. 27, 2019.
Canadian Patent Office; Office Action in Application No. 2,983,858 dated Sep. 19, 2018.
Petronio,S. Going the Distance. Machine Design 76.10 (2004): 3, S8, S10, S12. (Year: 2004).
ASTM International (2008). Standard Test Methods for Vibration Testing of Shipping Containers. D999-08. (Year 2008).
ASTM International (2009). Standard Test Methods for Programmable Horizaontal Impact Test for Shipping Containers and Systems. D4003-98. (Year: 2009).
Blumer, T., & Guadagnini, D. (2011). Shock transmissibility of a palletized load caused by forklift truck handling. Department of Industrial Technology, California Polytechnic State University . (Year:2011).
Cernokus, E. (2012). The Effect of Stretch Wrap Pre-stretch on Unitized Load Containment. M.S. Thesis, Department of Industrial Technology, California Polytechnic State University (Year: 2012).
Emblem, A. (2012). Packaging Technology—Fundamentals, Materials and Processed. Woodhead Publishing Ltd. (Year: 2012).
Crocker, Malcolm J. (2007). Handbook of Noise and Vibration Control. John Wiley & Sons. (Year: 2007).
Canadian Patent Office, Notice of Allowance in Application No. 3,050,578 dated Oct. 7, 2021.
Canadian Patent Office, Office Action in Application No. 3,050,578 dated Jan. 29, 2021.
Australian Patent Office; Notice of Acceptance in Application No. 2017251774 dated May 28, 2019.
"The Technology Behind a 'No-Tear', 'No-Rip' Film Carriage, and How to Explain it to your Customers," Jan. 21, 2010, downloaded from http://wulftecstretchwrapper.blogspt.com/2010_01_01archive.html on Jan. 7, 2011; 4 pages.
International Search Report and Written Opinion of the International Searching Authority for Application No. PCT/US14/016245, dated Apr. 29, 2014.
International Search Report and Written Opinion of the International Searching Authority for Application No. PCT/US14/016245, dated Jul. 4, 2014.
International Search Report and Written Opinion of the International Searching Authority for Application No. PCT/US15/011385, dated Apr. 2, 2015.
International Search Report for Application No. PCT/US13/066807, dated Jan. 31, 2014.
Written Opinion of the International Searching Authority for Application No. PCT/US2013/066807, dated Jan. 31, 2014.
International Search Report for Application No. PCT/US 13/066823, dated Feb. 10, 2014.
Written Opinion of the International Searching Authority for Application No. PCT/US2013/066823, dated Feb. 10, 2014.
Partial International Search Report for Application No. PCT/US13/066838, dated Jan. 30, 2014.
International Search Report and Written Opinion of the International Searching Authority for Application No. PCT/US13/066838, dated Apr. 16, 2014.
List of Citations of Related US Patents and/or Patent Applications.
http://2012.modexshow.com/press/release.aspx?ref=press&id=1899. Feb. 6, 2012.
http://www.mhpn.com/product/force_anticipation_stretch_technology_for_stretch_wrappers/packaging. Nov. 23, 2012.
http://www.wulftec.com/contents/brochures/015f519c-8a1a-4a0b-81d1-727cbdcbf946.pdf. Oct. 10, 2012.
http://literature.rockwellautomation.com/idc/groups/literature/documents/ap/oem-ap069_-en-p.pdf. Aug. 1, 2011.
http://www.packworld.com/machinery/pallelizing/wulftec-international-inc-film-feeding-system-secure-product-containment_9/14/2011.
Bossier, JohnD., "Manual of Geospatial Science and Technology", CRC Press 2001, pp. 8-15.
European Patent Office; Office Action in European Patent Application No. 14709453.6 dated Aug. 26, 2016; 3 pages.
Canadian Patent Office; Office Action in Canadian Patent Application No. 2,901,254, dated Aug. 12, 2016.
Australian Patent Office; Examination Report in Australian Patent Application No. 2014216281, dated Jun. 14, 2017.

(56) References Cited

OTHER PUBLICATIONS

European Patent Office; Office Action in European Patent Application No. 14709453.6 dated Jul. 18, 2017.
U.S. Patent Office; Non-Final Office Action in U.S. Appl. No. 14/179,843 dated Nov. 8, 2017.
Canadian Patent Office; Notice of Allowance in Application No. 2,901,254 dated Jan. 9, 2018.
European Patent Office; Communication in Application No. 14709453.6 dated Dec. 6, 2017.
Australian Patent Office; Examination Report in Application No. 2014216278 dated Feb. 28, 2017.
Australian Patent Office; Examination Report in Application No. 2014216278 dated Nov. 7, 2017.
Australian Patent Office; Notice of Acceptance in Application No. 2014216278 dated Feb. 21, 2018.
International Preliminary Report on Patentability and Written Opinion of the International Searching Authority for Application No. PCT/US14/016254, pp. 1-13, dated Aug. 18, 2015.
Canadian Patent Office, Notice of Allowance in Application No. 3,007,829 dated Feb. 21, 2020.
U.S. Patent and Trademark Office, Notice of Allowance for U.S. Appl. No. 15/722,920 dated Jun. 10, 2020.
U.S. Patent and Trademark Office, Final Office Action for U.S. Appl. No. 15/722,920 dated Mar. 19, 2020.
European Patent Office; Decision to Grant for Application No. 18206394.1 dated Apr. 2, 2020.
U.S. Patent and Trademark Office, Non-Final Office Action for U.S. Appl. No. 16/932,006 dated May 12, 2022.

* cited by examiner

PACKAGING MATERIAL PROFILING FOR CONTAINMENT FORCE-BASED WRAPPING

FIELD OF THE INVENTION

The invention generally relates to wrapping loads with packaging material through relative rotation of loads and a packaging material dispenser, and in particular, to a control system therefore.

BACKGROUND OF THE INVENTION

Various packaging techniques have been used to build a load of unit products and subsequently wrap them for transportation, storage, containment and stabilization, protection and waterproofing. One system uses wrapping machines to stretch, dispense, and wrap packaging material around a load. The packaging material may be pre-stretched before it is applied to the load. Wrapping can be performed as an inline, automated packaging technique that dispenses and wraps packaging material in a stretch condition around a load on a pallet to cover and contain the load. Stretch wrapping, whether accomplished by a turntable, rotating arm, vertical rotating ring, or horizontal rotating ring, typically covers the four vertical sides of the load with a stretchable packaging material such as polyethylene packaging material. In each of these arrangements, relative rotation is provided between the load and the packaging material dispenser to wrap packaging material about the sides of the load.

A primary metric used in the shipping industry for gauging overall wrapping effectiveness is containment force, which is generally the cumulative force exerted on the load by the packaging material wrapped around the load. Containment force depends on a number of factors, including the number of layers of packaging material, the thickness, strength and other properties of the packaging material, the amount of pre-stretch applied to the packaging material, and the wrap force applied to the load while wrapping the load. The wrap force, however, is a force that fluctuates as packaging material is dispensed to the load due primarily to the irregular geometry of the load.

In particular, wrappers have historically suffered from packaging material breaks and limitations on the amount of wrap force applied to the load (as determined in part by the amount of pre-stretch used) due to erratic speed changes required to wrap loads. Were all loads perfectly cylindrical in shape and centered precisely at the center of rotation for the relative rotation, the rate at which packaging material would need to be dispensed would be constant throughout the rotation. Typical loads, however, are generally box-shaped, and have a square or rectangular cross-section in the plane of rotation, such that even in the case of square loads, the rate at which packaging material is dispensed varies throughout the rotation. In some instances, loosely wrapped loads result due to the supply of excess packaging material during portions of the wrapping cycle where the demand rate for packaging material by the load is exceeded by the rate at which the packaging material is supplied by the packaging material dispenser. In other instances, when the demand rate for packaging material by the load is greater than the supply rate of the packaging material by the packaging material dispenser, breakage of the packaging material may occur.

When wrapping a typical rectangular load, the demand for packaging material typically decreases as the packaging material approaches contact with a corner of the load and increases after contact with the corner of the load. In horizontal rotating rings, when wrapping a tall, narrow load or a short load, the variation in the demand rate is typically even greater than in a typical rectangular load. In vertical rotating rings, high speed rotating arms, and turntable apparatuses, the variation is caused by a difference between the length and the width of the load, while in a horizontal rotating ring apparatus, the variation is caused by a difference between the height of the load (distance above the conveyor) and the width of the load. Variations in demand may make it difficult to properly wrap the load, and the problem with variations may be exacerbated when wrapping a load having one or more dimensions that may differ from one or more corresponding dimensions of a preceding load. The problem may also be exacerbated when wrapping a load having one or more dimensions that vary at one or more locations of the load itself. Furthermore, whenever a load is not centered precisely at the center of rotation of the relative rotation, the variation in the demand rate is also typically greater, as the corners and sides of even a perfectly symmetric load will be different distances away from the packaging material dispenser as they rotate past the dispenser.

The amount of force, or pull, that the packaging material exhibits on the load determines in part how tightly and securely the load is wrapped. Conventionally, this wrap force is controlled by controlling the feed or supply rate of the packaging material dispensed by the packaging material dispenser. For example, the wrap force of many conventional stretch wrapping machines is controlled by attempting to alter the supply of packaging material such that a relatively constant packaging material wrap force is maintained. With powered pre-stretching devices, changes in the force or tension of the dispensed packaging material are monitored, e.g., by using feedback mechanisms typically linked to spring loaded dancer bars, electronic load cells, or torque control devices. The changing force or tension of the packaging material caused by rotating a rectangular shaped load is transmitted back through the packaging material to some type of sensing device, which attempts to vary the speed of the motor driven dispenser to minimize the change. The passage of the corner causes the force or tension of the packaging material to increase, and the increase is typically transmitted back to an electronic load cell, spring-loaded dancer interconnected with a sensor, or to a torque control device. As the corner approaches, the force or tension of the packaging material decreases, and the reduction is transmitted back to some device that in turn reduces the packaging material supply to attempt to maintain a relatively constant wrap force or tension.

With the ever faster wrapping rates demanded by the industry, however, rotation speeds have increased significantly to a point where the concept of sensing changes in force and altering supply speed in response often loses effectiveness. The delay of response has been observed to begin to move out of phase with rotation at approximately 20 RPM. Given that a packaging dispenser is required to shift between accelerating and decelerating eight times per revolution in order to accommodate the four corners of the load, at 20 RPM the shift between acceleration and deceleration occurs at a rate of more than every once every half of a second. Given also that the rotating mass of a packaging material roll and rollers in a packaging material dispenser may be 100 pounds or more, maintaining an ideal dispense rate throughout the relative rotation can be a challenge.

Also significant is the need in many applications to minimize acceleration and deceleration times for faster cycles. Initial acceleration must pull against clamped packaging material, which typically cannot stand a high force, and especially the high force of rapid acceleration, which typically cannot be maintained by the feedback mechanisms described above. As a result of these challenges, the use of high speed wrapping has often been limited to relatively lower wrap forces and pre-stretch levels where the loss of control at high speeds does not produce undesirable packaging material breaks.

In addition, due to environmental, cost and weight concerns, an ongoing desire exists to reduce the amount of packaging material used to wrap loads, typically through the use of thinner, and thus relatively weaker packaging materials and/or through the application of fewer layers of packaging material. As such, maintaining adequate containment forces in the presence of such concerns, particularly in high speed applications, can be a challenge.

Another difficulty associated with conventional wrapping machines is based on the difficulty in selecting appropriate control parameters to ensure that an adequate containment force is applied to a load. In many wrapping machines, the width of the packaging material is significantly less than the height of the load, and a lift mechanism is used to move a roll carriage in a direction generally parallel to the axis of rotation of the wrapping machine as the load is being wrapped, which results in the packaging material being wrapped in a generally spiral manner around the load. Conventionally, an operator is able to control a number of wraps around the bottom of the load, a number of wraps around the top of the load, and a speed of the roll carriage as it traverses between the top and bottom of the load to manage the amount of overlap between successive wraps of the packaging material. In some instances, control parameters may also be provided to control an amount of overlap (e.g., in inches) between successive wraps of packaging material.

The control of the roll carriage in this manner, when coupled with the control of the wrap force applied during wrapping, may result in some loads that are wrapped with insufficient containment force throughout, or that consume excessive packaging material (which also has the side effect of increasing the amount of time required to wrap each load). In part, this may be due in some instances to an uneven distribution of packaging material, as it has been found that the overall integrity of a wrapped load is based on the integrity of the weakest portion of the wrapped load. Thus, if the packaging material is wrapped in an uneven fashion around a load such that certain portions of the load have fewer layers of overlapping packaging material and/or packaging material applied with a lower wrap force, the wrapped load may lack the desired integrity regardless of how well it is wrapped in other portions.

Ensuring even and consistent containment force throughout a load, however, has been found to be challenging, particularly for less experienced operators. Traditional control parameters such as wrap force, roll carriage speed, etc. frequently result in significant variances in number of packaging material layers and containment forces applied to loads from top to bottom. Furthermore, many operators lack sufficient knowledge of packaging material characteristics and comparative performance between different brands, thicknesses, materials, etc., so the use of different packaging materials often further complicates the ability to provide even and consistent wrapped loads.

As an example, many operators will react to excessive film breaks by simply reducing wrap force, which leads to inadvertent lowering of cumulative containment forces below desired levels. The effects of insufficient containment forces, however, may not be discovered until much later, when wrapped loads are loaded into trucks, ships, airplanes or trains and subjected to typical transit forces and conditions. Failures of wrapped loads may lead to damaged goods during transit, loading and/or unloading, increasing costs as well as inconveniencing customers, manufacturers and shippers alike.

Another approach may be to simply lower the speed of a roll carriage and increase the amount of packaging material applied in response to loads being found to lack adequate containment force; however, such an approach may consume an excessive amount of packaging material, thereby increasing costs and decreasing the throughput of a wrapping machine.

Therefore, a significant need continues to exist in the art for an improved manner of reliably and efficiently controlling the containment force applied to a wrapped load.

SUMMARY OF THE INVENTION

The invention addresses these and other problems associated with the prior art by providing in one aspect a method, apparatus and program product that profile a packaging material for use in a load wrapping apparatus. In particular, it has been found that a packaging material attribute referred to herein as incremental containment force per revolution (ICF) attribute may be implemented in some embodiments as a function that may be utilized in connection with a load containment force requirement to properly configure a wrapping apparatus to provide consistent and reliable load wrapping operations. The ICF function is typically variable as a function of wrap force, and may be modeled in a number of manners, e.g., via a linear function, a piecewise linear function, or an s-curve, among others.

Therefore, consistent with another aspect of the invention, a method is provided for profiling a packaging material with a load wrapping apparatus of the type configured to wrap a load on a load support through relative rotation between a packaging material dispenser and the load support. The method includes initiating a first wrap operation to wrap a load with the packaging material using a first wrap force; determining a first incremental containment force per revolution (ICF) value from the first wrap operation; initiating a second wrap operation to wrap a load with the packaging material using a second wrap force; determining a second ICF value from the second wrap operation; and using a central processing unit, determining an ICF function for the packaging material from the first and second ICF values.

The invention also provides in an additional aspect a manner of comparing the performance of different packaging materials capable of being used in a load wrapping apparatus, and in particular, comparing the performance of such packaging materials for particular loads or applications. A comparative performance parameter, such as number of revolutions or time required to wrap a load, or the total weight or cost of packaging material to wrap a load, may be generated for different packaging materials based upon dimensions of a load and a desired load containment force requirement for the load.

Therefore, consistent with yet another aspect of the invention, a method is provided for comparing performance of a plurality of packaging materials capable of being used in a load wrapping apparatus of the type configured to wrap a load on a load support through relative rotation between a packaging material dispenser and the load support. The method includes determining dimensions for a representative load; determining a load containment force requirement for the representative load; simulating, for each of a plurality of packaging materials, a wrap operation performed on the representative load using such packaging material and meeting the load containment force requirement; and determining, for each of the plurality of packaging materials, a comparative performance parameter for such packaging material based upon the simulation of the wrap operation using such packaging material.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described exemplary embodiments of the invention.

DETAILED DESCRIPTION

Embodiments consistent with the invention utilize various techniques to simplify the control of a wrapping apparatus and to enable more consistent application of packaging material such as film to a load. Prior to a discussion of the aforementioned concepts, however, a brief discussion of various types of wrapping apparatus within which the various techniques disclosed herein may be implemented is provided.

In addition, the disclosures of each of U.S. Pat. No. 4,418,510, entitled "STRETCH WRAPPING APPARATUS AND PROCESS," and filed Apr. 17, 1981; U.S. Pat. No. 4,953,336, entitled "HIGH TENSILE WRAPPING APPARATUS," and filed Aug. 17, 1989; U.S. Pat. No. 4,503,658, entitled "FEEDBACK CONTROLLED STRETCH WRAPPING APPARATUS AND PROCESS," and filed Mar. 28, 1983; U.S. Pat. No. 4,676,048, entitled "SUPPLY CONTROL ROTATING STRETCH WRAPPING APPARATUS AND PROCESS," and filed May 20, 1986; U.S. Pat. No. 4,514,955, entitled "FEEDBACK CONTROLLED STRETCH WRAPPING APPARATUS AND PROCESS," and filed Apr. 6, 1981; U.S. Pat. No. 6,748,718, entitled "METHOD AND APPARATUS FOR WRAPPING A LOAD," and filed Oct. 31, 2002; U.S. Pat. No. 7,707,801, entitled "METHOD AND APPARATUS FOR DISPENSING A PREDETERMINED FIXED AMOUNT OF PRE-STRETCHED FILM RELATIVE TO LOAD GIRTH," filed Apr. 6, 2006; U.S. Pat. No. 8,037,660, entitled "METHOD AND APPARATUS FOR SECURING A LOAD TO A PALLET WITH A ROPED FILM WEB," and filed Feb. 23, 2007; U.S. Patent Application Publication No. 2007/0204565, entitled "METHOD AND APPARATUS FOR METERED PRE-STRETCH FILM DELIVERY," and filed Sep. 6, 2007; U.S. Pat. No. 7,779,607, entitled "WRAPPING APPARATUS INCLUDING METERED PRE-STRETCH FILM DELIVERY ASSEMBLY AND METHOD OF USING," and filed Feb. 23, 2007; U.S. Patent Application Publication No. 2009/0178374, entitled "ELECTRONIC CONTROL OF METERED FILM DISPENSING IN A WRAPPING APPARATUS," and filed Jan. 7, 2009; U.S. Patent Application Publication No. 2011/0131927, entitled "DEMAND BASED WRAPPING," and filed Nov. 6, 2010; U. S. Patent Application Publication No. 2012/0102886, entitled "METHODS AND APPARATUS FOR EVALUATING PACKAGING MATERIALS AND DETERMINING WRAP SETTINGS FOR WRAPPING MACHINES," and filed Oct. 28, 2011; U.S. Patent Application Publication No. 2012/0102887, entitled "MACHINE GENERATED WRAP DATA," and filed Oct. 28, 2011; U.S. provisional patent application Ser. No. 61/718,429, entitled "ROTATION ANGLE-BASED WRAPPING, and filed Oct. 25, 2012; and U.S. provisional patent application Ser. No. 61/718,433, entitled "EFFECTIVE CIRCUMFERENCE-BASED WRAPPING, and filed Oct. 25, 2012, are incorporated herein by reference in their entirety.

Wrapping Apparatus Configurations

Figure 1:
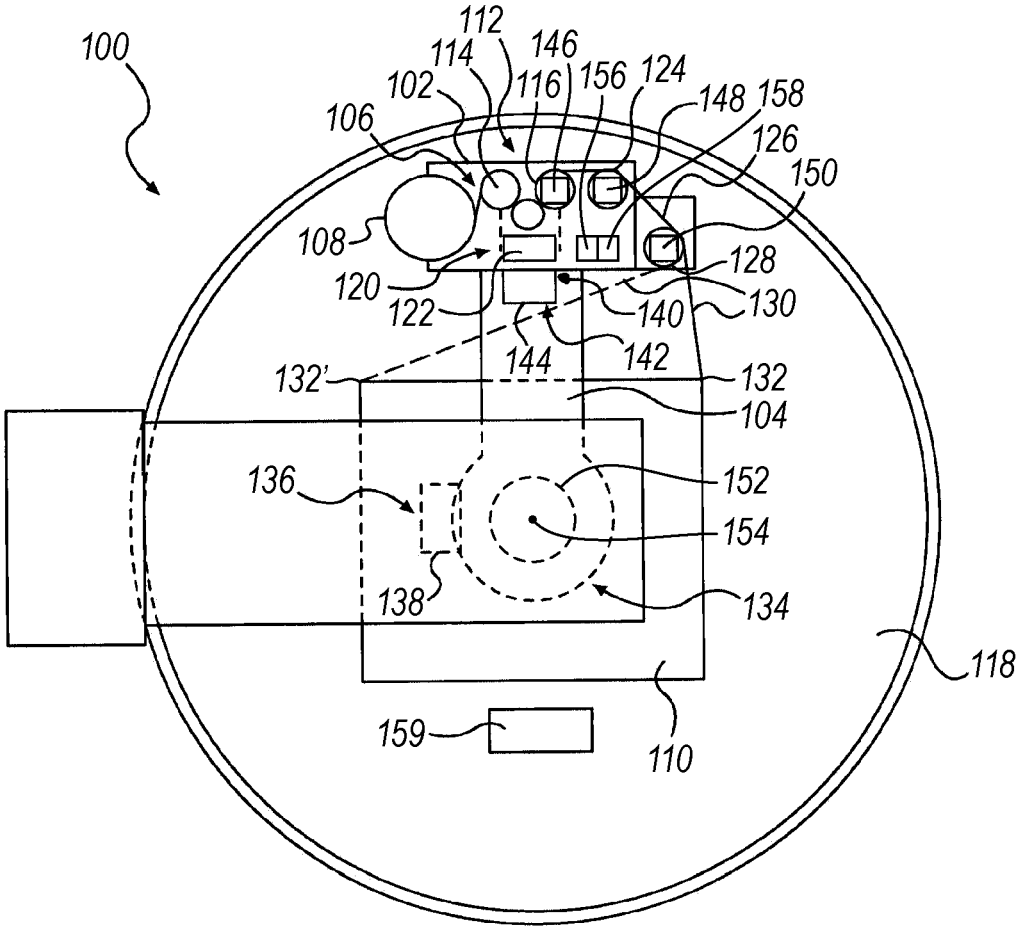
FIG. 1 shows a top view of a rotating arm-type wrapping apparatus consistent with the invention.

FIG. 1, for example, illustrates a rotating arm-type wrapping apparatus 100, which includes a roll carriage 102 mounted on a rotating arm 104. Roll carriage 102 may include a packaging material dispenser 106. Packaging material dispenser 106 may be configured to dispense packaging material 108 as rotating arm 104 rotates relative to a load 110 to be wrapped. In an exemplary embodiment, packaging material dispenser 106 may be configured to dispense stretch wrap packaging material. As used herein, stretch wrap packaging material is defined as material having a high yield coefficient to allow the material a large amount of stretch during wrapping. However, it is possible that the apparatuses and methods disclosed herein may be practiced with packaging material that will not be pre-stretched prior to application to the load. Examples of such packaging material include netting, strapping, banding, tape, etc. The invention is therefore not limited to use with stretch wrap packaging material.

Packaging material dispenser 106 may include a pre-stretch assembly 112 configured to pre-stretch packaging material before it is applied to load 110 if pre-stretching is desired, or to dispense packaging material to load 110 without pre-stretching. Pre-stretch assembly 112 may include at least one packaging material dispensing roller, including, for example, an upstream dispensing roller 114 and a downstream dispensing roller 116. It is contemplated that pre-stretch assembly 112 may include various configurations and numbers of pre-stretch rollers, drive or driven roller and idle rollers without departing from the spirit and scope of the invention.

The terms "upstream" and "downstream," as used in this application, are intended to define positions and movement relative to the direction of flow of packaging material 108 as it moves from packaging material dispenser 106 to load 110. Movement of an object toward packaging material dispenser 106, away from load 110, and thus, against the direction of flow of packaging material 108, may be defined as "upstream." Similarly, movement of an object away from packaging material dispenser 106, toward load 110, and thus, with the flow of packaging material 108, may be defined as "downstream." Also, positions relative to load 110 (or a load support surface 118) and packaging material dispenser 106 may be described relative to the direction of packaging material flow. For example, when two pre-stretch rollers are present, the pre-stretch roller closer to packaging material dispenser 106 may be characterized as the "upstream" roller and the pre-stretch roller closer to load 110 (or load support 118) and further from packaging material dispenser 106 may be characterized as the "downstream" roller.

A packaging material drive system 120, including, for example, an electric motor 122, may be used to drive dispensing rollers 114 and 116. For example, electric motor 122 may rotate downstream dispensing roller 116. Downstream dispensing roller 116 may be operatively coupled to upstream dispensing roller 114 by a chain and sprocket assembly, such that upstream dispensing roller 114 may be driven in rotation by downstream dispensing roller 116. Other connections may be used to drive upstream roller 114 or, alternatively, a separate drive (not shown) may be provided to drive upstream roller 114.

Downstream of downstream dispensing roller 116 may be provided one or more idle rollers 124, 126 that redirect the web of packaging material, with the most downstream idle roller 126 effectively providing an exit point 128 from packaging material dispenser 102, such that a portion 130 of packaging material 108 extends between exit point 128 and a contact point 132 where the packaging material engages load 110 (or alternatively contact point 132' if load 110 is rotated in a counter-clockwise direction).

Wrapping apparatus 100 also includes a relative rotation assembly 134 configured to rotate rotating arm 104, and thus, packaging material dispenser 106 mounted thereon, relative to load 110 as load 110 is supported on load support surface 118. Relative rotation assembly 134 may include a rotational drive system 136, including, for example, an electric motor 138. It is contemplated that rotational drive system 136 and packaging material drive system 120 may run independently of one another. Thus, rotation of dispensing rollers 114 and 116 may be independent of the relative rotation of packaging material dispenser 106 relative to load 110. This independence allows a length of packaging material 108 to be dispensed per a portion of relative revolution that is neither predetermined or constant. Rather, the length may be adjusted periodically or continuously based on changing conditions.

Wrapping apparatus 100 may further include a lift assembly 140. Lift assembly 140 may be powered by a lift drive system 142, including, for example, an electric motor 144, that may be configured to move roll carriage 102 vertically relative to load 110. Lift drive system 142 may drive roll carriage 102, and thus packaging material dispenser 106, upwards and downwards vertically on rotating arm 104 while roll carriage 102 and packaging material dispenser 106 are rotated about load 110 by rotational drive system 136, to wrap packaging material spirally about load 110.

One or more of downstream dispensing roller 116, idle roller 124 and idle roller 126 may include a corresponding sensor 146, 148, 150 to monitor rotation of the respective roller. In particular, rollers 116, 124 and/or 126, and/or packaging material 108 dispensed thereby, may be used to monitor a dispense rate of packaging material dispenser 106, e.g., by monitoring the rotational speed of rollers 116, 124 and/or 126, the number of rotations undergone by such rollers, the amount and/or speed of packaging material dispensed by such rollers, and/or one or more performance parameters indicative of the operating state of packaging material drive system 120, including, for example, a speed of packaging material drive system 120. The monitored characteristics may also provide an indication of the amount of packaging material 108 being dispensed and wrapped onto load 110. In addition, in some embodiments a sensor, e.g., sensor 148 or 150, may be used to detect a break in the packaging material.

Wrapping apparatus also includes an angle sensor 152 for determining an angular relationship between load 110 and packaging material dispenser 106 about a center of rotation 154 (through which projects an axis of rotation that is perpendicular to the view illustrated in FIG. 1). Angle sensor 152 may be implemented, for example, as a rotary encoder, or alternatively, using any number of alternate sensors or sensor arrays capable of providing an indication of the angular relationship and distinguishing from among multiple angles throughout the relative rotation, e.g., an array of proximity switches, optical encoders, magnetic encoders, electrical sensors, mechanical sensors, photodetectors, motion sensors, etc. The angular relationship may be represented in some embodiments in terms of degrees or fractions of degrees, while in other embodiments a lower resolution may be adequate. It will also be appreciated that an angle sensor consistent with the invention may also be disposed in other locations on wrapping apparatus 100, e.g., about the periphery or mounted on arm 104 or roll carriage 102. In addition, in some embodiments angular relationship may be represented and/or measured in units of time, based upon a known rotational speed of the load relative to the packaging material dispenser, from which a time to complete a full revolution may be derived such that segments of the revolution time would correspond to particular angular relationships.

Additional sensors, such as a load distance sensor 156 and/or a film angle sensor 158, may also be provided on wrapping apparatus 100. Load distance sensor 156 may be used to measure a distance from a reference point to a surface of load 110 as the load rotates relative to packaging material dispenser 106 and thereby determine a cross-sectional dimension of the load at a predetermined angular position relative to the packaging material dispenser. In one embodiment, load distance sensor 156 measures distance along a radial from center of rotation 154, and based on the known, fixed distance between the sensor and the center of rotation, the dimension of the load may be determined by subtracting the sensed distance from this fixed distance. Sensor 156 may be implemented using various types of distance sensors, e.g., a photo eye, proximity detector, laser distance measurer, ultrasonic distance measurer, electronic rangefinder, and/or any other suitable distance measuring device. Exemplary distance measuring devices may include, for example, an IFM Effector 01D100 and a Sick UM30-213118 (6036923).

Film angle sensor 158 may be used to determine a film angle for portion 130 of packaging material 108, which may be relative, for example, to a radial (not shown in FIG. 1) extending from center of rotation 154 to exit point 128 (although other reference lines may be used in the alternative).

In one embodiment, film angle sensor 158 may be implemented using a distance sensor, e.g., a photo eye, proximity detector, laser distance measurer, ultrasonic distance measurer, electronic rangefinder, and/or any other suitable distance measuring device. In one embodiment, an IFM Effector 01D100 and a Sick UM30-213118 (6036923) may be used for film angle sensor 158. In other embodiments, film angle sensor 158 may be implemented mechanically, e.g., using a cantilevered or rockered follower arm having a free end that rides along the surface of portion 130 of packaging material 108 such that movement of the follower arm tracks movement of the packaging material. In still other embodiments, a film angle sensor may be implemented by a force sensor that senses force changes resulting from movement of portion 130 through a range of film angles, or a sensor array (e.g., an image sensor) that is positioned above or below the plane of portion 130 to sense an edge of the packaging material. Wrapping apparatus 100 may also include additional components used in connection with other aspects of a wrapping operation. For example, a clamping device 159 may be used to grip the leading end of packaging material 108 between cycles. In addition, a conveyor (not shown) may be used to convey loads to and from wrapping apparatus 100. Other components commonly used on a wrapping apparatus will be appreciated by one of ordinary skill in the art having the benefit of the instant disclosure.

Figure 2:
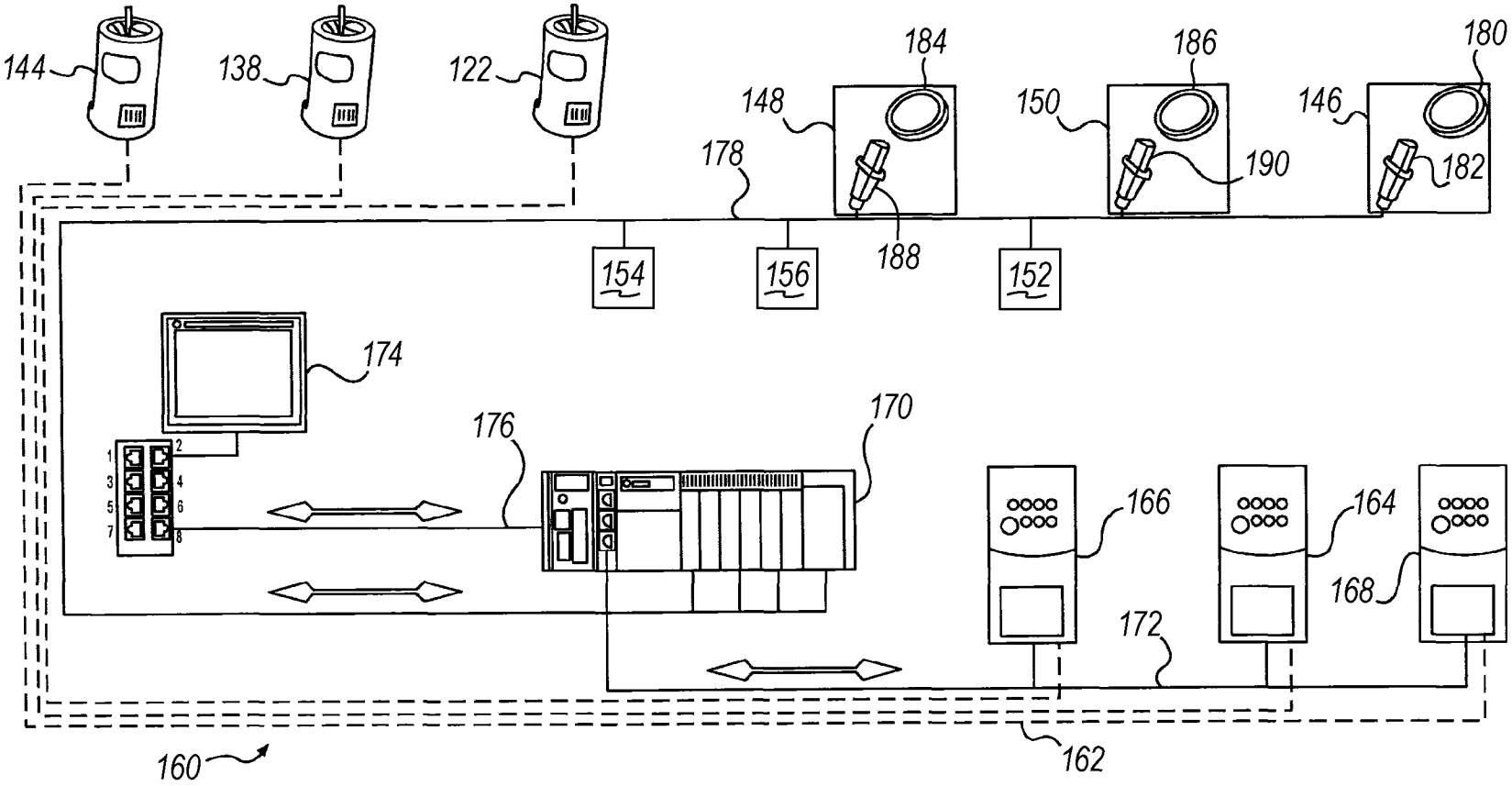
FIG. 2 is a schematic view of an exemplary control system for use in the apparatus of FIG. 1.

An exemplary schematic of a control system 160 for wrapping apparatus 100 is shown in FIG. 2. Motor 122 of packaging material drive system 120, motor 138 of rotational drive system 136, and motor 144 of lift drive system 142 may communicate through one or more data links 162 with a rotational drive variable frequency drive ("VFD") 164, a packaging material drive VFD 166, and a lift drive VFD 168, respectively. Rotational drive VFD 164, packaging material drive VFD 166, and lift drive VFD 168 may communicate with controller 170 through a data link 172. It should be understood that rotational drive VFD 164, packaging material drive VFD 166, and lift drive VFD 168 may produce outputs to controller 170 that controller 170 may use as indicators of rotational movement. For example, packaging material drive VFD 166 may provide controller 170 with signals similar to signals provided by sensor 146, and thus, sensor 146 may be omitted to cut down on manufacturing costs.

Controller 170 may include hardware components and/or software program code that allow it to receive, process, and transmit data. It is contemplated that controller 170 may be implemented as a programmable logic controller (PLC), or may otherwise operate similar to a processor in a computer system. Controller 170 may communicate with an operator interface 174 via a data link 176. Operator interface 174 may include a display or screen and controls that provide an operator with a way to monitor, program, and operate wrapping apparatus 100. For example, an operator may use operator interface 174 to enter or change predetermined and/or desired settings and values, or to start, stop, or pause the wrapping cycle. Controller 170 may also communicate with one or more sensors, e.g., sensors 146, 148, 150, 152, 154 and 156, as well as others not illustrated in FIG. 2, through a data link 178, thus allowing controller 170 to receive performance related data during wrapping. It is contemplated that data links 162, 172, 176, and 178 may include any suitable wired and/or wireless communications media known in the art.

As noted above, sensors 146, 148, 150, 152 may be configured in a number of manners consistent with the invention. In one embodiment, for example, sensor 146 may be configured to sense rotation of downstream dispensing roller 116, and may include one or more magnetic transducers 180 mounted on downstream dispensing roller 116, and a sensing device 182 configured to generate a pulse when the one or more magnetic transducers 180 are brought into proximity of sensing device 182. Alternatively, sensor assembly 146 may include an encoder configured to monitor rotational movement, and capable of producing, for example, 360 or 720 signals per revolution of downstream dispensing roller 116 to provide an indication of the speed or other characteristic of rotation of downstream dispensing roller 116. The encoder may be mounted on a shaft of downstream dispensing roller 116, on electric motor 122, and/or any other suitable area. One example of a sensor assembly that may be used is an Encoder Products Company model 15H optical encoder. Other suitable sensors and/or encoders may be used for monitoring, such as, for example, optical encoders, magnetic encoders, electrical sensors, mechanical sensors, photodetectors, and/or motion sensors.

Likewise, for sensors 148 and 150, magnetic transducers 184, 186 and sensing devices 188, 190 may be used to monitor rotational movement, while for sensor 152, a rotary encoder may be used to determine the angular relationship between the load and packaging material dispenser. Any of the aforementioned alternative sensor configurations may be used for any of sensors 146, 148, 150, 152, 154 and 156 in other embodiments, and as noted above, one or more of such sensors may be omitted in some embodiments. Additional sensors capable of monitoring other aspects of the wrapping operation may also be coupled to controller 170 in other embodiments.

For the purposes of the invention, controller 170 may represent practically any type of computer, computer system, controller, logic controller, or other programmable electronic device, and may in some embodiments be implemented using one or more networked computers or other electronic devices, whether located locally or remotely with respect to wrapping apparatus 100. Controller 170 typically includes a central processing unit including at least one microprocessor coupled to a memory, which may represent the random access memory (RAM) devices comprising the main storage of controller 170, as well as any supplemental levels of memory, e.g., cache memories, non-volatile or backup memories (e.g., programmable or flash memories), read-only memories, etc. In addition, the memory may be considered to include memory storage physically located elsewhere in controller 170, e.g., any cache memory in a processor in CPU 52, as well as any storage capacity used as a virtual memory, e.g., as stored on a mass storage device or on another computer or electronic device coupled to controller 170. Controller 170 may also include one or more mass storage devices, e.g., a floppy or other removable disk drive, a hard disk drive, a direct access storage device (DASD), an optical drive (e.g., a CD drive, a DVD drive, etc.), and/or a tape drive, among others. Furthermore, controller 170 may include an interface with one or more networks (e.g., a LAN, a WAN, a wireless network, and/or the Internet, among others) to permit the communication of information to the components in wrapping apparatus 100 as well as with other computers and electronic devices. Controller 170 operates under the control of an operating system, kernel and/or firmware and executes or otherwise relies upon various computer software applications, components, programs, objects, modules, data structures, etc. Moreover, various applications, components, programs, objects, modules, etc. may also execute on one or more processors in another computer coupled to controller 170, e.g., in a distributed or client-server computing environment, whereby the processing required to implement the functions of a computer program may be allocated to multiple computers over a network.

In general, the routines executed to implement the embodiments of the invention, whether implemented as part of an operating system or a specific application, component, program, object, module or sequence of instructions, or even a subset thereof, will be referred to herein as "computer program code," or simply "program code." Program code typically comprises one or more instructions that are resident at various times in various memory and storage devices in a computer, and that, when read and executed by one or more processors in a computer, cause that computer to perform the steps necessary to execute steps or elements embodying the various aspects of the invention. Moreover, while the invention has and hereinafter will be described in the context of fully functioning controllers, computers and computer systems, those skilled in the art will appreciate that the various embodiments of the invention are capable of being distributed as a program product in a variety of forms, and that the invention applies equally regardless of the particular type of computer readable media used to actually carry out the distribution.

Such computer readable media may include computer readable storage media and communication media. Computer readable storage media is non-transitory in nature, and may include volatile and non-volatile, and removable and non-removable media implemented in any method or technology for storage of information, such as computer-readable instructions, data structures, program modules or other data. Computer readable storage media may further include RAM, ROM, erasable programmable read-only memory (EPROM), electrically erasable programmable read-only memory (EEPROM), flash memory or other solid state memory technology, CD-ROM, digital versatile disks (DVD), or other optical storage, magnetic cassettes, magnetic tape, magnetic disk storage or other magnetic storage devices, or any other medium that can be used to store the desired information and which can be accessed by controller 170. Communication media may embody computer readable instructions, data structures or other program modules. By way of example, and not limitation, communication media may include wired media such as a wired network or direct-wired connection, and wireless media such as acoustic, RF, infrared and other wireless media. Combinations of any of the above may also be included within the scope of computer readable media.

Various program code described hereinafter may be identified based upon the application within which it is implemented in a specific embodiment of the invention. However, it should be appreciated that any particular program nomenclature that follows is used merely for convenience, and thus the invention should not be limited to use solely in any specific application identified and/or implied by such nomenclature. Furthermore, given the typically endless number of manners in which computer programs may be organized into routines, procedures, methods, modules, objects, and the like, as well as the various manners in which program functionality may be allocated among various software layers that are resident within a typical computer (e.g., operating systems, libraries, API's, applications, applets, etc.), it should be appreciated that the invention is not limited to the specific organization and allocation of program functionality described herein.

Figure 3:
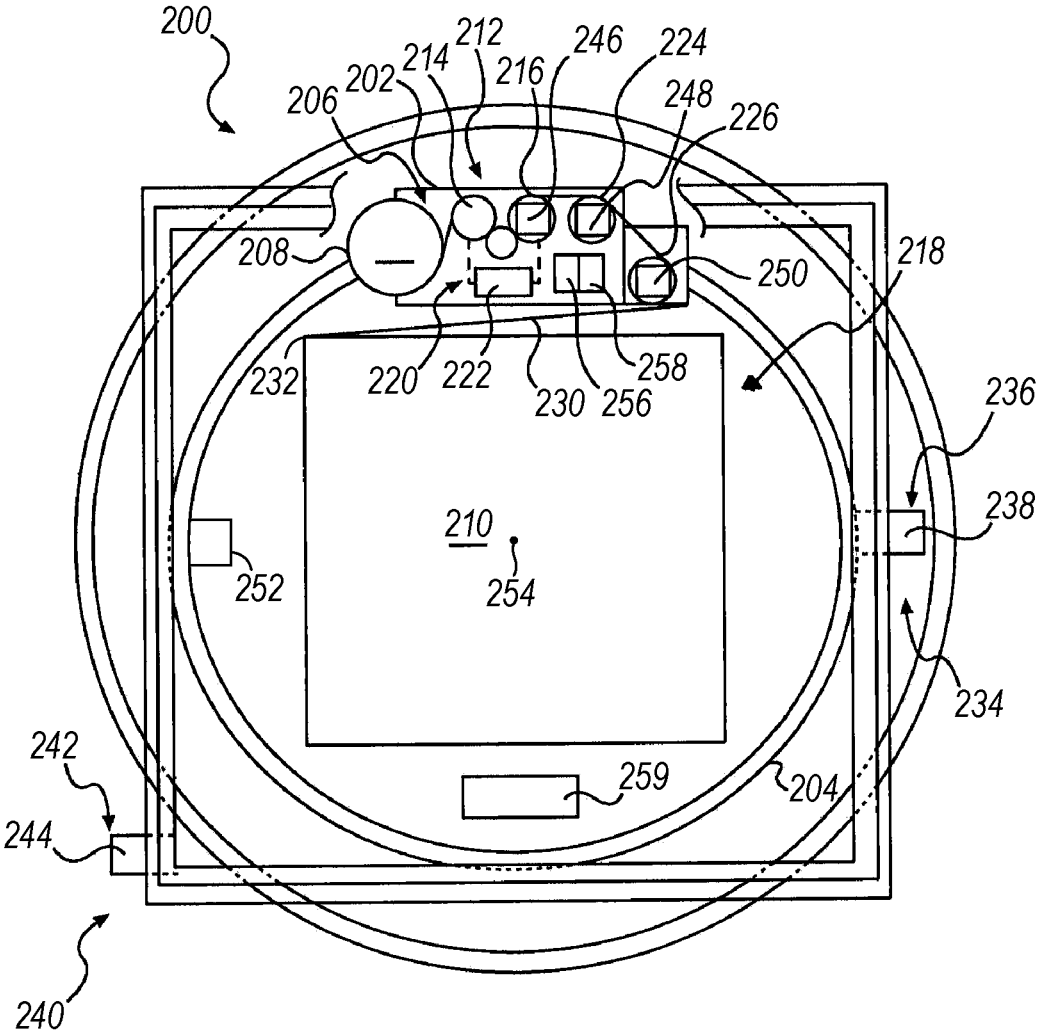
FIG. 3 shows a top view of a rotating ring-type wrapping apparatus consistent with the invention.

Now turning to FIG. 3, a rotating ring-type wrapping apparatus 200 is illustrated. Wrapping apparatus 200 may include elements similar to those shown in relation to wrapping apparatus 100 of FIG. 1, including, for example, a roll carriage 202 including a packaging material dispenser 206 configured to dispense packaging material 208 during relative rotation between roll carriage 202 and a load 210 disposed on a load support 218. However, a rotating ring 204 is used in wrapping apparatus 200 in place of rotating arm 104 of wrapping apparatus 100. In many other respects, however, wrapping apparatus 200 may operate in a manner similar to that described above with respect to wrapping apparatus 100.

Packaging material dispenser 206 may include a prestretch assembly 212 including an upstream dispensing roller 214 and a downstream dispensing roller 216, and a packaging material drive system 220, including, for example, an electric motor 222, may be used to drive dispensing rollers 214 and 216. Downstream of downstream dispensing roller 216 may be provided one or more idle rollers 224, 226, with the most downstream idle roller 226 effectively providing an exit point 228 from packaging material dispenser 206, such that a portion 230 of packaging material 208 extends between exit point 228 and a contact point 232 where the packaging material engages load 210.

Wrapping apparatus 200 also includes a relative rotation assembly 234 configured to rotate rotating ring 204, and thus, packaging material dispenser 206 mounted thereon, relative to load 210 as load 210 is supported on load support surface 218. Relative rotation assembly 234 may include a rotational drive system 236, including, for example, an electric motor 238. Wrapping apparatus 200 may further include a lift assembly 240, which may be powered by a lift drive system 242, including, for example, an electric motor 244, that may be configured to move rotating ring 204 and roll carriage 202 vertically relative to load 210.

In addition, similar to wrapping apparatus 100, wrapping apparatus 200 may include sensors 246, 248, 250 on one or more of downstream dispensing roller 216, idle roller 224 and idle roller 226. Furthermore, an angle sensor 252 may be provided for determining an angular relationship between load 210 and packaging material dispenser 206 about a center of rotation 254 (through which projects an axis of rotation that is perpendicular to the view illustrated in FIG. 3), and in some embodiments, one or both of a load distance sensor 256 and a film angle sensor 258 may also be provided. Sensor 252 may be positioned proximate center of rotation 254, or alternatively, may be positioned at other locations, such as proximate rotating ring 204. Wrapping apparatus 200 may also include additional components used in connection with other aspects of a wrapping operation, e.g., a clamping device 259 may be used to grip the leading end of packaging material 208 between cycles.

Figure 4:
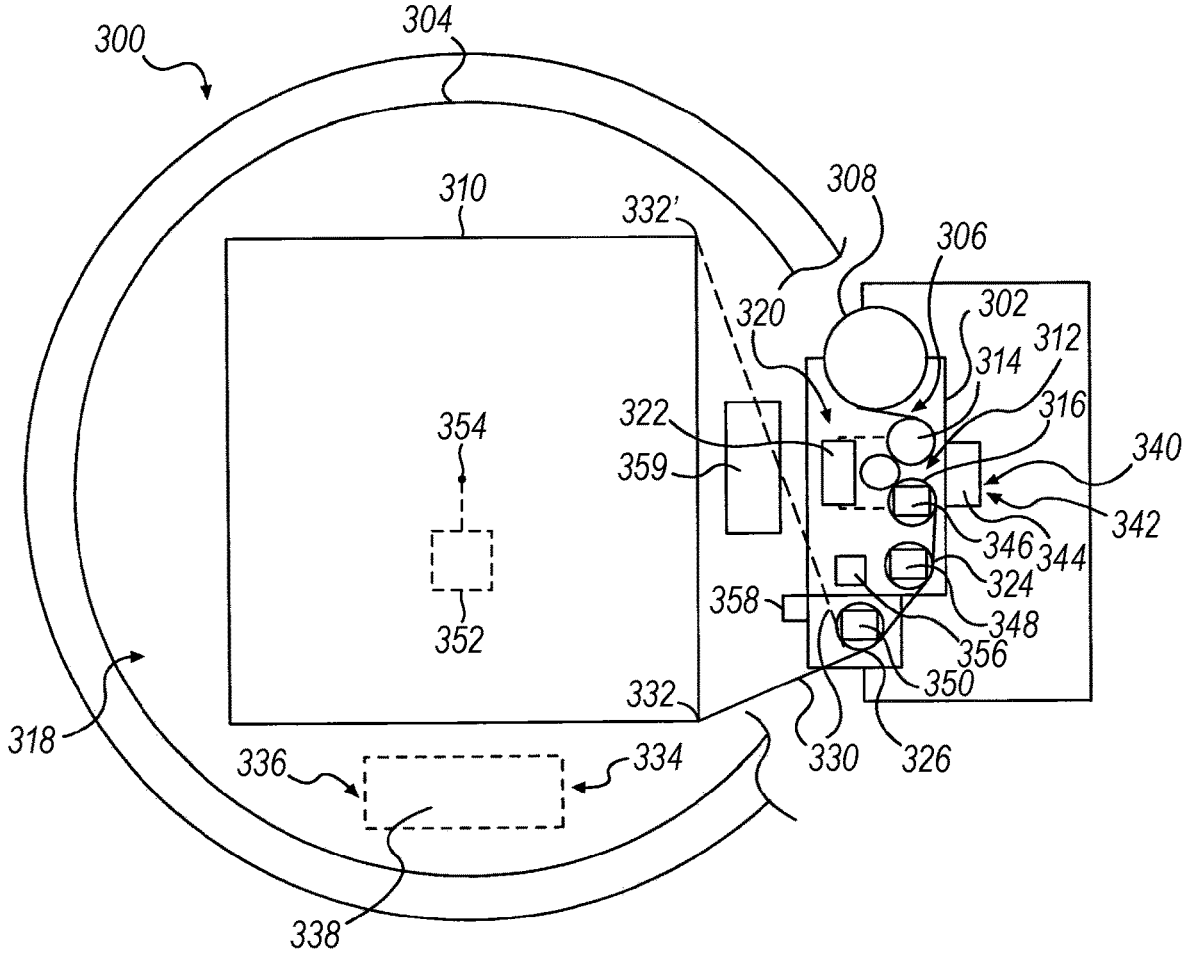
FIG. 4 shows a top view of a turntable-type wrapping apparatus consistent with the invention.

FIG. 4 likewise shows a turntable-type wrapping apparatus 300, which may also include elements similar to those shown in relation to wrapping apparatus 100 of FIG. 1. However, instead of a roll carriage 102 that rotates around a fixed load 110 using a rotating arm 104, as in FIG. 1, wrapping apparatus 300 includes a rotating turntable 304 functioning as a load support 318 and configured to rotate load 310 about a center of rotation 354 (through which projects an axis of rotation that is perpendicular to the view illustrated in FIG. 4) while a packaging material dispenser 306 disposed on a dispenser support 302 remains in a fixed location about center of rotation 354 while dispensing packaging material 308. In many other respects, however, wrapping apparatus 300 may operate in a manner similar to that described above with respect to wrapping apparatus 100.

Packaging material dispenser 306 may include a prestretch assembly 312 including an upstream dispensing roller 314 and a downstream dispensing roller 316, and a packaging material drive system 320, including, for example, an electric motor 322, may be used to drive dispensing rollers 314 and 316, and downstream of downstream dispensing roller 316 may be provided one or more idle rollers 324, 326, with the most downstream idle roller 326 effectively providing an exit point 328 from packaging material dispenser 306, such that a portion 330 of packaging material 308 extends between exit point 328 and a contact point 332 (or alternatively contact point 332' if load 310 is rotated in a counter-clockwise direction) where the packaging material engages load 310.

Wrapping apparatus 300 also includes a relative rotation assembly 334 configured to rotate turntable 304, and thus, load 310 supported thereon, relative to packaging material dispenser 306. Relative rotation assembly 334 may include a rotational drive system 336, including, for example, an electric motor 338. Wrapping apparatus 300 may further include a lift assembly 340, which may be powered by a lift drive system 342, including, for example, an electric motor 344, that may be configured to move dispenser support 302 and packaging material dispenser 306 vertically relative to load 310.

In addition, similar to wrapping apparatus 100, wrapping apparatus 300 may include sensors 346, 348, 350 on one or more of downstream dispensing roller 316, idle roller 324 and idle roller 326. Furthermore, an angle sensor 352 may be provided for determining an angular relationship between load 310 and packaging material dispenser 306 about a center of rotation 354, and in some embodiments, one or both of a load distance sensor 356 and a film angle sensor 358 may also be provided. Sensor 352 may be positioned proximate center of rotation 354, or alternatively, may be positioned at other locations, such as proximate the edge of turntable 304. Wrapping apparatus 300 may also include additional components used in connection with other aspects of a wrapping operation, e.g., a clamping device 359 may be used to grip the leading end of packaging material 308 between cycles.

Each of wrapping apparatus 200 of FIG. 3 and wrapping apparatus 300 of FIG. 4 may also include a controller (not shown) similar to controller 170 of FIG. 2, and receive signals from one or more of the aforementioned sensors and control packaging material drive system 220, 320 during relative rotation between load 210, 310 and packaging material dispenser 206, 306.

Those skilled in the art will recognize that the exemplary environments illustrated in FIGS. 1-4 are not intended to limit the present invention. Indeed, those skilled in the art will recognize that other alternative environments may be used without departing from the scope of the invention.

Wrapping Operation

During a typical wrapping operation, a clamping device, e.g., as known in the art, is used to position a leading edge of the packaging material on the load such that when relative rotation between the load and the packaging material dispenser is initiated, the packaging material will be dispensed from the packaging material dispenser and wrapped around the load. In addition, where prestretching is used, the packaging material is stretched prior to being conveyed to the load. The dispense rate of the packaging material is controlled during the relative rotation between the load and the packaging material, and a lift assembly controls the position, e.g., the height, of the web of packaging material engaging the load so that the packaging material is wrapped in a spiral manner around the load from the base or bottom of the load to the top. Multiple layers of packaging material may be wrapped around the load over multiple passes to increase overall containment force, and once the desired amount of packaging material is dispensed, the packaging material is severed to complete the wrap.

In the illustrated embodiments, to control the overall containment force of the packaging material applied to the load, both the wrap force and the position of the web of packaging material are both controlled to provide the load with a desired overall containment force. The mechanisms by which each of these aspects of a wrapping operation are controlled are provided below.

Wrap Force Control

In many wrapping applications, the rate at which packaging material is dispensed by a packaging material dispenser of a wrapping apparatus is controlled based on a desired payout percentage, which in general relates to the amount of wrap force applied to the load by the packaging material during wrapping. Further details regarding the concept of payout percentage may be found, for example, in the aforementioned U.S. Pat. No. 7,707,801, which has been incorporated by reference.

In many embodiments, for example, a payout percentage may have a range of about 80% to about 120%. Decreasing the payout percentage slows the rate at which packaging material exits the packaging material dispenser compared to the relative rotation of the load such that the packaging material is pulled tighter around the load, thereby increasing wrap force, and as a consequence, the overall containment force applied to the load. In contrast, increasing the payout percentage decreases the wrap force. For the purposes of simplifying the discussion hereinafter, however, a payout percentage of 100% is initially assumed.

It will be appreciated, however, that other metrics may be used as an alternative to payout percentage to reflect the relative amount of wrap force to be applied during wrapping, so the invention is not so limited. In particular, to simplify the discussion, the term "wrap force" will be used herein to generically refer to any metric or parameter in a wrapping apparatus that may be used to control how tight the packaging material is pulled around a load at a given instant. Wrap force, as such, may be based on the amount of tension induced in a web of packaging material extending between the packaging material dispenser and the load, which in some embodiments may be measured and controlled directly, e.g., through the use of an electronic load cell coupled to a roller over which the packaging material passes, a spring-loaded dancer interconnected with a sensor, a torque control device, or any other suitable sensor capable of measuring force or tension in a web of packaging material.

On the other hand, because the amount of tension that is induced in a web of packaging material is fundamentally based upon the relationship between the feed rate of the packaging material and the rate of relative rotation of the load (i.e., the demand rate of the load), wrap force may also refer to various metrics or parameters related to the rate at which the packaging material is dispensed by a packaging material dispenser.

Thus, a payout percentage, which relates the rate at which the packaging material is dispensed by the packaging material dispenser to the rate at which the load is rotated relative to the packaging material dispenser, may be a suitable wrap force parameter in some embodiments. Alternatively, a dispense rate, e.g., in terms of the absolute or relative linear rate at which packaging material exits the packaging material dispenser, or the absolute or relative rotational rate at which an idle or driven roller in the packaging material dispenser or otherwise engaging the packaging material rotates, may also be a suitable wrap force parameter in some embodiments.

To control wrap force in a wrapping apparatus, a number of different control methodologies may be used. For example, in some embodiments of the invention, the effective circumference of a load may be used to dynamically control the rate at which packaging material is dispensed to a load when wrapping the load with packaging material during relative rotation established between the load and a packaging material dispenser, and thus control the wrap force applied to the load by the packaging material.

Figure 5:
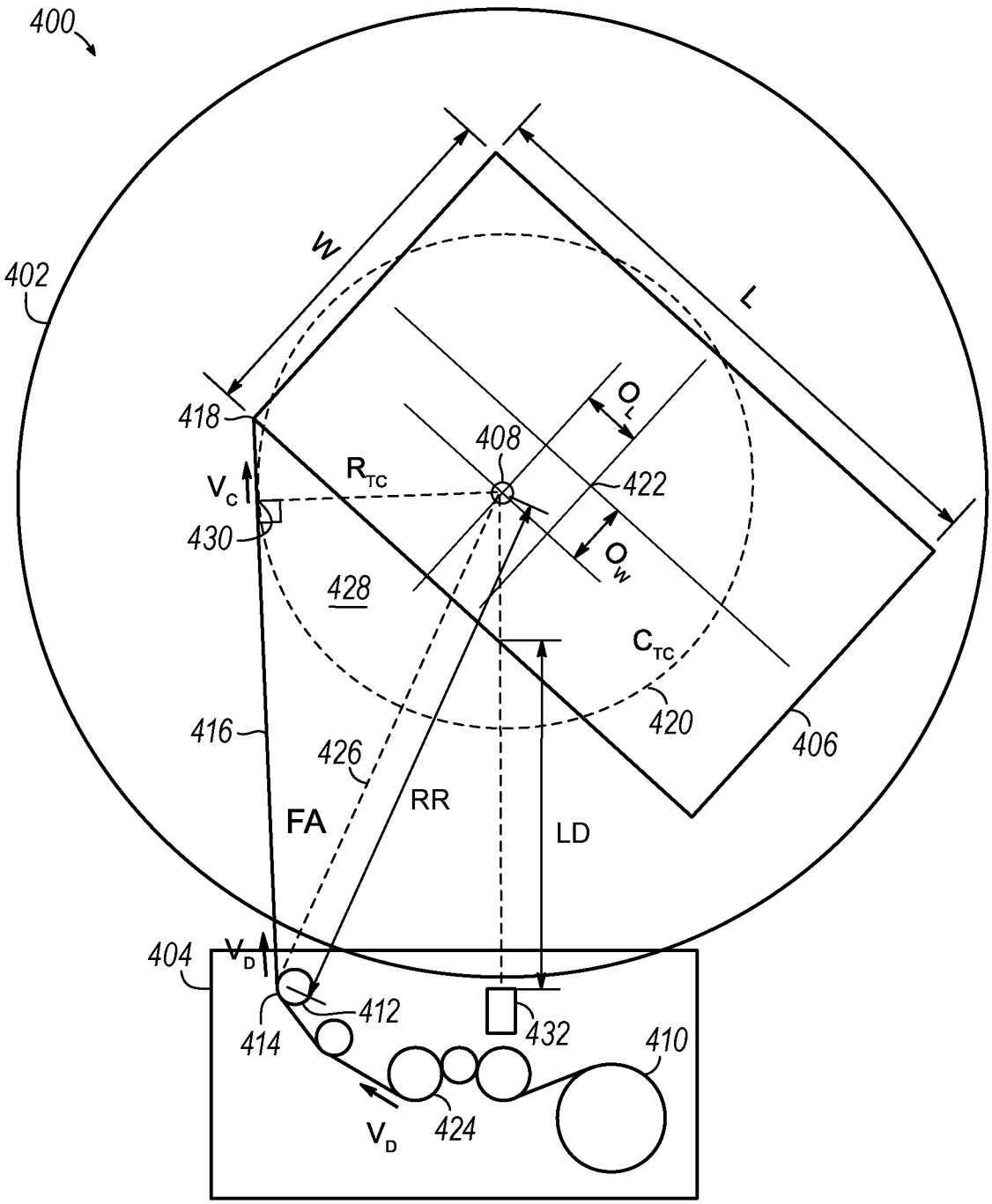
FIG. 5 is a top view of a packaging material dispenser and a load, illustrating a tangent circle defined for the load throughout relative rotation between the packaging material dispenser and the load.

FIG. 5, for example, functionally illustrates a wrapping apparatus 400 in which a load support 402 and packaging material dispenser 404 are adapted for relative rotation with one another to rotate a load 406 about a center of rotation 408 and thereby dispense a packaging material 410 for wrapping around the load. In this illustration, the relative rotation is in a clockwise direction relative to the load (i.e., the load rotates clockwise relative to the packaging material dispenser, while the packaging material dispenser may be considered to rotate in a counter-clockwise direction around the load).

In embodiments consistent with the invention, the effective circumference of a load throughout relative rotation is indicative of an effective consumption rate of the load, which is in turn indicative of the amount of packaging material being "consumed" by the load as the load rotates relative to the packaging dispenser. In particular, effective consumption rate, as used herein, generally refers to a rate at which packaging material would need to be dispensed by the packaging material dispenser in order to substantially match the tangential velocity of a tangent circle that is substantially centered at the center of rotation of the load and substantially tangent to a line substantially extending between a first point proximate to where the packaging material exits the dispenser and a second point proximate to where the packaging material engages the load. This line is generally coincident with the web of packaging material between where the packaging material exits the dispenser and where the packaging material engages the load.

As shown in FIG. 5, for example, an idle roller 412 defines an exit point 414 for packaging material dispenser 404, such that a portion of web 416 of packaging material 410 extends between this exit point 414 and an engagement point 418 at which the packaging material 410 engages load 406. In this arrangement, a tangent circle 420 is tangent to portion 416 and is centered at center of rotation 408.

The tangent circle has a circumference $C_{TC}$, which for the purposes of this invention, is referred to as the "effective circumference" of the load. Likewise, other dimensions of the tangent circle, e.g., the radius $R_{TC}$ and diameter $D_{TC}$, may be respectively referred to as the "effective radius" and "effective diameter" of the load.

It has been found that for a load having a non-circular cross-section, as the load rotates relative to the dispenser about center of rotation 408 (through which an axis of rotation extends generally perpendicular to the view shown in FIG. 5), the size (i.e., the circumference, radius and diameter) of tangent circle 420 dynamically varies, and that the size of tangent circle 420 throughout the rotation effectively models, at any given angular position of the load relative to the dispenser, a rate at which packaging material should be dispensed in order to match the consumption rate of the load, i.e., where the dispense rate in terms of linear velocity (represented by arrow $V_D$) is substantially equal to the tangential velocity of the tangent circle (represented by arrow $V_C$). Thus, in situations where a payout percentage of 100% is desired, the desired dispense rate of the packaging material may be set to substantially track the dynamically changing tangential velocity of the tangent circle.

Of note, the tangent circle is dependent not only on the dimensions of the load (i.e., the length L and width W), but also the offset of the geometric center 422 of the load from the center of rotation 408, illustrated in FIG. 5 as $O_L$ and $O_W$. Given that in many applications, a load will not be perfectly centered when it is placed or conveyed onto the load support, the dimensions of the load, by themselves, typically do not present a complete picture of the effective consumption rate of the load. Nonetheless, as will become more apparent below, the calculation of the dimensions of the tangent circle, and thus the effective consumption rate, may be determined without determining the actual dimensions and/or offset of the load in many embodiments.

It has been found that this tangent circle, when coupled with the web of packaging material and the drive roller (e.g., drive roller 424), functions in much the same manner as a belt drive system, with tangent circle 420 functioning as the driver pulley, dispenser drive roller 424 functioning as the follower pulley, and web 416 of packaging material functioning as the belt. For example, let $N_d$ be the rotational velocity of a driver pulley in RPM, $N_f$ be the rotational velocity of a follower pulley in RPM, $R_d$ be the radius of the driver pulley and $R_f$ be the radius of the follower pulley. Consider the length of belt that passes over each of the driver pulley and the follower pulley in one minute, which is equal to the circumference of the respective pulley (diameter*π, or radius*2π) multiplied by the rotational velocity:

$$L_d=2\pi*R_d*N_d \quad (1)$$

$$L_f=2\pi*R_f*N_f \quad (2)$$

where $L_d$ is the length of belt that passes over the driver pulley in one minute, and $L_f$ is the length of belt that passes over the follower pulley in one minute.

In this theoretical system, the point at which neither pulley applied a tensile or compressive force to the belt (which generally corresponds to a payout percentage of 100%) would be achieved when the tangential velocities, i.e., the linear velocities at the surfaces or rims of the pulleys, were equal. Put another way, when the length of belt that passes over each pulley over the same time period is equal, i.e., $L_d=L_f$. Therefore:

$$2\pi*R_d*N_d=2\pi*R_f*N_f \quad (3)$$

Consequently, the velocity ratio VR of the rotational velocities of the driver and follower pulleys is:

$$VR=\frac{N_d}{N_f}=\frac{R_f}{R_d} \quad (4)$$

Alternatively, the velocity ratio may be expressed in terms of the ratio of diameters or of circumferences:

$$VR=\frac{N_d}{N_f}=\frac{D_f}{D_d} \quad (5)$$

$$VR=\frac{N_d}{N_f}=\frac{C_f}{C_d} \quad (6)$$

where $D_f$, $D_d$ are the respective diameters of the follower and driver pulleys, and $C_f$, $C_d$ are the respective circumferences of the follower and driver pulleys.

Returning to equations (1) and (2) above, the values $L_d$ and $L_f$ represent the length of belt that passes the driver and follower pulleys in one minute. Thus, when the tangent circle for the load is considered a driver pulley, the effective consumption rate (ECR) may be considered to be equal to the length of packaging material that passes the tangent circle in a fixed amount of time, e.g., per minute:

$$ECR=C_{TC}*N_{TC}=2\pi*R_{TC}*N_{TC} \quad (7)$$

where $C_{TC}$ is the circumference of the tangent circle, $N_{TC}$ is the rotational velocity of the tangent circle (e.g., in revolutions per minute (RPM)), and $R_{TC}$ is the radius of the tangent circle.

Therefore, given a known rotational velocity for the load, a known circumference of the tangent circle at a given instant and a known circumference for the drive roller, the rotational velocity of the drive roller necessary to provide a dispense rate that substantially matches the effective consumption rate is:

$$N_{DR}=\frac{C_{TC}}{C_{DR}}*N_L \quad (8)$$

where $N_{DR}$ is the rotational rate of the drive roller, $C_{TC}$ is the circumference of the tangent circle and the effective circumference of the load, CDR is the circumference of the drive roller and NL is the rotational rate of the load relative to the dispenser.

In addition, should it be desirable to scale the rotational rate of the drive roller to provide a controlled payout percentage (PP), and thereby provide a desired containment force and/or a desired packaging material use efficiency, equation (8) may be modified as follows:

$$N_{DR}=\frac{C_{TC}}{C_{DR}}*N_L*PP \quad (9)$$

Figure 6:
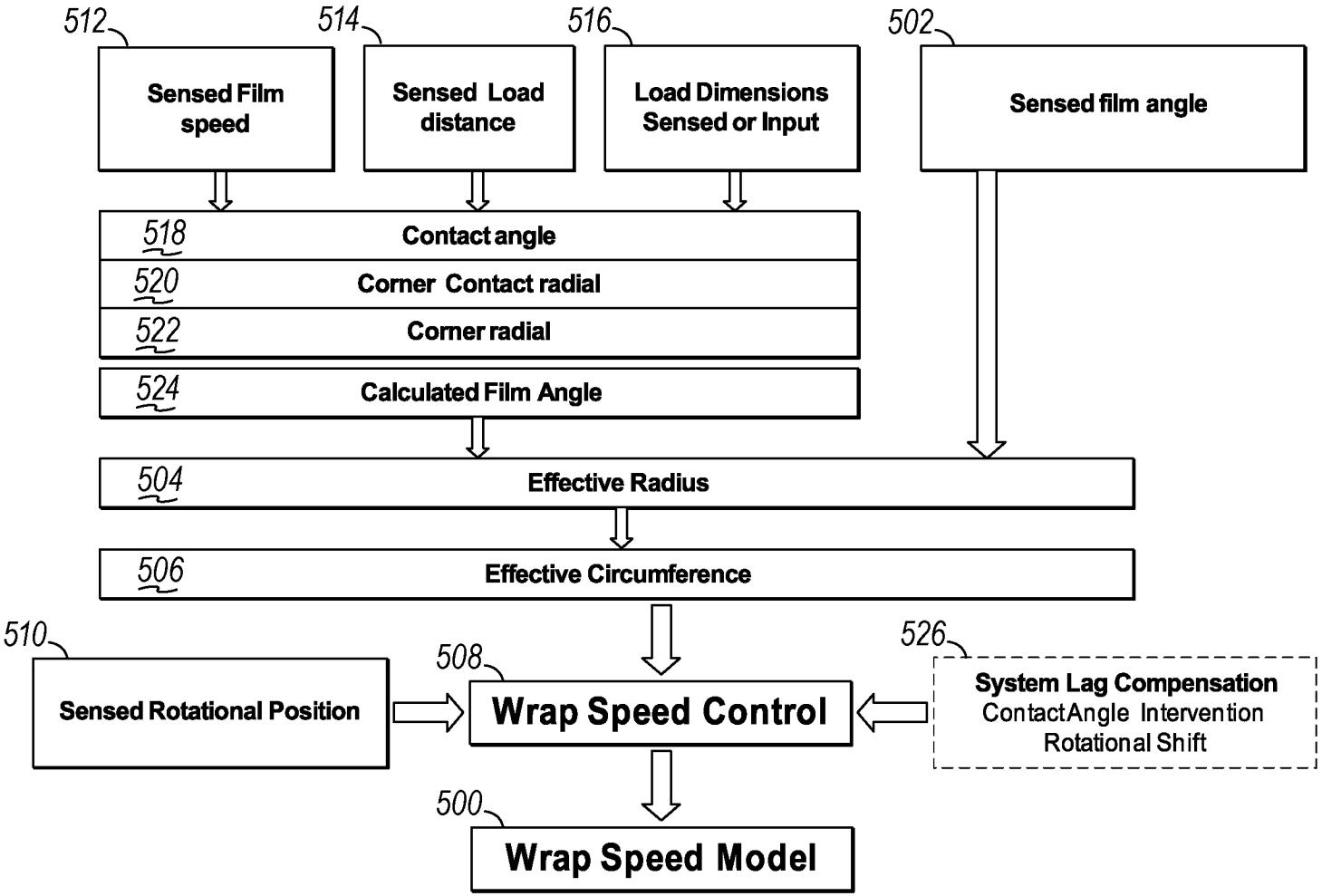
FIG. 6 is a block diagram of various inputs to a wrap speed model consistent with the invention.

The manner in which the dimensions (i.e., circumference, diameter and/or radius) of the tangent circle may be calculated or otherwise determined may vary in different embodiments. For example, as illustrated in FIG. 6, a wrap speed model 500, representing the control algorithm by which to drive a packaging material dispenser to dispense packaging material at a desired dispense rate during relative rotation with a load, may be responsive to a number of different control inputs.

In some embodiments, for example, a sensed film angle (block 502) may be used to determine various dimensions of a tangent circle, e.g., effective radius (block 504) and/or effective circumference (block 506). As shown in FIG. 5, for example, a film angle FA may be defined as the angle at exit point 414 between portion 416 of packaging material 410 (to which tangent circle 420 is tangent) and a radial or radius 426 extending from center of rotation 408 to exit point 414.

Returning to FIG. 6, the film angle sensed in block 502, e.g., using an encoder and follower arm or other electronic sensor, is used to determine one or more dimensions of the tangent circle (e.g., effective radius, effective circumference and/or effective diameter), and from these determined dimensions, a wrap speed control algorithm 508 determines a dispense rate. In many embodiments, wrap speed control algorithm 508 also utilizes the angular relationship between the load and the packaging material dispenser, i.e., the sensed rotational position of the load, as an input such that, for any given rotational position or angle of the load (e.g., at any of a plurality of angles defined in a full revolution), a desired dispense rate for the determined tangent circle may be determined.

Alternatively or in addition to the use of sensed film angle, various additional inputs may be used to determine dimensions of a tangent circle. As shown in block 512, for example, a film speed sensor, such as an optical or magnetic encoder on an idle roller, may be used to determine the speed of the packaging material as the packaging material exits the packaging material dispenser. In addition, as shown in block 514, a laser or other distance sensor may be used to determine a load distance (i.e., the distance between the surface of the load at a particular rotational position and a reference point about the periphery of the load). Furthermore, as shown in block 516, the dimensions of the load, e.g., length, width and/or offset, may either be input manually by a user, may be received from a database or other electronic data source, or may be sensed or measured.

From any or all of these inputs, one or more dimensions of the load, such as corner contact angles (block 518), corner contact radials (block 520), and/or corner radials (block 522) may be used to determine a calculated film angle (block 524), such that this calculated film angle may be used in lieu of or in addition to any sensed film angle to determine one or more dimensions of the tangent circle. Thus, the calculated film angle may be used by the wrap speed control algorithm in a similar manner to the sensed film angle described above. Moreover, in some embodiments additional modifications may be applied to wrap speed control algorithm 508 to provide more accurate control over the dispense rate. As shown in block 526, for example, a compensation may be performed to address system lag. In some embodiments, for example, a controlled intervention may be performed to effectively anticipate contact of a corner of the load with the packaging material. In addition, in some embodiments, a rotational shift may be performed to better align collected data with the control algorithm and thereby account for various lags in the system.

Additional details regarding effective circumference-based control may be found in the aforementioned U.S. provisional patent applications Ser. No. 61/718,429 and Ser. No. 61/718,433, which have been incorporated by reference herein. In addition, as noted above other manners of directly or indirectly controlling wrap force may be used in other embodiments without departing from the spirit and scope of the invention, including various techniques and variations disclosed in the aforementioned provisional patent applications, as well as other wrap speed or wrap force-based control packaging material dispense techniques known in the art.

Web Position Control

Figure 7:
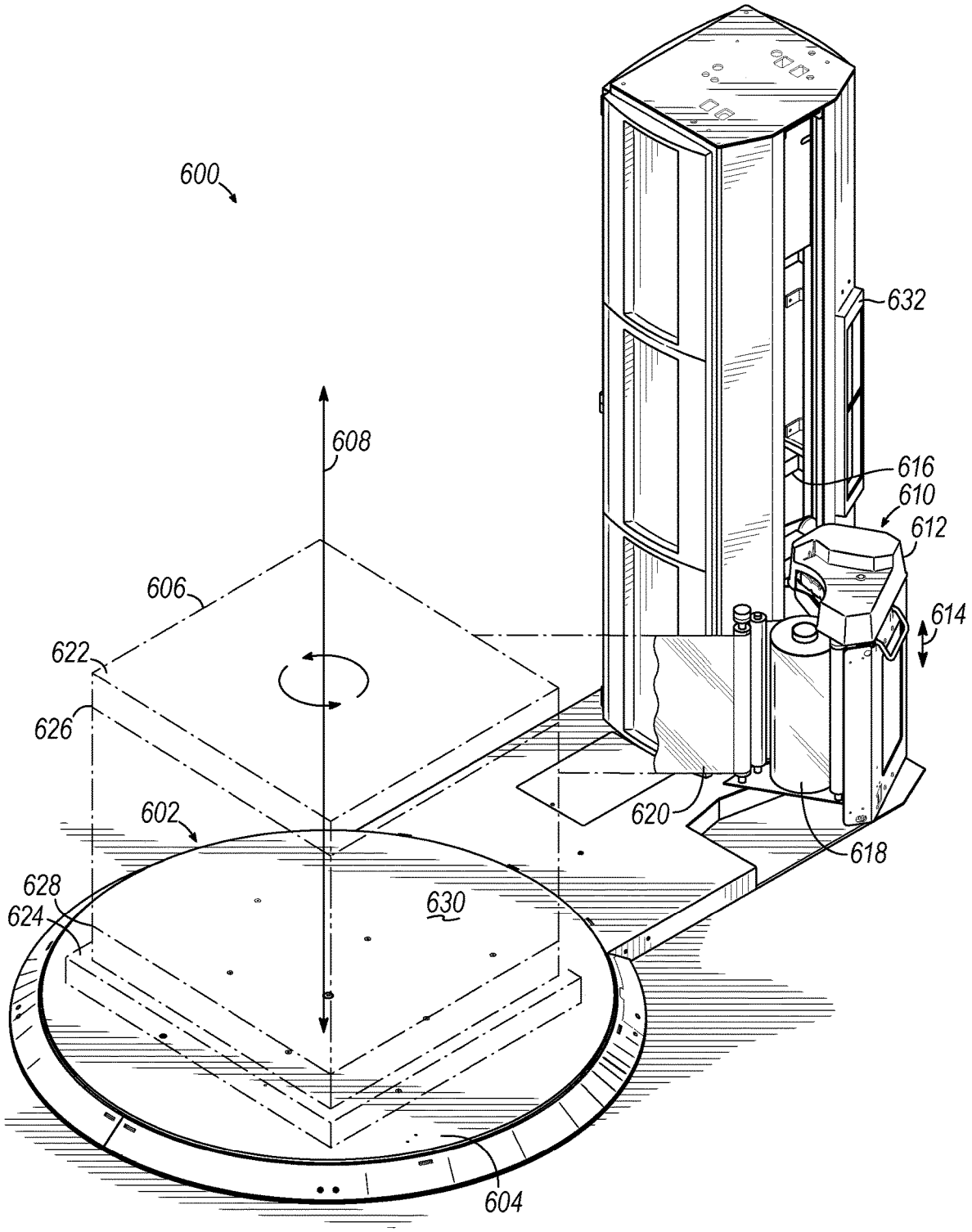
FIG. 7 is a perspective view of a turntable-type wrapping apparatus consistent with the invention.

As noted above, during a wrapping operation, the position of the web of packaging material is typically controlled to wrap the load in a spiral manner. FIG. 7, for example, illustrates a turntable-type wrapping apparatus 600 similar to wrapping apparatus 300 of FIG. 4, including a load support 602 configured as a rotating turntable 604 for supporting a load 606. Turntable 604 rotates about an axis of rotation 608, e.g., in a counter-clockwise direction as shown in FIG. 7.

A packaging material dispenser 610, including a roll carriage 612, is configured for movement along a direction 614 by a lift mechanism 616. Roll carriage 612 supports a roll 618 of packaging material, which during a wrapping operation includes a web 620 extending between packaging material dispenser 610 and load 606.

Direction 614 is generally parallel to an axis about which packaging material is wrapped around load 606, e.g., axis 608, and movement of roll carriage 612, and thus web 620, along direction 614 during a wrapping operation enables packaging material to be wrapped spirally around the load.

In the illustrated embodiment, it is desirable to provide at least a minimum number of layers of packaging material within a contiguous region on a load. For example, load 606 includes opposing ends along axis 608, e.g., a top 622 and bottom 624 for a load wrapped about a vertically oriented axis 608, and it may be desirable to wrap packaging material between two positions 626 and 628 defined along direction 614 and respectively proximate top 622 and bottom 624. Positions 626, 628 define a region 630 therebetween that, in the illustrated embodiments, is provided with at least a minimum number of layers of packaging material throughout.

The position of roll carriage 612 may be sensed using a sensing device (not shown in FIG. 7), which may include any suitable reader, encoder, transducer, detector, or sensor capable of determining the position of the roll carriage, another portion of the packaging material dispenser, or of the web of packaging material itself relative to load 606 along direction 614. It will be appreciated that while a vertical direction 614 is illustrated in FIG. 7, and thus the position of roll carriage 612 corresponds to a height, in other embodiments where a load is wrapped about an axis other than a vertical axis, the position of the roll carriage may not be related to a height.

Control of the position of roll carriage 612, as well as of the other drive systems in wrapping apparatus 600, is provided by a controller 632, the details of which are discussed in further detail below.

Containment Force-Based Wrapping

Conventionally, stretch wrapping machines have controlled the manner in which packaging material is wrapped around a load by offering control input for the number of bottom wraps placed at the base of a load, the number of top wraps placed at the top of the load, and the speed of the roll carriage in the up and down traverse to manage overlaps of the spiral wrapped film. In some designs, these controls have been enhanced by controlling the overlap inches during the up and down travel taking into consideration the relative speed of rotation and roll carriage speed.

However, it has been found that conventional control inputs often do not provide optimal performance, as such control inputs often do not evenly distribute the containment forces on all areas of a load, and often leave some areas with insufficient containment force. Often, this is due to the relatively complexity of the control inputs and the need for experienced operators. Particularly with less experienced operators, operators react to excessive film breaks by reducing wrap force and inadvertently lowering cumulative containment forces below desirable levels.

Embodiments consistent with the invention, on the other hand, utilize a containment force-based wrap control to simplify control over wrap parameters and facilitate even distribution of containment force applied to a load. In particular, in some embodiments of the invention, an operator specifies a load containment force requirement that is used, in combination with one or more attributes of the packaging material being used to wrap the load, to control the dispensing of packaging material to the load.

A load containment force requirement, for example, may include a minimum overall containment force to be applied over all concerned areas of a load (e.g., all areas over which packaging material is wrapped around the load). In some embodiments, a load containment force requirement may also include different minimum overall containment forces for different areas of a load, a desired range of containment forces for some or all areas of a load, a maximum containment force for some or all areas of a load.

A packaging material attribute may include, for example, an incremental containment force/revolution (ICF) attribute, which is indicative of the amount of containment force added to a load in a single revolution of packaging material around the load. The ICF attribute may be related to a wrap force or payout percentage, such that, for example, the ICF attribute is defined as a function of the wrap force or payout percentage at which the packaging material is being applied. In some embodiments, the ICF attribute may be linearly related to payout percentage, and include an incremental containment force at 100% payout percentage along with a slope that enables the incremental containment force to be calculated for any payout percentage. Alternatively, the ICF attribute may be defined with a more complex function, e.g., s-curve, interpolation, piecewise linear, exponential, multi-order polynomial, logarithmic, moving average, power, or other regression or curve fitting techniques. It will be appreciated that other attributes associated with the tensile strength of the packaging material may be used in the alternative.

Other packaging material attributes may include attributes associated with the thickness and/or weight of the packaging material, e.g., specified in terms of weight per unit length, such as weight in ounces per 1000 inches. Still other packaging material attributes may include a wrap force limit attributes, indicating, for example, a maximum wrap force or range of wrap forces with which to use the packaging material (e.g., a minimum payout percentage), a width attribute indicating the width (e.g., in inches) of the packaging material, as well as additional identifying attributes of a packaging material, e.g., manufacturer, model, composition, coloring, etc.

A load containment force requirement and a packaging material attribute may be used in a wrap control consistent with the invention to determine one or both of a wrap force to be used when wrapping a load with packaging material and a number of layers of packaging material to be applied to the load to meet the load containment force requirement. The wrap force and number of layers may be represented respectively by wrap force and layer parameters. The wrap force parameter may specify, for example, the desired wrap force to be applied to the load, e.g., in terms of payout percentage, or in terms of a dispense rate or force.

The layer parameter may specify, for example, a minimum number of layers of packaging material to be dispensed throughout a contiguous region of a load. In this regard, a minimum number of layers of three, for example, means that at any point on the load within a contiguous region wrapped with packaging material, at least three overlapping layers of packaging material will overlay that point. A layer parameter may also specify different number of layers for different portions of a load, and may include, for example, additional layers proximate the top and/or bottom of a load. Other layer parameters may include banding parameters (e.g., where multiple pallets are stacked together in one load).

Figure 8:
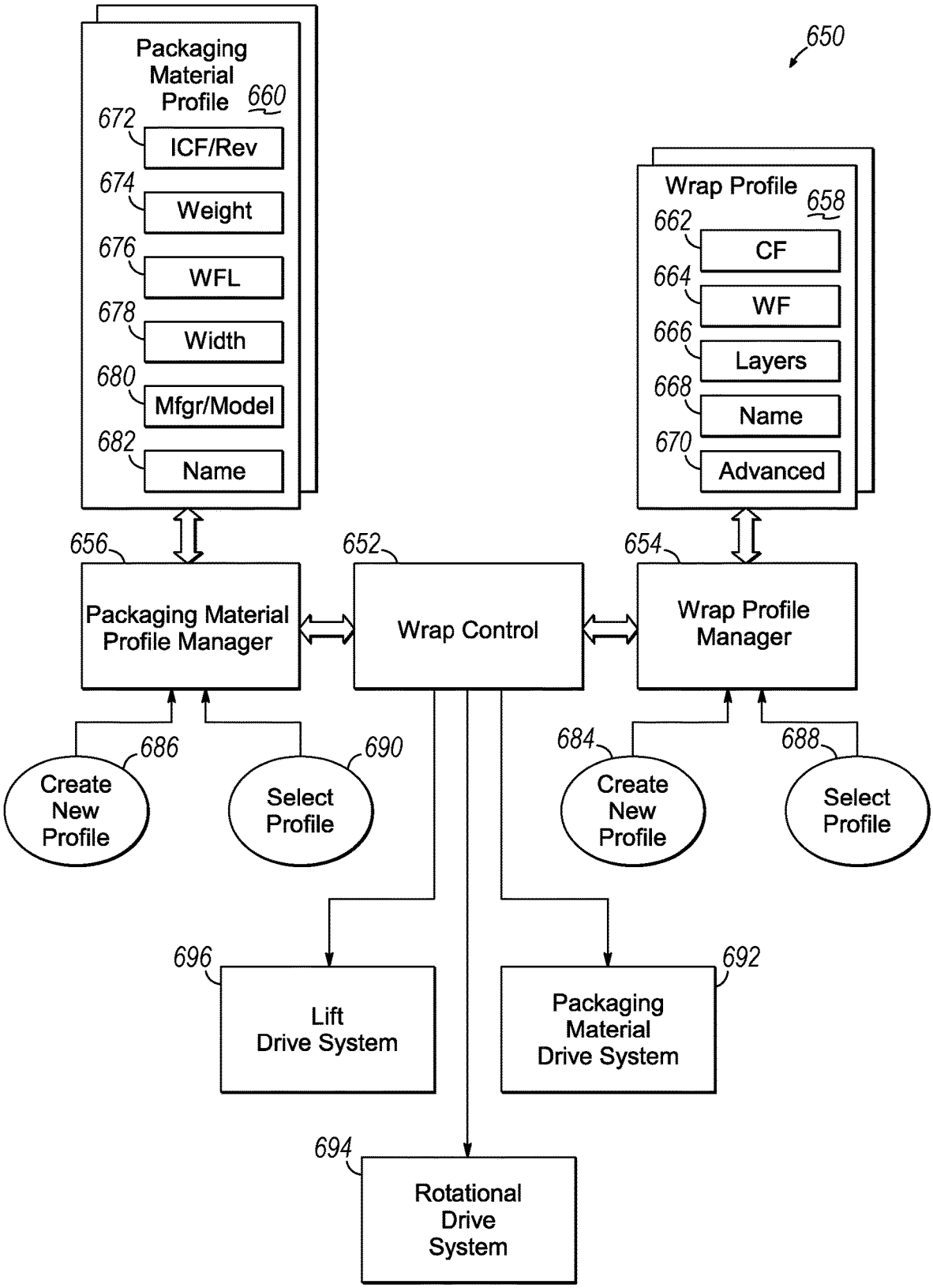
FIG. 8 is a block diagram illustrating an example load containment force-based control system consistent with the invention.

Now turning to FIG. 8, an example control system 650 for a wrapping apparatus implements load containment force-based wrap control through the use of profiles. In particular, a wrap control block 652 is coupled to a wrap profile manager block 654 and a packaging material profile manager block 656, which respectively manage a plurality of wrap profiles 658 and packaging material profiles 660.

Each wrap profile 658 stores a plurality of parameters, including, for example, a containment force parameter 662, a wrap force (or payout percentage) parameter 664, and a layer parameter 666. In addition, each wrap profile 658 may include a name parameter providing a name or other identifier for the profile. The name parameter may identify, for example, a type of load (e.g., a light stable load type, a moderate stable load type, a moderate unstable load type or a heavy unstable load type), or may include any other suitable identifier for a load (e.g., "20 oz bottles", "Acme widgets", etc.).

In addition, a wrap profile may include additional parameters, collectively illustrated as advanced parameters 670, that may be used to specify additional instructions for wrapping a load. Additional parameters may include, for example, an overwrap parameter identifying the amount of overwrap on top of a load, a top parameter specifying an additional number of layers to be applied at the top of the load, a bottom parameter specifying additional number of layers to be applied at the bottom of the load, a pallet payout parameter specifying the payout percentage to be used to wrap a pallet supporting the load, a top wrap first parameter specifying whether to apply top wraps before bottom wraps, a variable load parameter specifying that loads are the same size from top to bottom, a variable layer parameter specifying that loads are not the same size from top to bottom, one or more rotation speed parameters (e.g., one rotation speed parameter specifying a rotational speed prior to a first top wrap and another rotation speed parameter specifying a rotational speed after the first top wrap), a band parameter specifying any additional layers to be applied at a band position, a band position parameter specifying a position of the band from the down limit, a load lift parameter specifying whether to raise the load with a load lift, a short parameter specifying a height to wrap for short loads (e.g., for loads that are shorter than a height sensor), etc.

A packaging material profile 660 may include a number of packaging material-related attributes and/or parameters, including, for example, an incremental containment force/revolution attribute 672 (which may be represented, for example, by a slope attribute and a force attribute at a specified wrap force), a weight attribute 674, a wrap force limit attribute 676, and a width attribute 678. In addition, a packaging material profile may include additional information such as manufacturer and/or model attributes 680, as well as a name attribute 682 that may be used to identify the profile. Other attributes, such as cost or price attributes, roll length attributes, prestretch attributes, or other attributes characterizing the packaging material, may also be included.

Each profile manager 654, 656 supports the selection and management of profiles in response to input data, e.g., as entered by a user or operator of the wrapping apparatus. For example, each profile manager may receive user input 684, 686 to create a new profile, as well as user input 688, 690 to select a previously-created profile. Additional user input, e.g., to modify or delete a profile, duplicate a profile, etc. may also be supported. Furthermore, it will be appreciated that user input may be received in a number of manners consistent with the invention, e.g., via a touchscreen, via hard buttons, via a keyboard, via a graphical user interface, via a text user interface, via a computer or controller coupled to the wrapping apparatus over a wired or wireless network, etc.

In addition, wrap and packaging material profiles may be stored in a database or other suitable storage, and may be created using control system 650, imported from an external system, exported to an external system, retrieved from a storage device, etc. In some instances, for example, packaging material profiles may be provided by packaging material manufacturers or distributors, or by a repository of packaging material profiles, which may be local or remote to the wrapping apparatus. Alternatively, packaging material profiles may be generated via testing, e.g., as disclosed in the aforementioned U.S. Patent Application Publication No. 2012/0102886.

Therefore, it will be appreciated that control of a wrapping apparatus, as well as entry, creation, selection, modification, etc. of the various parameters used to control a load wrapping operation, including containment force, wrap force, layers, packaging material attributes, load attributes, etc., whether or not associated with particular wrap and/or packaging material profiles, may be provided by way of input data. The input data, which is generally used to control a wrapping apparatus, may be supplied by a user or operator, or may be supplied by a database, an internal or external control system, etc., or in other manners that will be apparent to one of ordinary skill in the art having the benefit of the instant disclosure.

A load wrapping operation using control system 650 may be initiated, for example, upon selection of a wrap profile 658 and a packaging material profile 660, and results in initiation of a wrapping operation through control of a packaging material drive system 692, rotational drive system 694, and lift drive system 696.

Furthermore, wrap profile manager 654 includes functionality for automatically calculating one or more parameters in a wrap profile based upon a selected packaging material profile and/or one or more other wrap profile parameters. For example, wrap profile manager 654 may be configured to calculate a layer parameter and/or a wrap force parameter for a wrap profile based upon the load containment force requirement for the wrap profile and the packaging material attributes in a selected packaging material profile. In addition, in response to modification of a wrap profile parameter and/or selection of a different packaging material profile, wrap profile manager 654 may automatically update one or more wrap profile parameters In one embodiment, for example, selection of a different packaging material profile may result in updating of a layer and/or wrap force parameter for a selected wrap profile. In another embodiment, selection of a different wrap force parameter may result in updating of a layer parameter, and vice versa.

As one example, in response to unacceptable increases in film breaks, film quality issues, or mechanical issues such as film clamps or prestretch roller slippage, an operator may reduce wrap force (i.e., increase payout percentage), and functionality in the wrap control system may automatically increase the layer parameter to maintain the overall load containment force requirement for the wrap profile.

Wrap profile manager 654 may also support functionality for comparing different packaging material profiles, e.g., to compare the performance and/or cost of different packaging materials. An operator may therefore be able to determine, for example, that one particular packaging material, which has a lower cost per roll than another packaging material, is actually more expensive due to a need for additional layers to be applied to maintain a sufficient overall containment force. In some embodiments, a packaging material profile may even be automatically selected from among a plurality of packaging material profiles based upon comparative calculations to determine what packaging materials provide the desired performance with the lowest overall cost.

Figure 9:
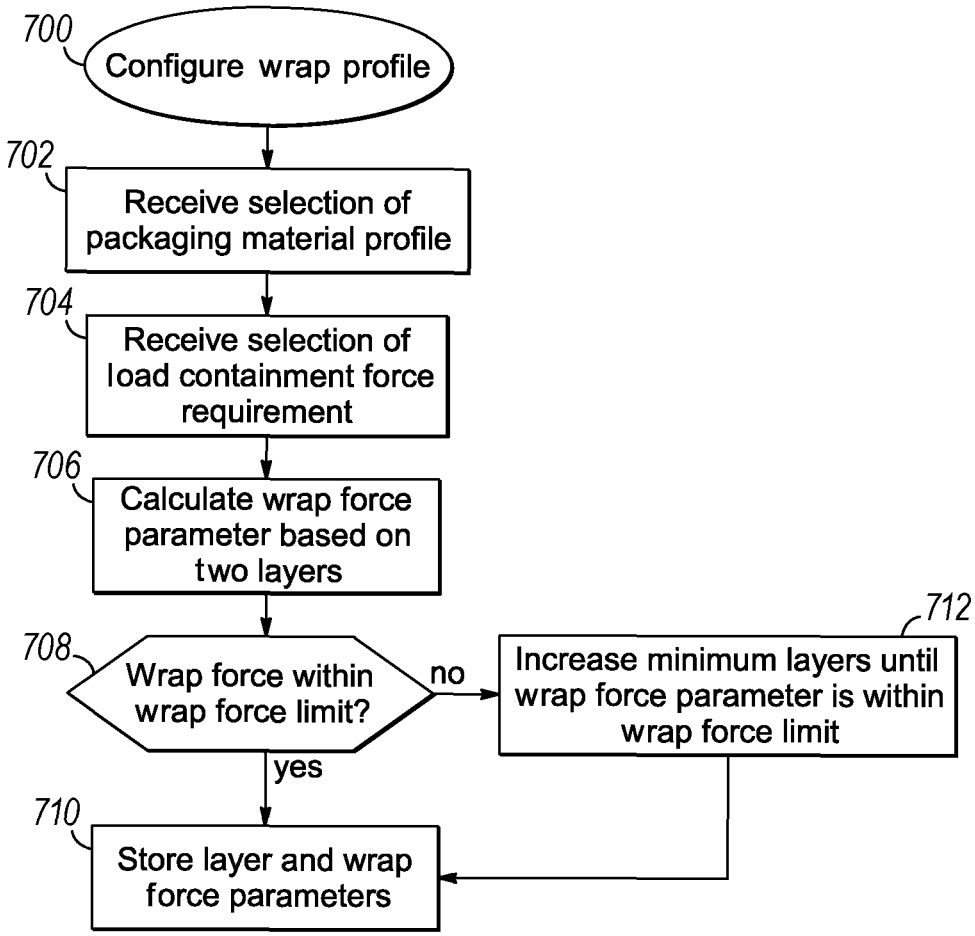
FIG. 9 is a flowchart illustrating a sequence of steps in an example routine for configuring a wrap profile in the control system of FIG. 8.

FIG. 9 illustrates an example routine 700 for configuring a wrap profile using wrap control system 650. Routine 700 begins in block 702 by receiving an operator selection of a packaging material profile. Next, in block 704, an operator selection of a load containment force requirement, e.g., a minimum load containment force, is received.

In some embodiments, a load containment force requirement may be specified based on a numerical force (e.g., in pounds of force). In other embodiments, the requirement may be based on a load attribute, such as a load type and/or various load-related characteristics. In some embodiments, for example, loads may be classified as being light, moderate or heavy, and stable or unstable in nature, and an appropriate load containment force requirement may be calculated based upon the load type or attributes. In still other embodiments, an operator may be provided with recommended ranges of containment forces, e.g., 2-5 lbs for light stable loads, 5-7 lbs for moderate stable loads, 7-12 lbs for moderate unstable loads, and 12-20 lbs for heavy unstable loads, enabling an operator to input a numerical containment force based upon the recommended ranges.

Next, in block 706, a wrap force parameter, e.g., a payout percentage, is calculated assuming an initial layer parameter of a minimum of two layers, and based on an incremental containment force/revolution attribute of the selected packaging material profile. The overall load containment force (CF) is calculated as:

$$CF=ICF*L \tag{10}$$

where ICF is the incremental containment force/revolution of the packaging material and L is the layer parameter, which is initially set to two.

The ICF attribute, as noted above, may be specified based on a containment force at a predetermined wrap force/payout percentage and a slope. Thus, for example, assuming an incremental containment force at 100% payout percentage ($ICF_{100\%}$) and slope (S), the ICF attribute is calculated as:

$$ICF=ICF_{100\%}+S(PP-100\%) \tag{11}$$

where PP is the wrap force or payout percentage.

Based on equations (10) and (11), wrap force, or payout percentage (PP) is calculated from the overall load containment force, the ICF attribute and the layer parameter as follows:

$$PP = 100\% + \frac{\left(\frac{CF}{L} - ICF_{100\%}\right)}{S} \tag{12}$$

Next, block 708 determines whether the payout percentage is within the wrap force limit for the packaging material. If so, control passes to block 710 to store the layer (L) and wrap force (PP) parameters for the wrap profile, and configuration of the wrap profile is complete. Otherwise, block 708 passes control to block 712 to increase the layer (L) parameter until the wrap force (PP) parameter as calculated using equation (12) falls within the wrap force limit for the packaging material. Control then passes to block 710 to store the layer and wrap force parameters. In this way, the overall load containment force requirement is met using the least number of layers, which minimizes costs and cycle time for a wrapping operation.

It will be appreciated that the functionality described above for routine 700 may also be used in connection with modifying a wrap profile, e.g., in response to an operator changing the number of layers, the selected packaging material profile, the desired wrap force and/or the overall load containment force requirement for a wrap profile. In addition, in other embodiments, no preference for using the least number of layers may exist, such that the selection of a layer and/or wrap force parameter may be based on whichever combination of parameters that most closely match the overall load containment force requirement for a load.

Figure 10:
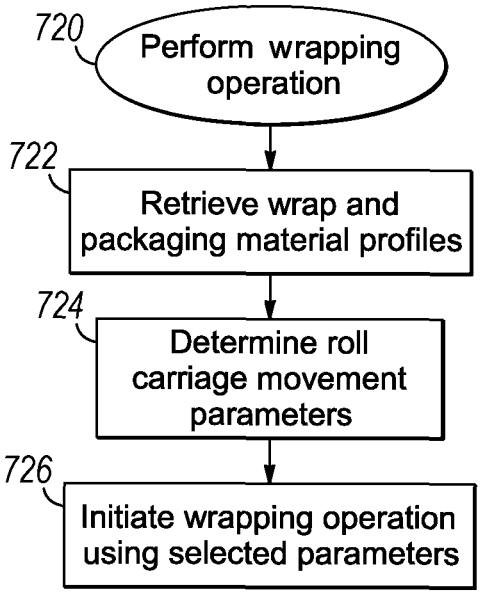
FIG. 10 is a flowchart illustrating a sequence of steps in an example routine for performing a wrapping operation in the control system of FIG. 8.

Once a wrap profile has been selected by an operator, a wrapping operation may be initiated, e.g., using a sequence of steps such as illustrated by routine 720 in FIG. 10. In particular, in block 722 the selected wrap and packaging material profiles are retrieved, and then in block 724, one or more roll carriage parameters are determined. The roll carriage parameters generally control the movement of the roll carriage, and thus, the height where the web of packaging material engages the load during a wrapping operation, such that the selected minimum number of layers of packaging material are applied to the load throughout a desired contiguous region of the load.

For example, in one embodiment, the roll carriage parameters may include a speed or rate of the roll carriage during a wrapping operation, as the number of layers applied by a wrapping operation may be controlled in part by controlling the speed or rate of the roll carriage as it travels between top and bottom positions relative to the rotational speed of the load. The rate may further be controlled based on a desired overlap between successive revolutions or wraps of the packaging material, as the overlap (O) may be used to provide the desired number of layers (L) of a packaging material having a width (W) based on the relationship:

$$O = W - \frac{W}{L} \tag{13}$$

In some instances, however, it may be desirable to utilize multiple up and/or down passes of the roll carriage in a wrapping operation such that only a subset of the desired layers is applied in each pass, and as such, the roll carriage parameters may also include a number of up and/or down passes.

In some embodiments, for example, such as some vertical ring designs, it may be desirable to attempt to apply all layers in a single pass between the top and bottom of a load. In other designs, however, such as designs incorporating bottom mounted clamping devices, it may be desirable to perform a first pass from the bottom to the top of the load and a second pass from the top of the load to the bottom of the load. In one embodiment for the latter type of designs, for example, two layers may be applied by applying the first layer on the first pass using an overlap of 0 inches and applying the second layer on the second pass using an overlap of 0 inches. Three layers may be applied by applying the first and second layers on the first pass using an overlap of 50% of the packaging width and applying the third layer on the second pass using an overlap of 0 inches. Four layers may be applied by applying the first and second layers on the first pass and the third and fourth layers on the second path, all with an overlap of 50% of the packaging material width. Five layers may be applied by applying the first, second and third layers on the first pass with an overlap of 67% of the packaging material width and applying the fourth and fifth layers on the second pass with an overlap of 50% of the packaging material width, etc.

It will be appreciated, however, the calculation of a roll carriage rate to provide the desired overlap and minimum number of layers throughout a contiguous region of the load may vary in other embodiments, and may additionally account for additional passes, as well as additional advanced parameters in a wrap profile, e.g., the provision of bands, additional top and/or bottom layers, pallet wraps, etc. In addition, more relatively complex patterns of movement may be defined for a roll carriage to vary the manner in which packaging material is wrapped around a load in other embodiments of the invention.

Returning to FIG. 10, after determination of the roll carriage parameters, block 726 initiates a wrapping operation using the selected parameters. During the wrapping operation, the movement of the roll carriage is controlled based upon the determined roll carriage parameters, and the wrap force is controlled in the manner discussed above based on the wrap force parameter in the wrap profile. In this embodiment, the load height is determined after the wrapping operation is initiated, e.g., using a sensor coupled to the roll carriage to sense when the top of the load has been detected during the first pass of the roll carriage. Alternatively, the load height may be defined in a wrap profile, may be manually input by an operator, or may be determined prior to initiation of a wrapping operation using a sensor on the wrapping apparatus. In addition, other parameters in the profile or otherwise stored in the wrap control system (e.g., the top and/or bottom positions for roll carriage travel relative to load height, band positions and layers, top and/or bottom layers, etc.), may also be used in the performance of the wrapping operation.

It will be appreciated that in other embodiments, no profiles may be used, whereby control parameters may be based on individual parameters and/or attributes input by an operator. Therefore, the invention does not require the use of profiles in all embodiments. In still other embodiments, an operator may specify one parameter, e.g., a desired number of layers, and a wrap control system may automatically select an appropriate wrap force parameter, packaging material and/or load containment force requirement based upon the desired number of layers.

Figure 11:
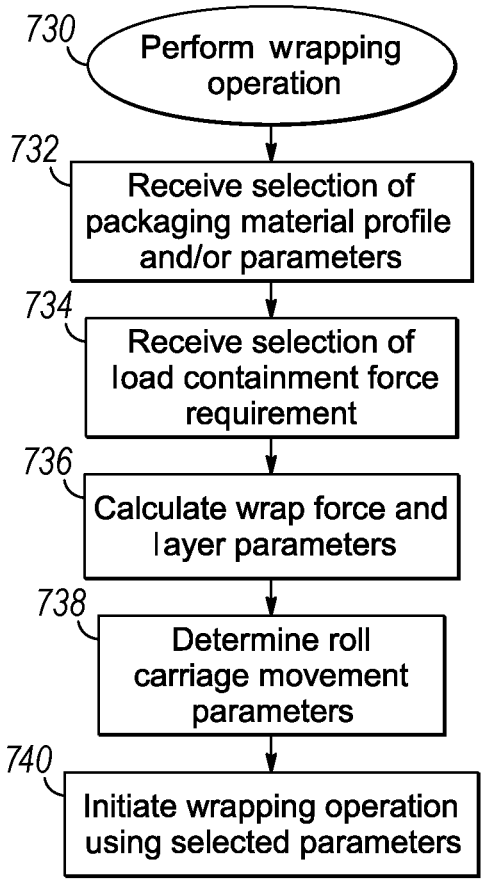
FIG. 11 is a flowchart illustrating a sequence of steps in an example routine for performing another wrapping operation in the control system of FIG. 8, but based upon operator input of a load containment force requirement.

For example, FIG. 11 illustrates an alternate routine 730 in which an operator inputs packaging material parameters either via a packaging material profile or through the manual input of one or more packaging material parameters (block 732), along with the input of a load containment force requirement (block 734). The input of the load containment force requirement may include, for example, selection of a numerical indicator of load containment force (e.g., 10 lbs). Alternatively, the input of the load containment force requirement may include the input of one or more load types, attributes or characteristics (e.g., weight of load, stability of load, a product number or identifier, etc.), with a wrap control system selecting an appropriate load containment force for the type of load indicated.

Then, in block 736, wrap force and layer parameters are determined in the manner disclosed above based on the load containment force requirement and packaging material attributes, and thereafter, roll carriage movement parameters are determined (block 738) and a wrapping operation is initiated to wrap the determined number of layers on the load using the determined wrap force (block 740). As such, an operator is only required to input characteristics of the load and/or an overall load containment force, and based on the packaging material used, suitable control parameters are generated to control the wrapping operation. Thus, the level of expertise required to operate the wrapping apparatus is substantially reduced.

Figure 12:
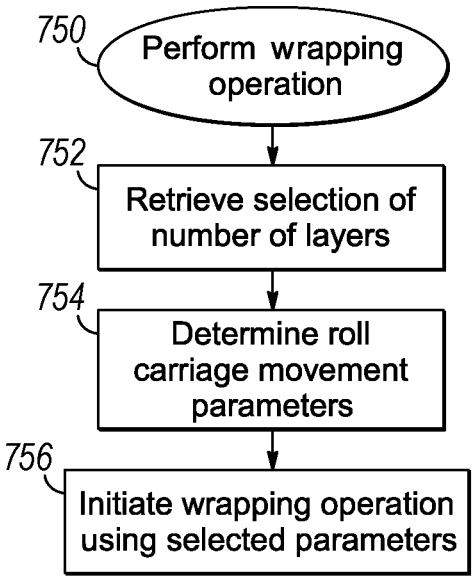
FIG. 12 is a flowchart illustrating a sequence of steps in an example routine for performing another wrapping operation in the control system of FIG. 8, but based upon operator input of a number of layers of packaging material to apply to a load.

As another example, FIG. 12 illustrates a routine 750 that is similar to routine 720 of FIG. 10, but that includes the retrieval of a selection of the number of layers to be applied from an operator in block 752, e.g., via input data that selects a numerical number of layers. Once the number of layers has been selected by an operator, and then based upon the width of the packaging material, and the number of layers defined in the wrap profile, as well as any additional parameters in the profile or otherwise stored in the wrap control system (e.g., the top and/or bottom positions for roll carriage travel relative to load height, band positions and layers, top and/or bottom layers, etc.), one or more roll carriage parameters may be determined in block 754, in a similar manner as that described above in connection with FIG. 10. Then, after determination of the roll carriage parameters, block 756 initiates a wrapping operation using the selected parameters. During the wrapping operation, the movement of the roll carriage is controlled based upon the determined roll carriage parameters. In addition, the wrap force may be controlled in the manner discussed above based on a wrap force parameter. Alternatively, various alternative wrap force controls, e.g., various conventional wrap force controls, may be used, with the operator selection of the number of layers used to control the manner in which the packaging material is wrapped about the load.

Figure 13:
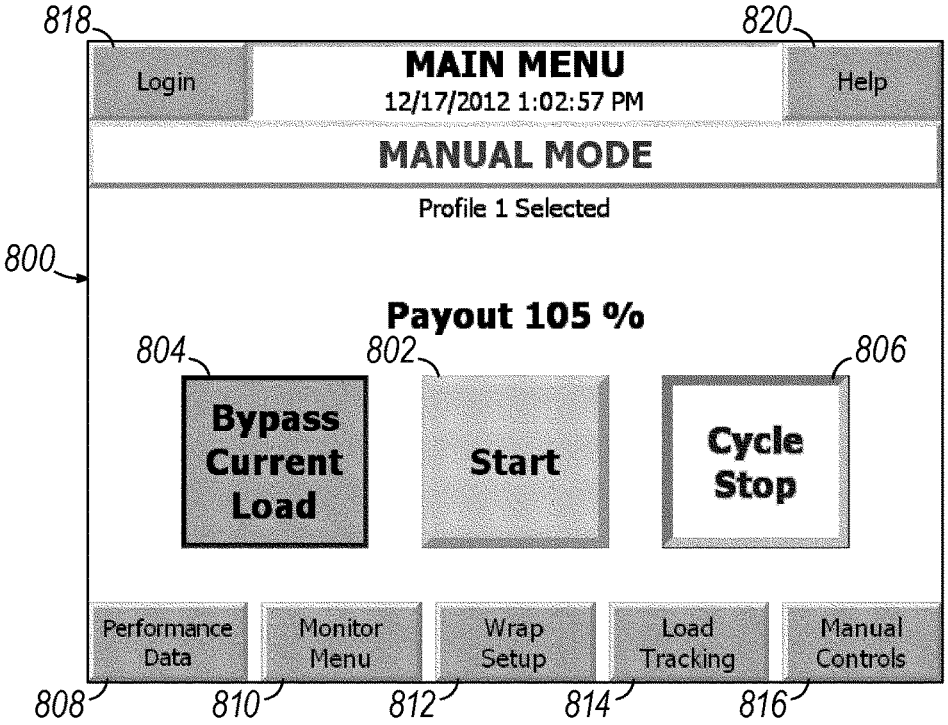
FIGS. 13-23 are block diagrams of example displays capable of being displayed by the control system of FIG. 8 when interacting with an operator.

Now turning to FIGS. 13-21, these figures illustrate a number of example touch screen displays that may be presented to an operator to implement containment force-based wrapping in a manner consistent with the invention. FIG. 13, for example, illustrates an example computer-generated display 800 that may be displayed to an operator during normal operation of a wrapping apparatus. A start button 802 initiates a wrapping operation, while a bypass button 804 bypasses a current load and a stop button 806 stops an active wrapping operation. Various additional buttons, including a performance data button 808 (used to view performance data), a monitor menu button 810 (used to display monitor information), a wrap setup button 812 (used to configure the wrapping apparatus), a load tracking button 814 (used to track loads) and a manual controls button 816 (used to provide manual control over the wrapping apparatus), are also displayed. Furthermore, to restrict access to the wrapping apparatus, a login button 818 may be used to enable an operator to log in to the system, and a help button 820 may be used to provide help information to an operator.

In display 800, it is assumed that wrap and packaging material profiles have been selected, with the name of the current wrap profile ("profile 1") displayed along with the current wrap force selected for the load in the current wrap profile (a payout percentage of 105%). Assuming that an operator wishes to modify the setup of the wrapping apparatus, the operator may select button 812 and be presented with a wrap setup display 830 as shown in FIG. 14.

In wrap setup display 830, the operator is presented with two sets of controls (e.g., list boxes) 832, 834 for respectively selecting packaging material and wrap profiles from among pluralities of stored packaging material and wrap profiles. As such, an operator is able to select from among different packaging material profiles and wrap profiles quickly and efficiently, thereby enabling a wrapping apparatus to be quickly configured to support a particular packaging material and load. In addition, a set of buttons 836-844 may include context-specific operations, such as for film (packaging material) setup button 836 (which enables a packaging material profile to be created or modified), payout calculator button 838 (which calculates the amount of packaging material that will be dispensed for a given load), edit presets button 840 (which enables other machine-related presets to be added, removed or modified), wrap profile copy button 842 (which enables a wrap profile displayed in control 834 to be duplicated), and wrap profile setup button 844 (which enables wrap profiles to be added, removed or modified). A main menu button 846 enables the operator to return to display 800.

Figure 15:
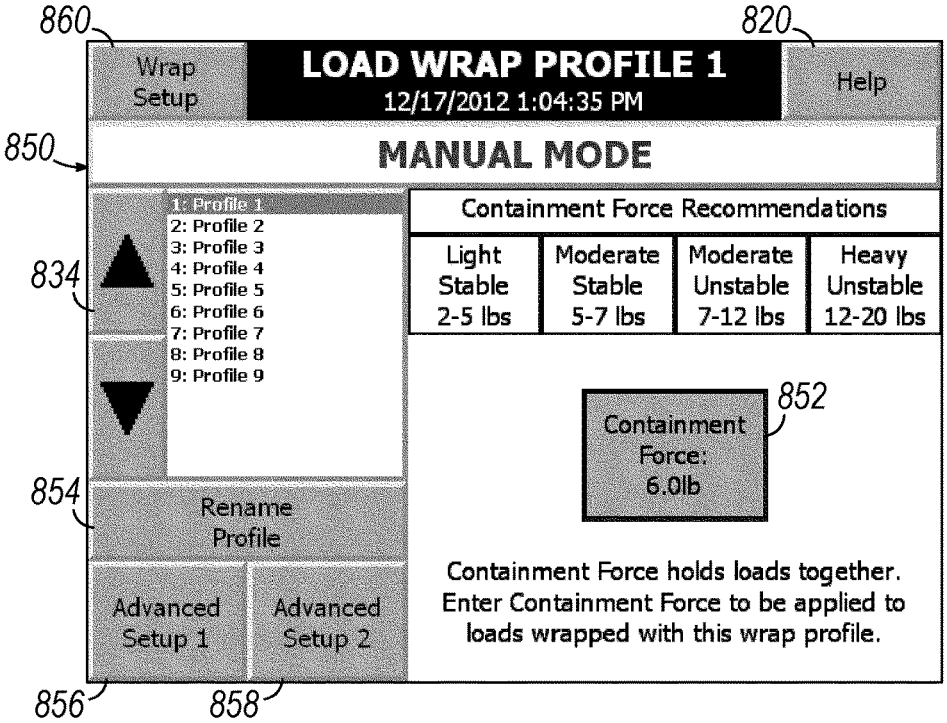

Upon selection of wrap profile setup button 844, for example, a display 850 as illustrated in FIG. 15 may be presented to an operator. In this display, an operator is presented with a button 852 that the operator may actuate to enter a load containment force requirement for a wrap profile selected via control 834. As shown in this figure, the operator may be presented with ranges of suggested containment forces for different types of loads. In addition, an operator may be able to rename a profile (button 854), select advanced options for a profile (buttons 856 and 858), or return to the wrap setup display (button 860).

Figure 14:
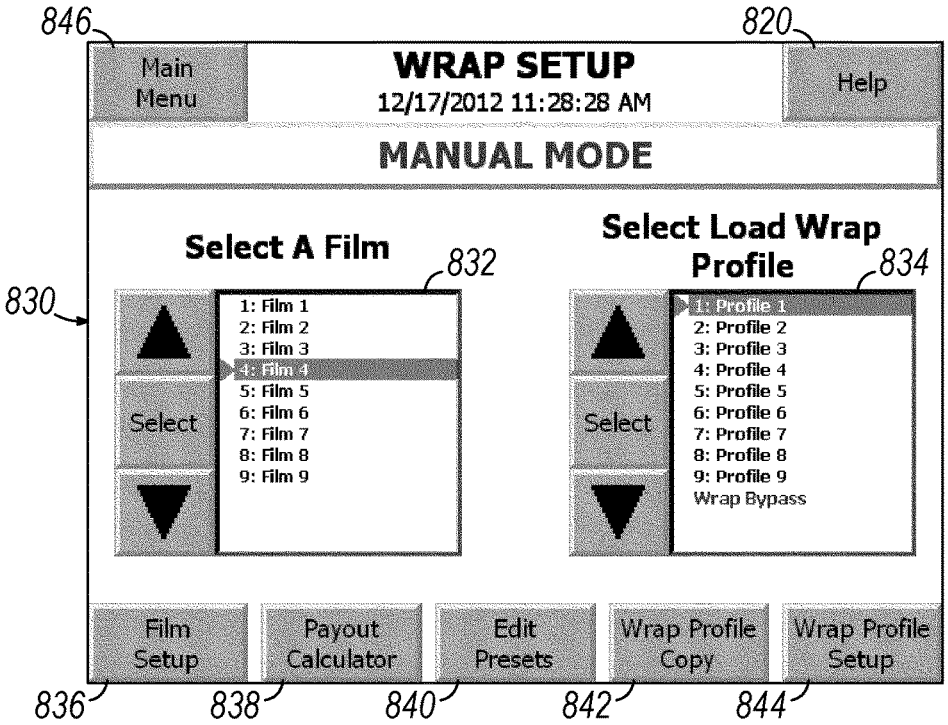
Figure 16:
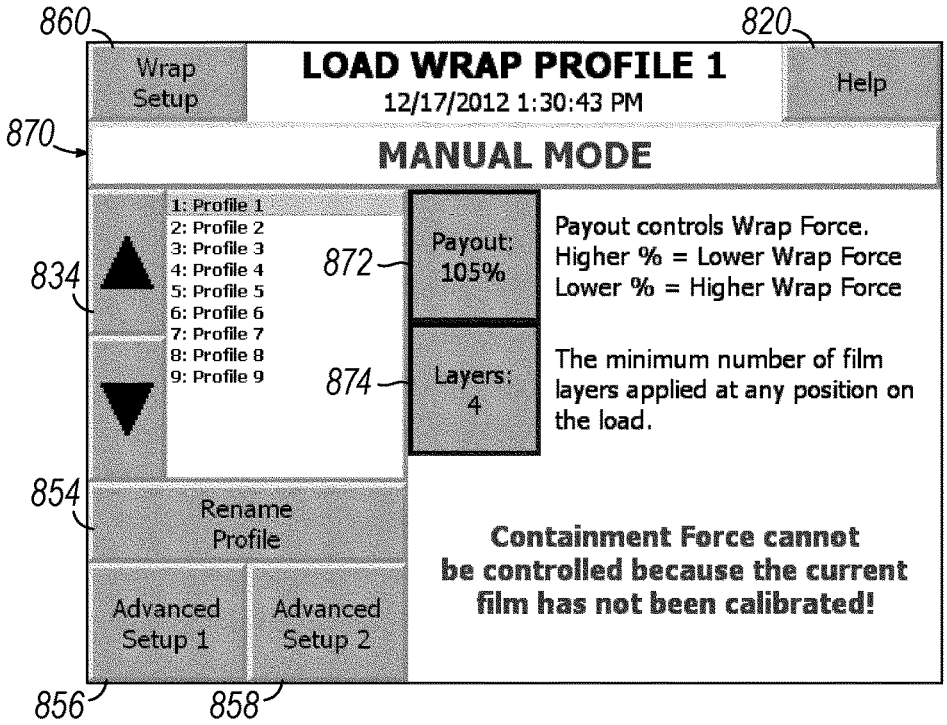
Figure 17:
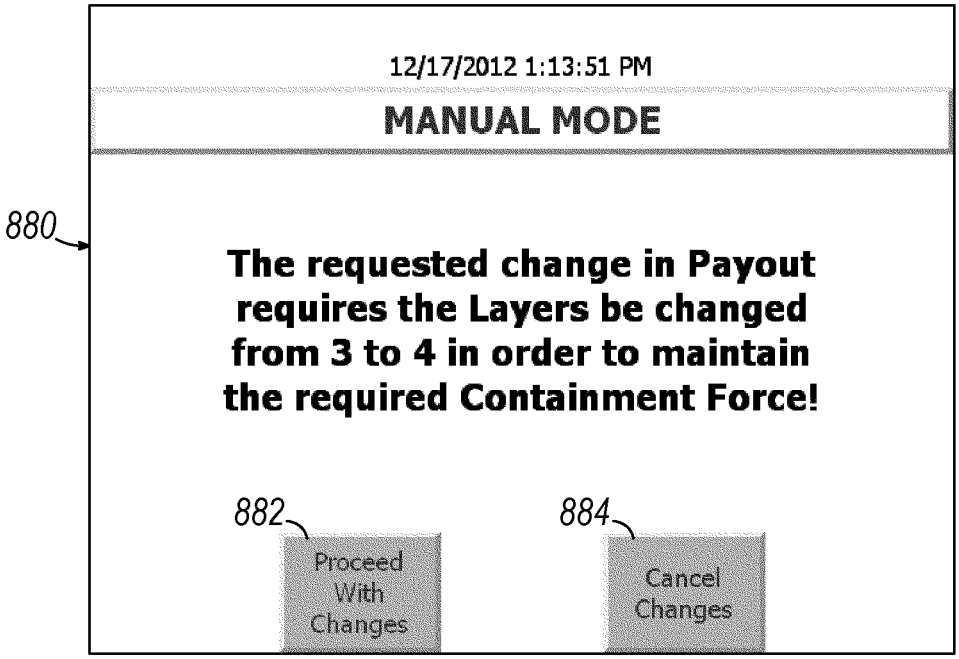
Figure 18:
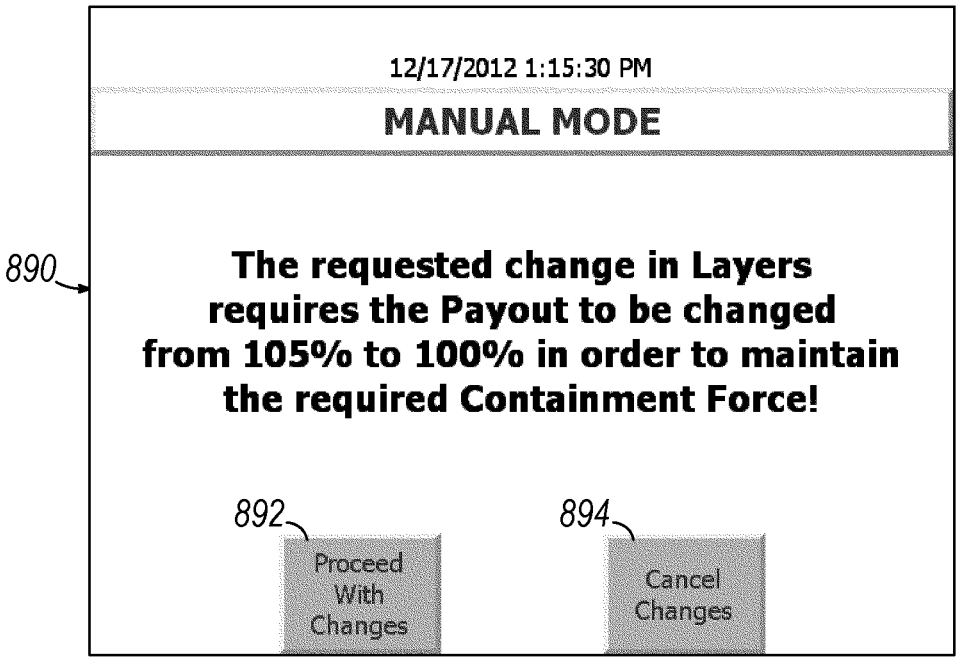

In the illustrated embodiment, if wrap profile setup button 844 of FIG. 14 is selected while no packaging material profile has been selected or no packaging material attributes are otherwise determined, a display 870 as illustrated in FIG. 16 may be presented to the operator instead of display 850. As shown in the lower right corner of this display, it may be desirable in this situation to alert the operator that containment force cannot be controlled until packaging material attributes have been established for the current packaging material. As such, an operator is not presented with a control for entering a load containment force requirement, but is instead presented with a wrap force parameter button 872 and a layer parameter button 874 to enable wrap force and/or layer parameters to be entered manually by the operator.

As shown in both FIG. 15 and FIG. 16, additional options for a wrap profile may be selected via buttons 856, 858. Among these options, as will be discussed below, is modifying a wrap force or layer parameter. Upon modifying one of these parameters, the wrap control system may update the other parameter as necessary to maintain compliance with the desired load containment force requirement. For example, as shown by display 880 of FIG. 17, upon changing a wrap force parameter, the operator may be notified that the change requires the layer parameter to be changed, and allow the operator to either confirm (button 882) or deny (button 884) the change. Likewise, as shown by display 890 of FIG. 18, upon changing a layer parameter, the operator may be notified that the change requires the wrap force parameter to be changed, and allow the operator to either confirm (button 892) or deny (button 894) the change.

Figure 19:
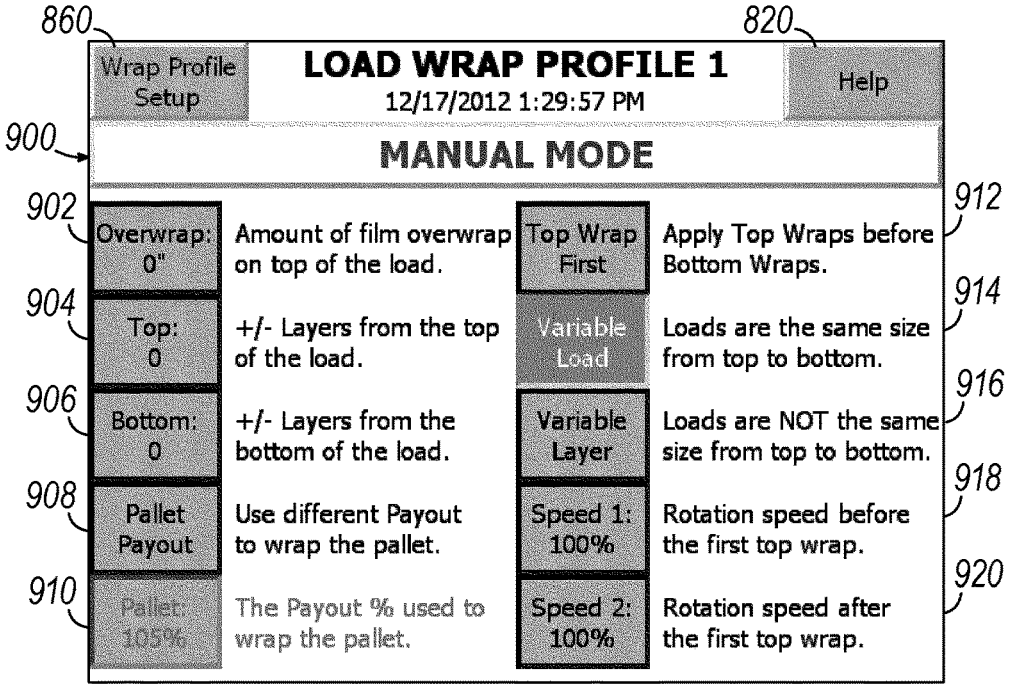

FIG. 19 illustrates a first advanced options display 900 including buttons 902-920 and displayed in response to actuation of button 856 of FIGS. 15 and 16. Button 902 controls the amount of overwrap on the top of the load, button 904 controls the number of additional layers (or fewer layers) to wrap around the top of the load, button 906 controls the number of additional layers (or fewer layers) to wrap around the bottom of the load, button 908 controls whether a different wrap force is used to wrap the pallet supporting the load, and button 910 selects that different wrap force. Button 912 specifies whether the load should be wrapped from the top first, button 914 specifies that loads are the same size from top to bottom, button 916 specifies that loads are not the same size from top to bottom, and buttons 918 and 920 specify the rotation speed (relative to the maximum speed of the wrapping apparatus) respectively before and after the first top wrap.

Figure 20:
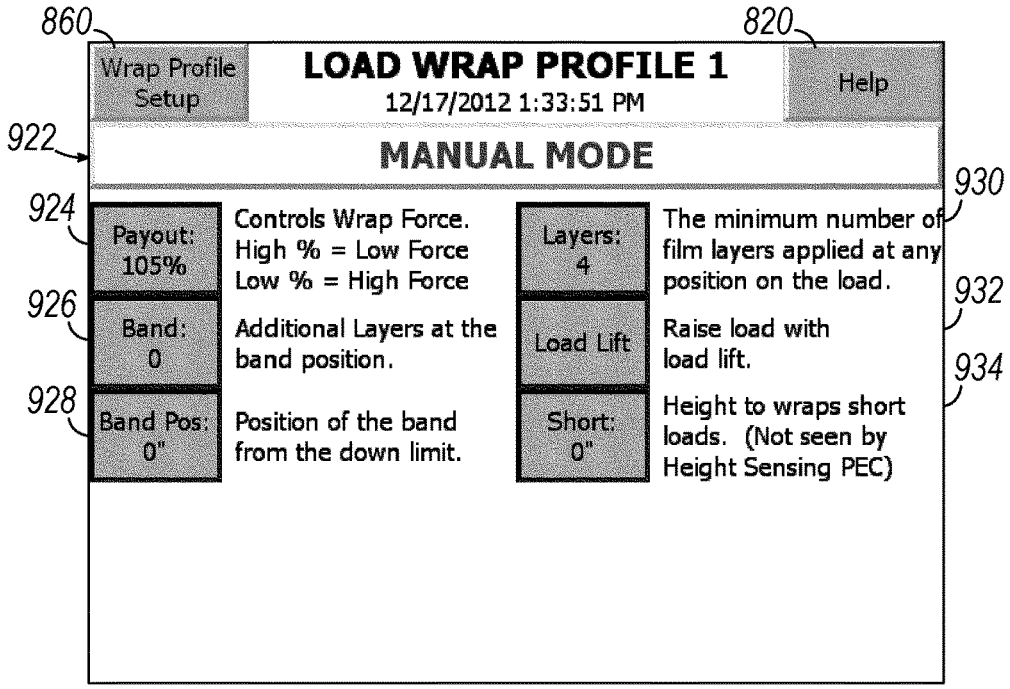

FIG. 20 illustrates a second advanced options display 922 including buttons 924-934 and displayed in response to actuation of button 858. Button 924 enables an operator to modify the wrap force parameter, button 926 specifies a number of additional layers to be wrapped at the band position, and button 928 specifies the band position from the down limit of the wrapping apparatus. Button 930 enables an operator to modify the layer parameter, while button 932 specifies whether to raise the load with a load lift, and button 934 specifies the height at which to wrap short loads (e.g., loads that are too short to be detected by a height sensor).

As noted above, modification of either the wrap force parameter or the layer parameter using buttons 924 and 930 results in the wrap control system recalculating the other parameter and displaying either of displays 880, 890 as necessary to confirm any changes to the other parameter. In addition, in the event that the packaging material profile or attributes have not been selected, it may be desirable to hide buttons 924 and 930 in display 922.

Figure 21:
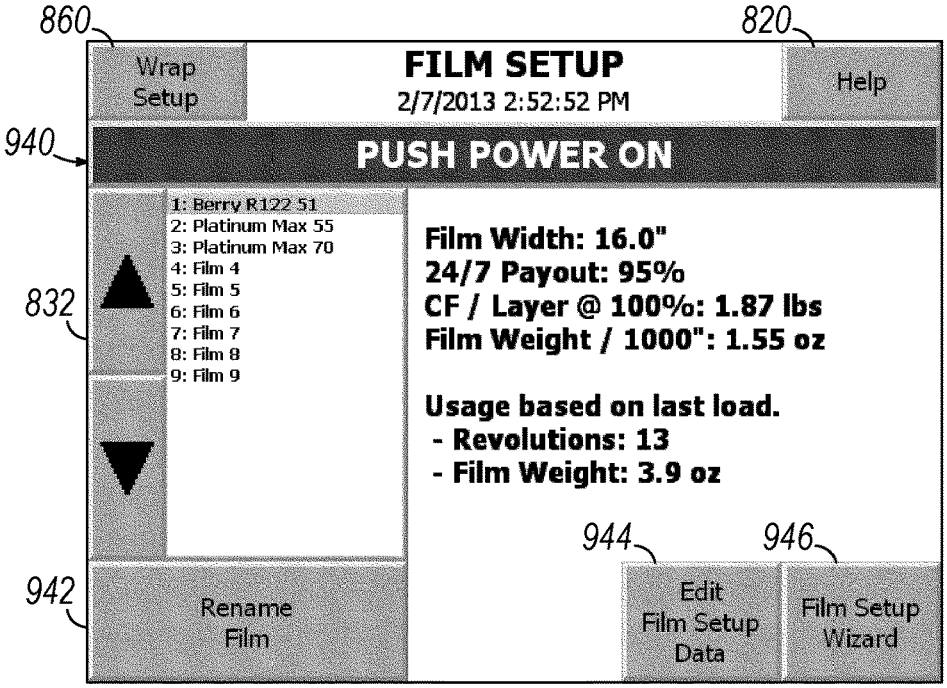

Returning to FIG. 14, viewing, editing and other management of a packaging material profile may be actuated via button 836, resulting in presentation of a display such as display 940 of FIG. 21. In this display, the current packaging material attributes (e.g., width, wrap force limit, incremental containment force/revolution and weight) may be displayed for a packaging material profile selected via control 832, with buttons 942-946 provided to enable an operator to rename the profile (button 942), editing the profile attributes (button 944) or initiate a setup wizard (button 946) to configure the profile based upon a testing protocol (described in greater detail below).

In addition, it may be desirable to present comparative performance data for the packaging material, e.g., based upon the dimensions of the last wrapped load, e.g., the height (as determined from a height sensor) and the girth (as determined from the length of packaging material dispensed in a single revolution of the load). Thus, for the packaging material represented in FIG. 21, and based on the dimensions of the last load, the number of revolutions required to wrap the load, and the total weight of the packaging material applied to the load, may be calculated and displayed. In addition, if the cost of the packaging material is known, a material cost to wrap the load may also be calculated and displayed.

It will be appreciated that additional and/or alternative displays may be used to facilitate operator interaction with a wrapping apparatus, and as such, the invention is not limited to the particular displays illustrated herein.

Among other benefits, the herein described embodiments may simplify operator control of a wrapping apparatus by guiding an operator through set up while requiring only minimum understanding of wrap parameters, and ensuring loads are wrapped with suitable containment force with minimum operator understanding of packaging material or wrap parameters. The herein described embodiments may also reduce load and product damage by maintaining more consistent load wrap quality, as well as enable realistic comparative packaging material evaluations based on critical performance and cost parameters.

Packaging Material Setup

Figure 22:
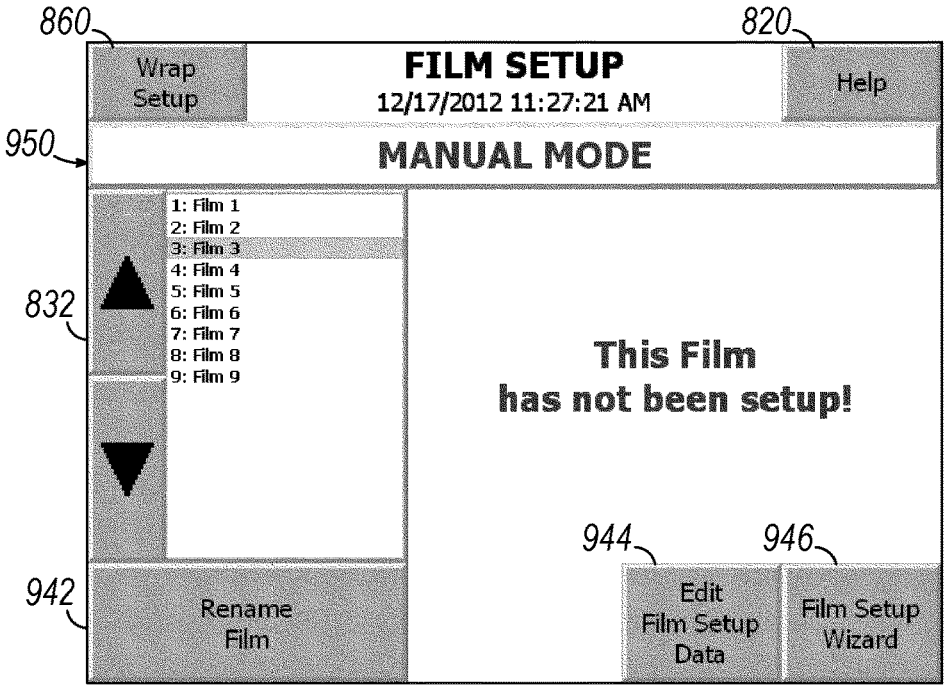

Returning again to FIG. 14, actuation of button 836 when no packaging material profile has been selected, or when a currently-selected packaging material profile has not been setup, results in the presentation of a display 950 of FIG. 22 in lieu of display 940 of FIG. 21. A user is provided with the option in either display 940, 950 of editing or setting up a packaging material profile through the use of manual entry, accessed via button 944, or through the use of a setup wizard, accessed via button 946.

Figure 23:
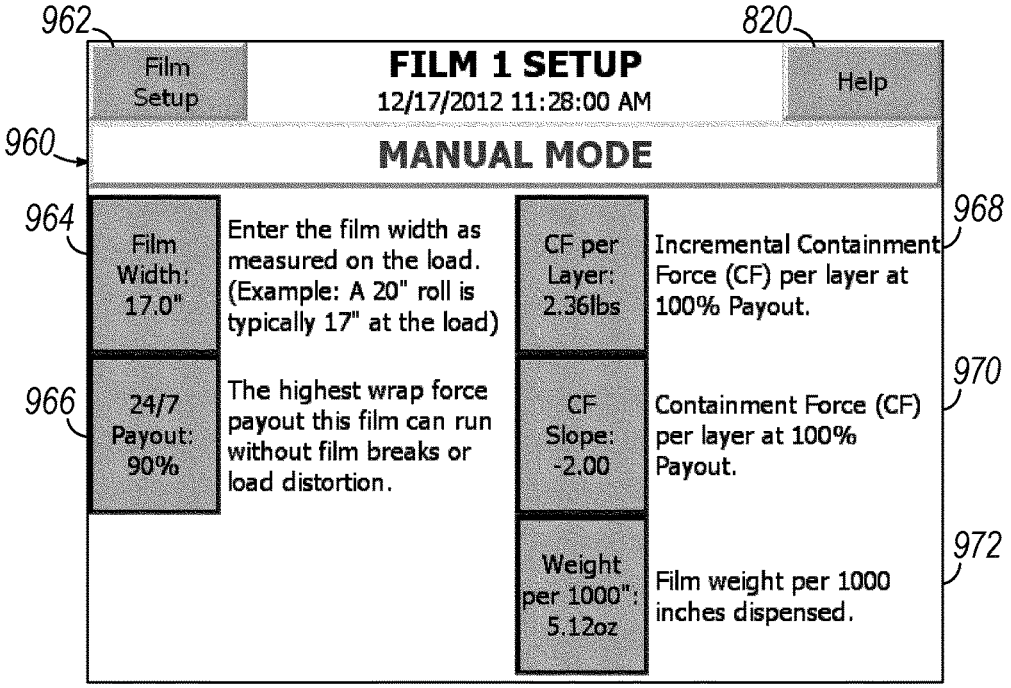

FIG. 23 illustrates an example display 960 for enabling manual editing of a packaging material profile, including a button 962 for returning to display 940, 950. Buttons 964, 966, 968, 970 and 972 respectively display current packaging material attributes including width (button 964), wrap force limit (button 966), incremental containment force/revolution (ICF) at 100% payout (button 968), incremental containment force/revolution (ICF) slope (button 970) and weight per 1000 inches (button 972). Activation of any of these buttons enables an operator to enter or modify the respective attributes.

Figure 24:
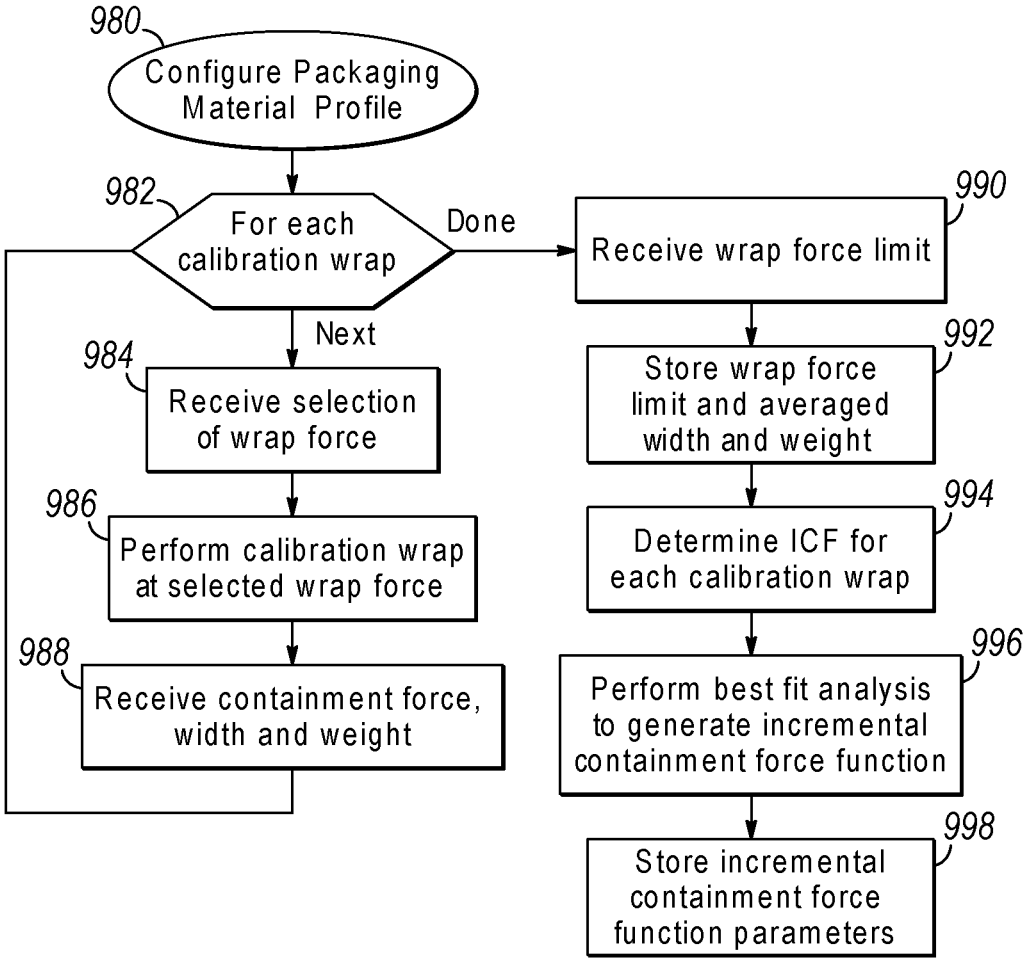
FIG. 24 is a flowchart illustrating a sequence of steps in an example routine for configuring a packaging material profile in the control system of FIG. 8.

As an alternative to manual entry, a setup wizard may be used, the operation of which is illustrated in routine 980 of FIG. 24. With the setup wizard, multiple calibration wraps are performed using the packaging material on a representative load, and at different wrap force settings, which enables incremental containment force/revolution for the packaging material to be mapped over a range of wrap force settings, thereby enabling an ICF function to be generated for the packaging material.

An ICF function may be defined based on as few as two calibration wraps, which may be suitable for generating a linear ICF function based upon two data points. For more complex ICF functions, however, it may be desirable to perform more than two calibration wraps, as additional calibration wraps add additional data points to which an ICF function may be fit. Thus, as shown in block 982, for each calibration wrap, block 984 receives an operator selection of a wrap force to be used for the calibration wrap, e.g., in terms of payout percentage. Next, block 986 performs the calibration wrap at the selected payout percentage, e.g., to apply a complete wrap of a load with a fixed number of layers (e.g., 2 layers) around the load.

After completion of the calibration wrap, an operator measures the containment force (e.g., in the middle of the load along one side). The containment force may be measured, for example, using the containment force measuring device of device of U.S. Pat. No. 7,707,901. In addition, the width of the packaging material at the load is measured, and then the packaging material is cut from the load and weighed. Then, in block 988, the containment force, width and weight are input by the operator, and control returns to block 982 to perform additional calibration wraps using other wrap forces. The operator may be required to select other wrap forces that differ from one another by at least a predetermined amount (e.g., 10%). Alternatively, wrap forces used for calibration may be constant and not input by an operator in some embodiments.

Once all calibration wraps have been performed, block 982 passes control to block 990 to receive a wrap force limit parameter from the operator, i.e., the highest wrap force (or lowest payout percentage) that may be used with this packaging material without excessive breaks or load distortion. This value may be determined from manufacturer specifications, by operator experience, or through testing (e.g., as disclosed in the aforementioned U.S. Patent Application Publication No. 2012/0102886). In addition, the wrap force limit parameter may be modified after calibration based on operator experience, e.g., to lower the wrap force limit if the packaging material is experienced higher than desirable breaks.

Next, block 992 stores the received wrap force limit in the packaging material profile, and stores averaged width and weight attributes received during the calibration wraps in the packaging material profile. Block 994 then determines the ICF value or attribute for each calibration wrap, e.g., by dividing the containment force measured for each calibration wrap by the known number of layers applied to the load during each calibration wrap. Next, in block 996, best fit analysis is performed to generate the ICF function for the packaging material. As noted above, the ICF function may be linear, and based on an ICF value at a predetermined wrap force (e.g., 100% payout) and a slope. Alternatively, a more complex ICF function may be defined, e.g., based on an s-curve, interpolation, piecewise linear, exponential, multi-order polynomial, logarithmic, moving average, power, or other regression or curve fitting technique.

Then, in block 998, the ICF parameters defining the ICF function are stored in the packaging material profile. Setup of the packaging material profile is then complete.

In other embodiments, the width of the packaging material may also be defined by a function similar to the ICF attribute. It has been found that the width of packaging material at a load typically decreases with higher wrap force, and as such, the width of the packaging material may be defined as a function of the wrap force, rather than as a static value. As such, rather than simply averaging widths measured during different calibration wraps, best fit analysis may be used to generate a width function for the packaging material, and the resulting function may be stored in a packaging material profile. The function may be linear or may be a more complex function, e.g., any of the different types of functions discussed above in connection with the ICF function.

Figure 25:
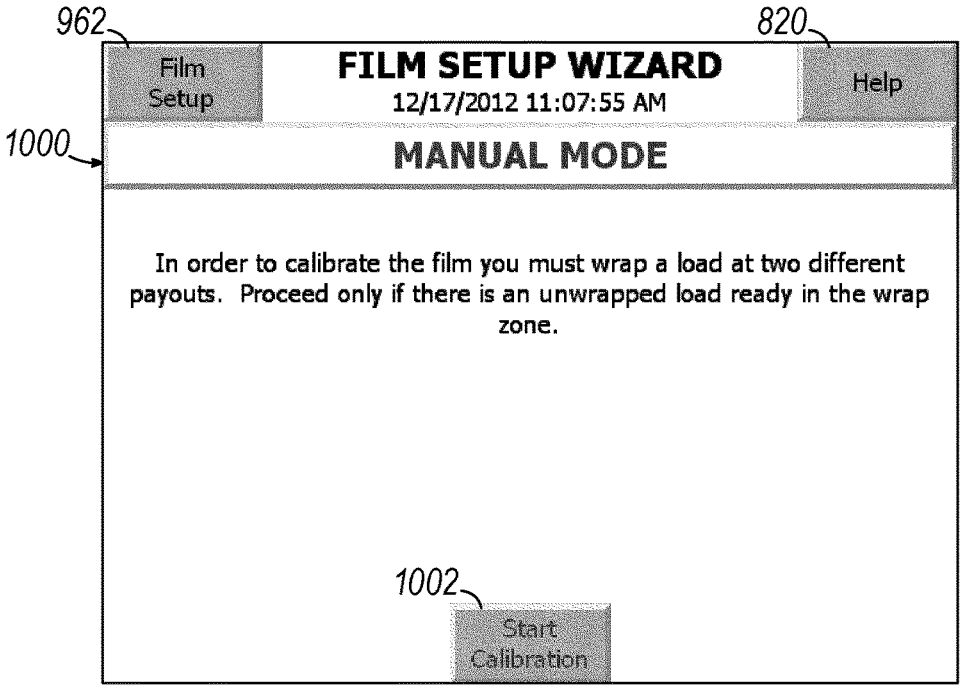
FIGS. 25-33 are block diagrams of additional example displays capable of being displayed by the control system of FIG. 8 when interacting with an operator.
Figure 26:
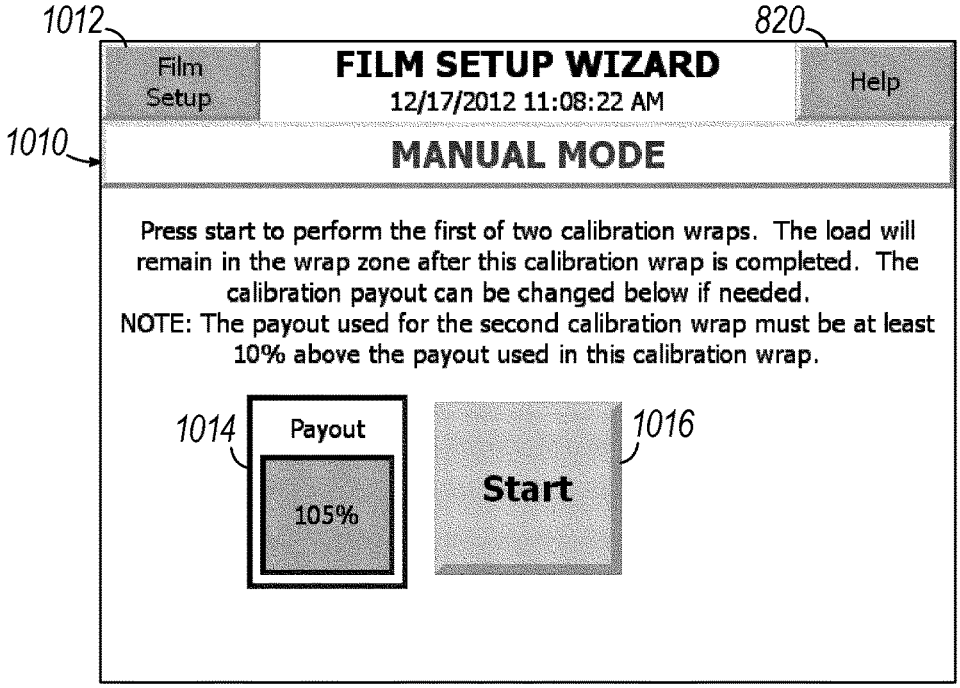

FIGS. 25-33 illustrate a series of displays that may be displayed to an operator in connection with utilizing routine 980. FIG. 25, for example, illustrates a display 1000 presented after an operator selects button 946 of FIG. 21 or FIG. 22, which displays a start button 1002 that may be used to initiate a profile setup. In this example setup, two calibration wraps are performed, so upon activation of button 1002, display 1010 of FIG. 26 is presented to the operator, providing instructions for performing the first calibration wrap, and providing a button 1012 to return to setup display 940 or 950 of FIGS. 21-22, a button 1014 in which a wrap force may be selected, and a start button 1016 that initiates a calibration wrap operation.

Figure 27:
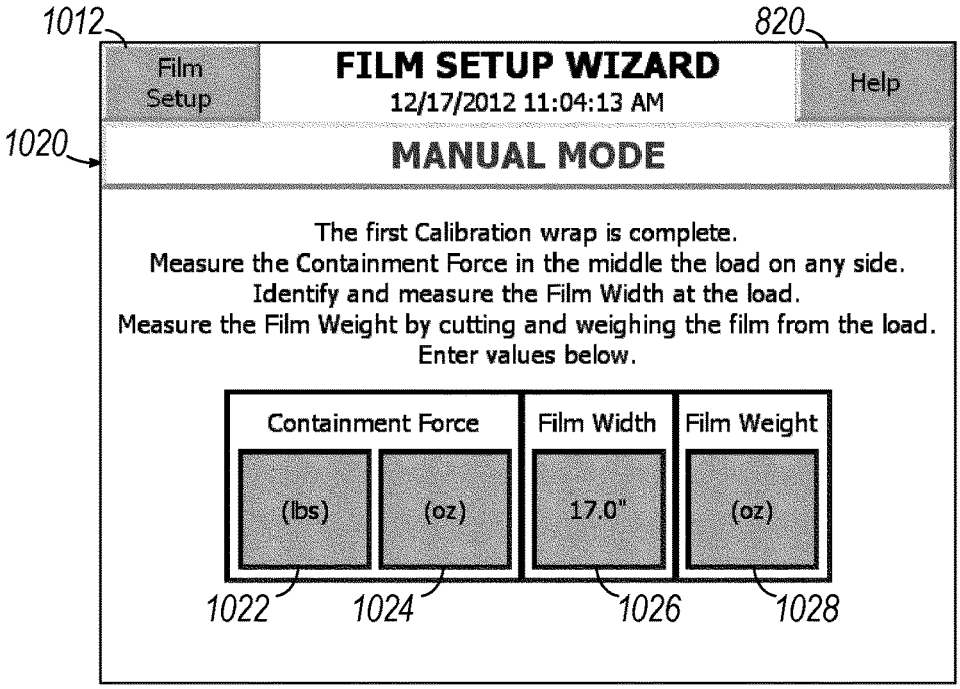
Figure 28:
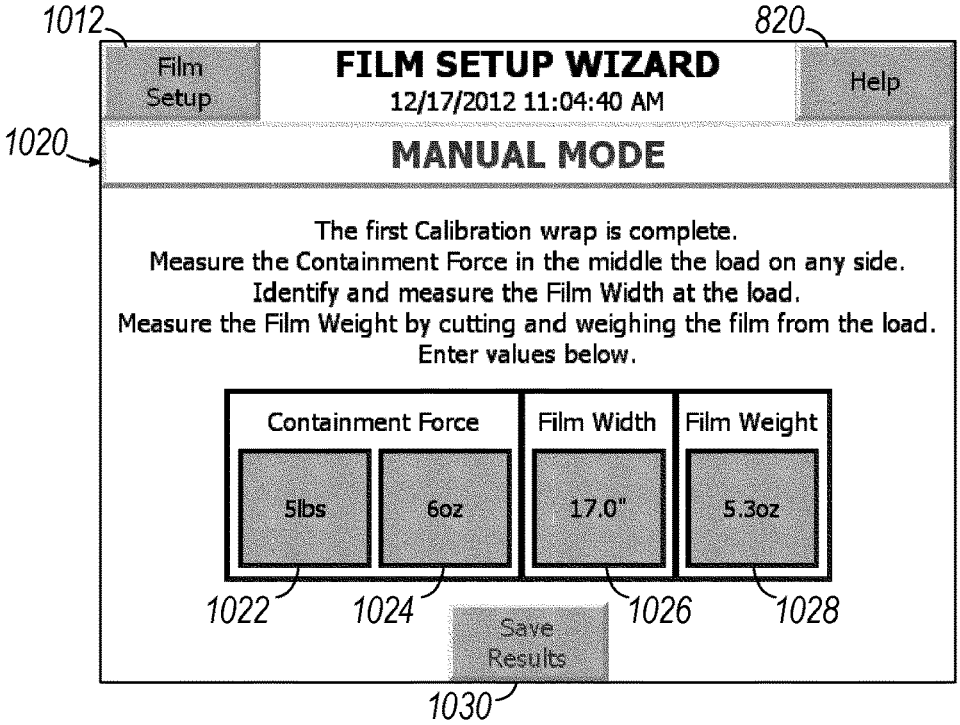

Upon actuation of button 1016, a wrap operation is performed, and upon completion, display 1020 of FIG. 27 is presented to the operator. The operator is instructed to measure the containment force in the middle of the load on any side, and enter the measured force in pounds and ounces using buttons 1022, 1024. The operator is also instructed to measure the width of the packaging material on the load and enter the measured width using button 1026, and then cut and weigh the packaging material applied during the calibration wrap operation and enter the measured weight using button 1028. As shown in FIG. 28, upon entering the measured parameters using buttons 1022-1028, a save results button 1030 is displayed to permit the entered parameters to be stored.

Figure 29:
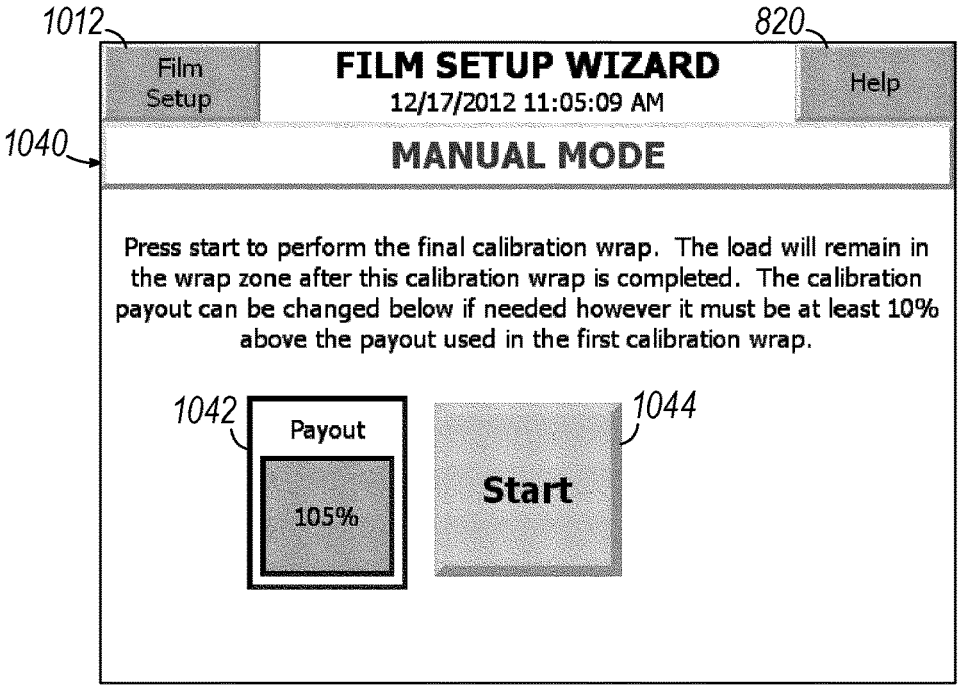

In addition, upon actuation of button 1030, display 1040 of FIG. 29 is presented to the operator, providing instructions for performing the second and final calibration wrap, and providing a button 1042 in which a wrap force may be selected, and a start button 1044 that initiates a calibration wrap operation. The wrap force for the second calibration wrap is desirably at least 10% below that used for the first calibration wrap.

Figure 30:
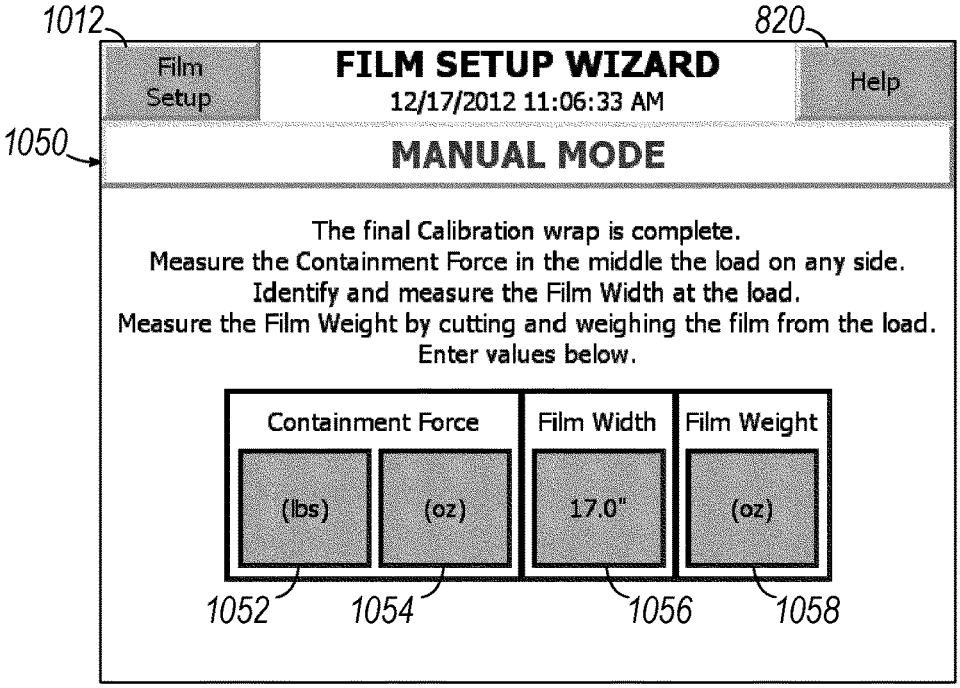
Figure 31:
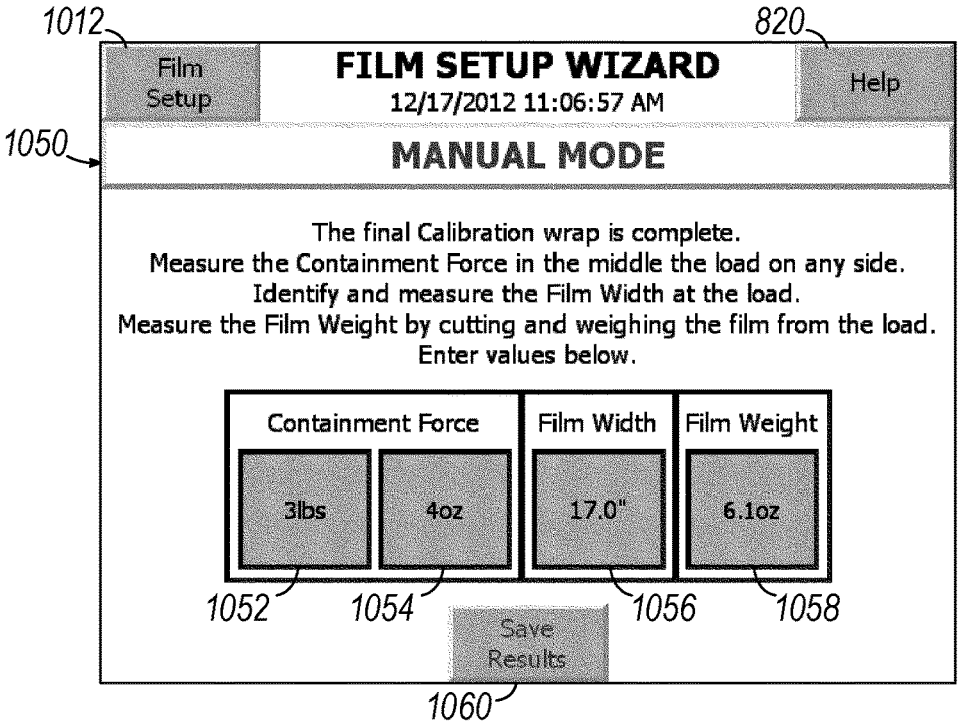

Upon actuation of button 1044, a wrap operation is performed, and upon completion, display 1050 of FIG. 30 is presented to the operator. The operator is instructed to measure the containment force in the middle of the load on any side, and enter the measured force in pounds and ounces using buttons 1052, 1054. The operator is also instructed to measure the width of the packaging material on the load and enter the measured width using button 1056, and then cut and weigh the packaging material applied during the calibration wrap operation and enter the measured weight using button 1058. As shown in FIG. 31, upon entering the measured parameters using buttons 1052-1058, a save results button 1060 is displayed to permit the entered parameters to be stored.

Figure 32:
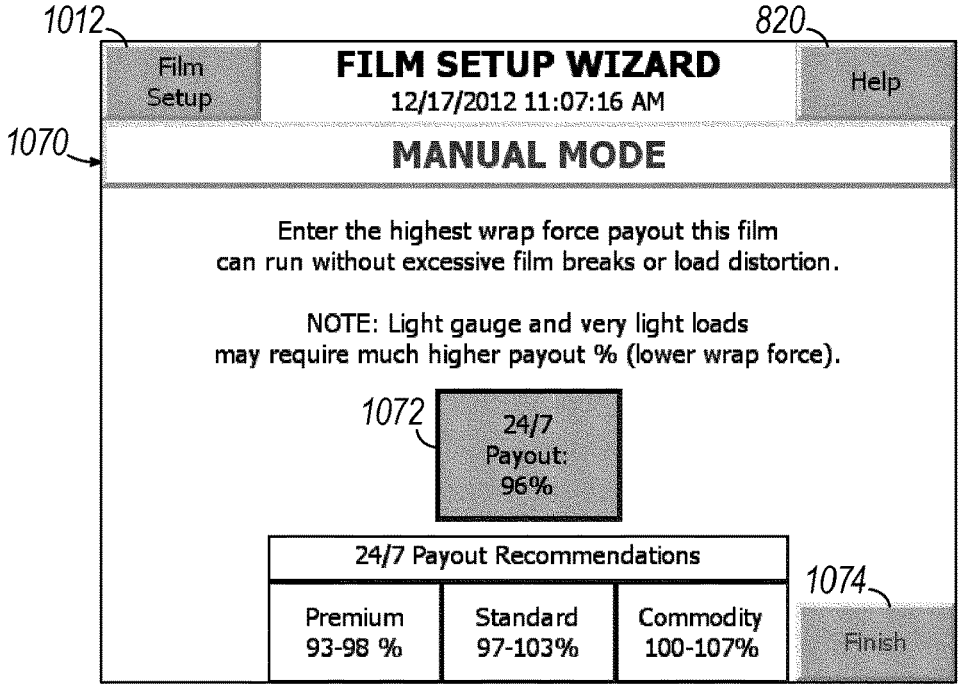

In addition, upon actuation of button 1060, display 1070 of FIG. 32 is presented to the operator, providing a button 1072 for entering a wrap force limit (24/7 payout %), representing the highest wrap force that the packaging material can be wrapped with without excessive breaks or load distortion. Recommended limits (e.g., 93-98% for premium materials, 97-103% for standard materials and 100-107% for commodity materials) may also be displayed. A finish button 1074 when actuated stores the attributes in the packaging material profile, completing the setup.

Figure 33:
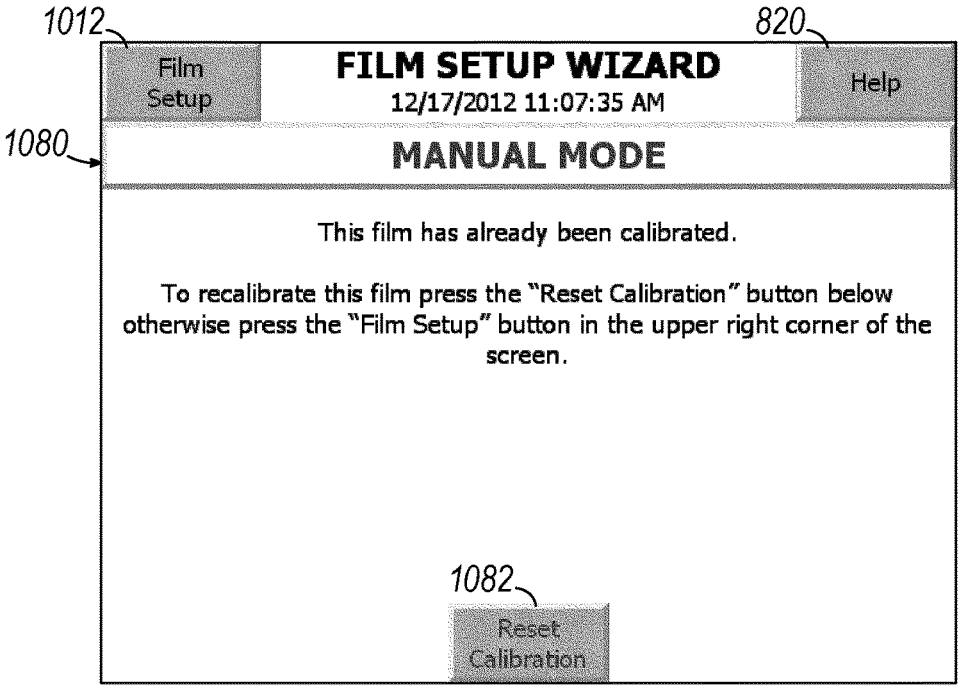

FIG. 33 illustrates an alternative display 1080 that may be presented to an operator when button 946 (FIGS. 21 and 22) is actuated and a packaging material profile has already been set up. An operator is therefore required to actuate a reset button 1082 to perform a recalibration of the packaging material profile.

It will be appreciated that after a packaging material profile has been setup, the packaging material can be compared against other packaging materials to enable an operator to choose a packaging material that best fits a particular load or application. As noted above, whenever a packaging material profile is set up, comparative performance parameters may be displayed for the profile in the setup display 940 of FIG. 21. The performance parameters, such as number of revolutions to wrap a load or the total weight of packaging material used to wrap the load, may be calculated based upon the dimensions of the last load wrapped, by effectively simulating the wrapping of the last load based on the load containment force requirement, the dimensions of the load, and the packaging material attributes in the packaging material profile. In addition, if the speed of revolution of the wrapping apparatus (e.g., in RPM) is known, the speed or cycle time may be calculated from the number of revolutions, and if the cost of the packaging material is known (e.g., per roll of x inches or y pounds), the overall cost to wrap the load may be calculated from the weight or amount of the packaging material dispensed to wrap the load.

As noted above, the comparative performance of different packaging materials may be based upon a last wrapped load. Alternatively, an operator may be permitted to enter or measure the dimensions of a load for which comparative performance may be desired (or if the load dimensions are stored in a wrap profile, those dimensions may be used) and have the comparative performance displayed for each packaging material profile with the selected load as shown in FIG. 21. It will be appreciated that by actuating control 832 to select different packaging material profiles, the comparative performance parameters may be displayed to enable an operator see how each packaging material would perform for a given load.

In addition, in some embodiments, it may be desirable to present comparative performance displays that show how all or a subset of packaging materials would perform. Graphs, charts, etc. may also be displayed to facilitate quick recognition of the comparative performance of each material.

Figure 34:
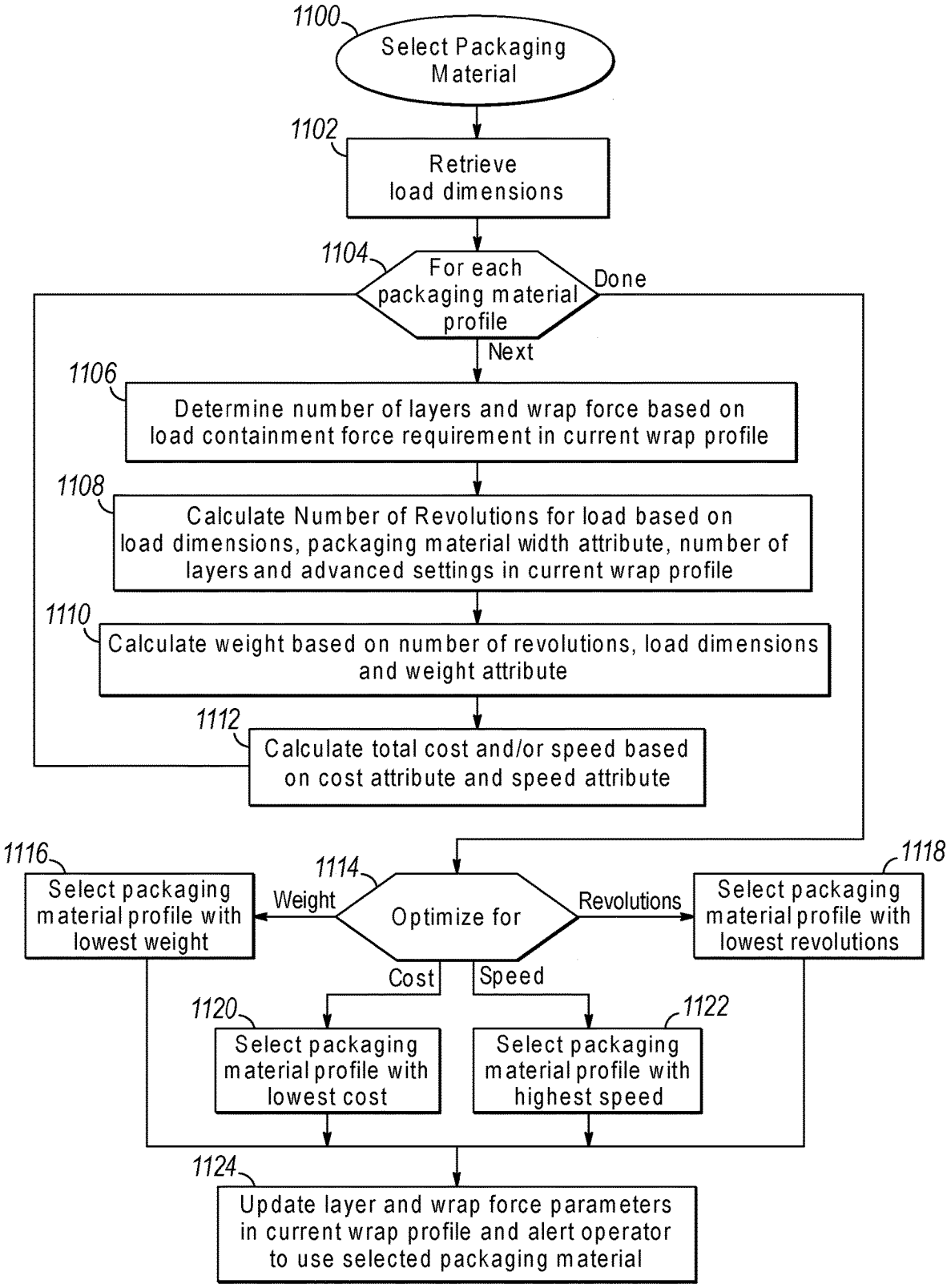
FIG. 34 is a flowchart illustrating a sequence of steps in an example routine for selecting a packaging material in the control system of FIG. 8.

In still other embodiments, it may be desirable for a control system to automatically select an optimal packaging material for a given load or application, e.g., for a representative load having particular dimensions. FIG. 34, for example, illustrates a routine 1100 that may be used to automatically select an optimal packaging material profile. Starting in block 1102, the dimensions of the representative load are retrieved, based, for example, on the last wrapped load, operator input, or dimensions stored in a currently-selected wrap profile. Next, block 1104 initiates a FOR loop to process each packaging material profile to effectively simulate a wrap operation of the representative load using the associated packaging material. For each such profile, block 1106 determines the number of layers and the wrap force required to meet the load containment force requirement of a currently-selected wrap profile based upon that packaging material profile, e.g., in the manner discussed above in connection with FIG. 9. Alternatively, a load containment force requirement may be entered separately by the operator, e.g., for testing various what-if scenarios.

Next, block 1108 calculates the number of revolutions required to wrap the load based on the load dimensions, the packaging material width attribute, and the minimum number of layers to be applied. In addition, if any advanced settings are stored in the wrap profile, e.g., additional top, bottom or band layers, the number of revolutions may be modified accordingly.

For example, in one example embodiment, a revolution count (R) may be calculated as the sum total of the following values:

Revolutions at the bottom (RB)
Revolutions on the way up (RU)
Revolutions at the top (RT)
Revolutions on the way down (RD)
Revolutions to decelerate and home (RH)

In some embodiments, RB may be equal to the number of layers (L) to be applied to the load. However, in other embodiments, due to the coverage provided from overlap and the revolutions it takes to decelerate and home, RB may be set as follows:

$$RB=L-2 \tag{14}$$

An exception may also be defined such that if L=2, RB is set to 1.

To calculate RU, the number of layers to apply on the way up (LU) is first calculated as ROUND(L/2). By rounding the result of L/2, the odd layer will be applied on the way up in this embodiment. Next, an Overlap Up (OU) value may be calculated based on the width (W) of the packaging material as follows:

$$OU=W-(W/LU) \tag{15}$$

An exception may also be defined such that if OU=0, OU is set at a nominal value such as 1" of overlap to ensure there are no coverage gaps on the load. Next, RU is calculated based on the height (H) of the load and the width (W) of the packaging material as follows:

$$RU=(H-W)/(W-OU) \tag{16}$$

In some embodiments, RT may be equal to the number of layers (L) to be applied to the load. However, in other embodiments, due to the coverage provided from overlap, RT may be set as follows:

$$RT=L-1 \tag{17}$$

An exception may also be defined such that if L=2, RT is set to 2.

To calculate RD, the number of layers to apply on the way down (LD) is first calculated as TRUNC(L/2). The result of L/2 is truncated since any odd layer is applied on the way up. Next, an Overlap Down (OD) value may be calculated based on the width (W) of the packaging material as follows:

$$OD=W-(W/LD) \tag{18}$$

An exception may also be defined such that if OD=0, OD is set at a nominal value such as 1" of overlap to ensure there are no coverage gaps on the load. Next, RD is calculated based on the height (H) of the load and the width (W) of the packaging material as follows:

$$RD=(H-W)/(W-OD) \tag{19}$$

RH is typically set to 1, as one revolution is typically required to decelerate and home the rotation in preparation to cut/clamp the packaging material at the completion of a wrap operation. As such, the revolution count (R) is defined as follows:

$$R=RB+RU+RT+RD+RH \tag{20}$$

R will typically be a fractional number that must be rounded. In some embodiments, R may be rounded up. However, other embodiments, e.g., in embodiments where a wrapping apparatus is allowed to decelerate and home before it has completely reached the bottom (i.e., RH<1), R may be rounded down.

Next, block 1110 calculates the total weight based upon the number of revolutions, the load dimensions, and the weight attribute for the packaging material, e.g., using the equation:

$$WT_T = \frac{R \times G}{1000} \times WT \tag{21}$$

where $WT_T$ is the total weight, R is the number of revolutions, G is the girth (2×(width+depth)) in inches and WT is the weight attribute in ounces per 1000 inches.

Next, block 1112 optionally calculates total cost and/or speed/cycle time from the number of revolutions and the total weight based on any cost and/or speed parameters stored in the wrap profile, e.g., to calculate a total material cost to wrap a load or a cycle time in seconds to wrap a load. Control then returns to block 1104 to process other packaging material profiles.

Once all packaging material profiles have been processed, block 1104 passes control to block 1114 to select an optimal packaging material profile based upon various performance parameters, e.g., as may be selected by an operator. For example, if material usage is of paramount concern, block 1114 may pass control to block 1116 to select the packaging material profile with the lowest total weight. Alternatively, if cycle time is of paramount concern, block 1114 may pass control to block 1118 to select the packaging material profile with the lowest number of revolutions. In addition, if cost and/or speed parameters are available in the wrap profile and it is desirable to optimize for either of these parameters, block 1114 may pass control to block 1120 or block 1122 to select the packaging material profile having the lowest cost or highest speed/shortest cycle time.

Once an optimal packaging material profile is selected in any of blocks 1116-1122, control passes to block 1124 to update the layer and wrap force parameters in the current wrap profile, and alert the operator to install the packaging material corresponding to the selected packaging material profile. Routine 1100 is then complete. It will be appreciated that in some embodiments, the optimal packaging material may be based on a combination of any or all of weight, number of revolutions, cost and speed, e.g., to select a packaging material that provides a desirable balance of multiple performance parameters.

In other embodiments, packaging material profiles may be generated by a third party, such as a packaging material manufacturer, other packaging material customers, etc., and retrieved from a remote source, such as a web site or external database, or alternatively loaded from a memory storage device such as a flash drive, memory card or optical disk. As such, operators may be permitted to compare different types and brands of packaging material to determine optimal packaging material to use for particular loads or applications.

Figure 35:
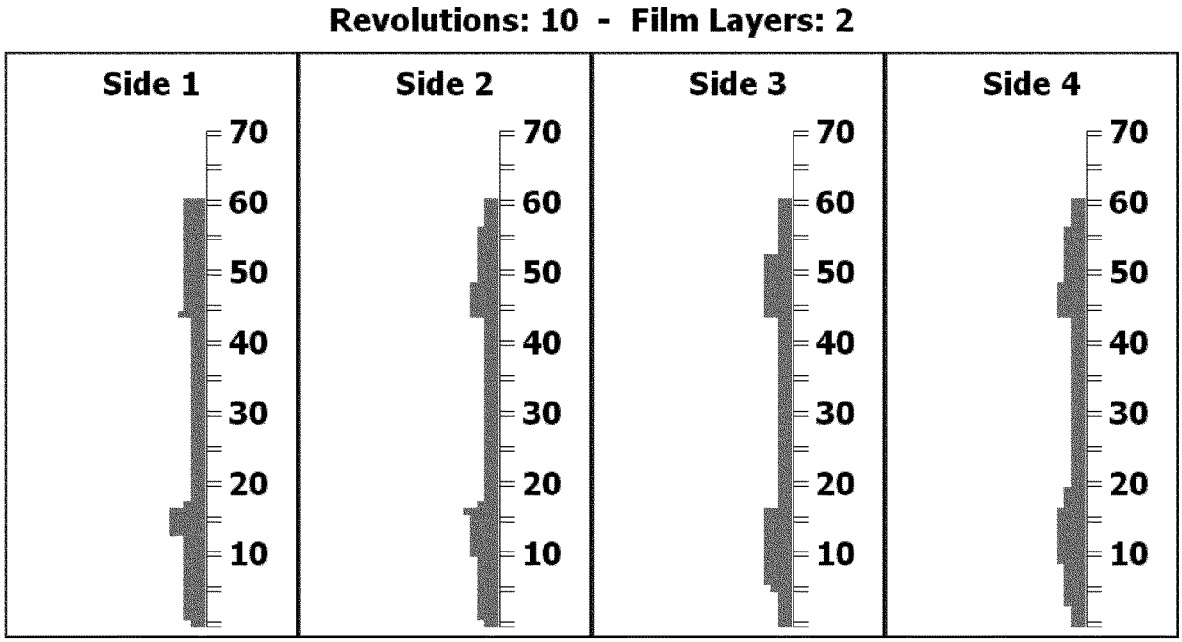
FIGS. 35-37 are example packaging material coverage displays capable of being displayed by the control system of FIG. 8.
Figure 36:
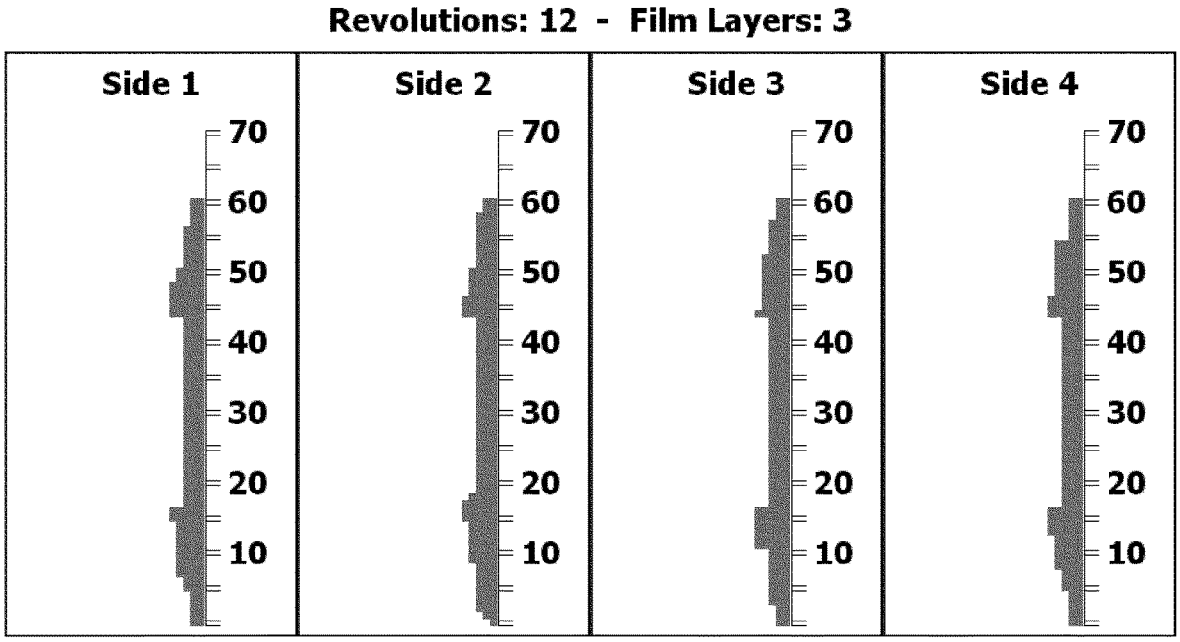
Figure 37:
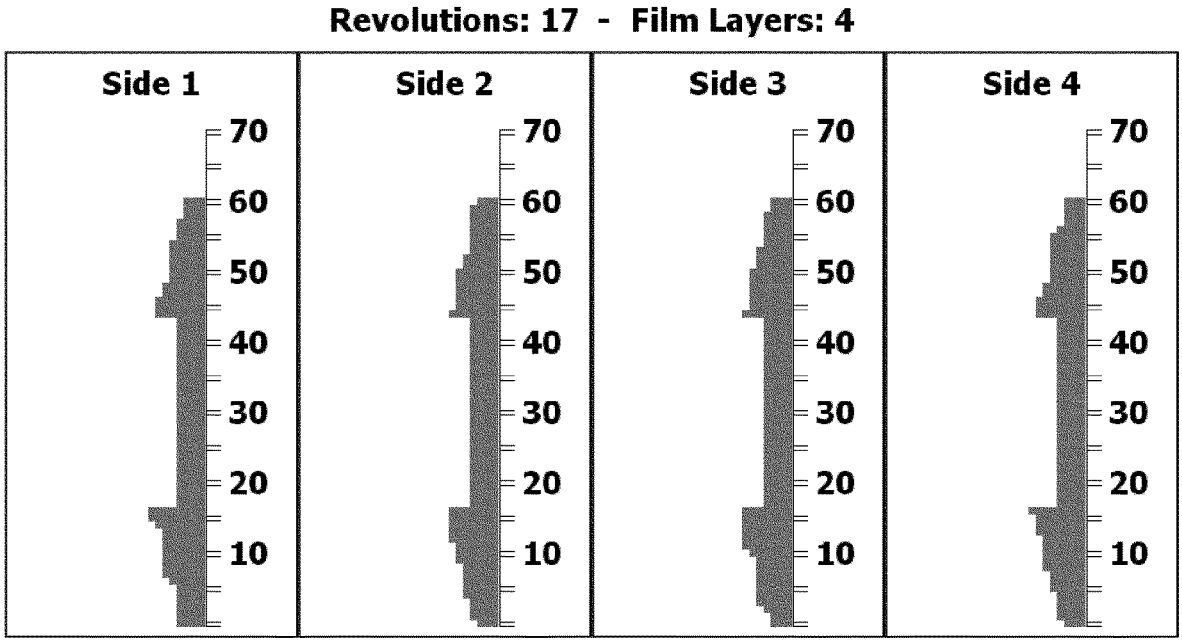

In addition, in some embodiments, it may be desirable to display to an operator a real-time graph of the number of layers of packaging material applied to a load during a wrap operation. For example, a graph may be displayed including a vertical axis representing a vertical dimension of the load and a horizontal axis representing a thickness (in layers) of packaging material applied to the load at a plurality of positions along the vertical dimension of the load. FIGS. 35-37, for example, illustrate example packaging material coverage displays for four sides of an example load for 2, 3 and 4 layers, respectively. Additional details regarding such graphs are disclosed in the aforementioned U.S. Patent Application Publication No. 2012/0102887, incorporated by reference herein.

Other embodiments will be apparent to those skilled in the art from consideration of the specification and practice of the present invention. It is intended that the specification and examples be considered as exemplary only, with a true scope and spirit of the disclosure being indicated by the following claims.

What is claimed is:

1. A method of comparing performance of a plurality of packaging materials capable of being used in a load wrapping apparatus of the type configured to wrap a load on a load support through relative rotation between a packaging material dispenser and the load support, the method comprising:

determining dimensions for a representative load;

determining a load containment force requirement for the representative load;

with a computer, simulating, for each of a plurality of packaging materials, a wrap operation performed on the representative load using such packaging material and meeting the load containment force requirement; and determining, for each of the plurality of packaging materials, a comparative performance parameter for such packaging material based upon the simulation of the wrap operation using such packaging material.

2. The method of claim 1, wherein determining the dimensions includes determining a girth and a height of the representative load.

3. The method of claim 1, wherein determining the dimensions includes receiving the dimensions via input data, determining dimensions of a load that was last wrapped by the load wrapping apparatus, automatically measuring the dimensions while wrapping the load, or retrieving the dimensions from a profile.

4. The method of claim 1, wherein determining the load containment force requirement includes receiving input data associated with the load containment force requirement.

5. The method of claim 1, wherein determining the load containment force requirement includes retrieving the load containment force requirement from a wrap profile.

6. The method of claim 1, wherein the comparative performance parameter is a number of revolutions required to wrap the representative load, a weight of packaging material to wrap the representative load, a cycle time required to wrap the representative load, or a cost required to wrap the representative load.

7. The method of claim 1, further comprising displaying the comparative performance parameter for at least a subset of the plurality of packaging materials to an operator.

8. The method of claim 7, wherein displaying the comparative performance parameter includes concurrently displaying the comparative performance parameters for multiple packaging materials.

9. The method of claim 7, wherein displaying the comparative performance parameter includes displaying the comparative performance parameter for a first packaging material concurrently with displaying a packaging material profile for the first packaging material.

10. The method of claim 1, further comprising automatically selecting an optimal packaging material among the plurality of packaging materials to be used to wrap a load based upon the comparative performance parameter thereof.

11. The method of claim 10, further comprising:

determining a plurality of comparative performance parameters for each packaging material; and receiving input data selecting a first comparative performance parameter from among the plurality of comparative performance parameters, wherein automatically selecting the optimal packaging material includes automatically selecting the packaging material that optimizes the first comparative performance parameter.

12. The method of claim 10, further comprising, after automatically selecting the optimal packaging material, updating at least one of a layer parameter and a wrap force parameter to be used to wrap the load based upon a packaging material attribute of the optimal packaging material and the load containment force requirement.

13. The method of claim 1, wherein simulating a wrap operation performed on the representative load for a first packaging material among the plurality of packaging material includes determining at least one of a number of layers of packaging material and a wrap force to be applied to the representative load to meet the load containment force requirement based on a packaging material attribute associated with the first packaging material.

14. The method of claim 13, wherein determining the comparative performance parameter for the first packaging material includes determining a number of revolutions required to wrap the representative load based on the dimensions of the representative load, a width of the first packaging material, and the number of layers of packaging material.

15. The method of claim 14, wherein determining the comparative performance parameter for the first packaging material includes determining a weight of the first packaging material required to wrap the representative load based on the dimensions of the representative load, the number of revolutions, and a weight attribute for the first packaging material.

16. An apparatus for wrapping a load supported by a load support with packaging material, the apparatus comprising:

a packaging material dispenser for dispensing packaging material to the load, wherein the packaging material dispenser and the load support are adapted for rotation relative to one other; and a controller configured to compare performance of a plurality of packaging materials by:

determining dimensions for a representative load;

determining a load containment force requirement for the representative load;

simulating, for each of a plurality of packaging materials, a wrap operation performed on the representative load using such packaging material and meeting the load containment force requirement; and determining, for each of the plurality of packaging materials, a comparative performance parameter for such packaging material based upon the simulation of the wrap operation using such packaging material.

17. The apparatus of claim 16, wherein the controller is configured to determine the dimensions by determining a girth and a height of the representative load.

18. The apparatus of claim 16, wherein the controller is configured to determine the dimensions by receiving the dimensions via input data, determining dimensions of a load that was last wrapped by the load wrapping apparatus, automatically measuring the dimensions while wrapping the load, or retrieving the dimensions from a profile.

19. The apparatus of claim 16, wherein the controller is configured to determine the load containment force requirement by receiving input data associated with the load containment force requirement.

20. The apparatus of claim 16, wherein the controller is configured to determine the load containment force requirement by retrieving the load containment force requirement from a wrap profile.

21. The apparatus of claim 16, wherein the comparative performance parameter is a number of revolutions required to wrap the representative load, a weight of packaging material to wrap the representative load, a cycle time required to wrap the representative load, or a cost required to wrap the representative load.

22. The apparatus of claim 16, wherein the controller is further configured to display the comparative performance parameter for at least a subset of the plurality of packaging materials to an operator.

23. The apparatus of claim 22, wherein the controller is configured to display the comparative performance parameter by concurrently displaying the comparative performance parameters for multiple packaging materials.

24. The apparatus of claim 22, wherein the controller is configured to display the comparative performance parameter by displaying the comparative performance parameter for a first packaging material concurrently with displaying a packaging material profile for the first packaging material.

25. The apparatus of claim 16, wherein the controller is further configured to automatically select an optimal packaging material among the plurality of packaging materials to be used to wrap a load based upon the comparative performance parameter thereof.

26. The apparatus of claim 25, wherein the controller is further configured to:

determine a plurality of comparative performance parameters for each packaging material; and receive input data selecting a first comparative performance parameter from among the plurality of comparative performance parameters, wherein the controller is configured to automatically select the optimal packaging material by automatically selecting the packaging material that optimizes the first comparative performance parameter.

27. The apparatus of claim 25, wherein the controller is further configured to, after automatically selecting the optimal packaging material, update at least one of a layer parameter and a wrap force parameter to be used to wrap the load based upon a packaging material attribute of the optimal packaging material and the load containment force requirement.

28. The apparatus of claim 16, wherein the controller is configured to simulate a wrap operation performed on the representative load for a first packaging material among the plurality of packaging material by determining at least one of a number of layers of packaging material and a wrap force to be applied to the representative load to meet the load containment force requirement based on a packaging material attribute associated with the first packaging material.

29. The apparatus of claim 28, wherein the controller is configured to determine the comparative performance parameter for the first packaging material by determining a number of revolutions required to wrap the representative load based on the dimensions of the representative load, a width of the first packaging material, and the number of layers of packaging material.

30. The apparatus of claim 29, wherein the controller is configured to determine the comparative performance parameter for the first packaging material by determining a weight of the first packaging material required to wrap the representative load based on the dimensions of the representative load, the number of revolutions, and a weight attribute for the first packaging material.

31. A program product, comprising:

a non-transitory computer readable medium; and program code stored on the non-transitory computer readable medium and configured to compare performance of a plurality of packaging materials capable of being used in a load wrapping apparatus of the type configured to wrap a load on a load support through relative rotation between a packaging material dispenser and the load support, the program code configured to compare performance by:

determining dimensions for a representative load;

determining a load containment force requirement for the representative load;

simulating, for each of a plurality of packaging materials, a wrap operation performed on the representative load using such packaging material and meeting the load containment force requirement; and determining, for each of the plurality of packaging materials, a comparative performance parameter for such packaging material based upon the simulation of the wrap operation using such packaging material.

* * * * *